US012680217B2

(12) United States Patent
Li et al.

(10) Patent No.: US 12,680,217 B2
(45) Date of Patent: Jul. 14, 2026

(54) DRYING SYSTEM AND LAUNDRY MACHINES USING THE SAME

(71) Applicant: Nanjing Roborock Innovation Technology Co., Ltd., Nanjing (CN)

(72) Inventors: Xing Li, Shenzhen (CN); Chuanlin Duan, Shenzhen (CN); Yadong Yan, Shenzhen (CN); Jibai Huang, Shenzhen (CN); Zhimin Yang, Shenzhen (CN); Zhe Wang, Shenzhen (CN); Ming Liu, Shenzhen (CN); Chenghu Lin, Shenzhen (CN); Junjun Fang, Shenzhen (CN); Hang Qi, Shenzhen (CN); Ming Xu, Shenzhen (CN); Tong Liu, Shenzhen (CN); Gang Quan, Shenzhen (CN)

(73) Assignee: NANJING ROBOROCK INNOVATION TECHNOLOGY CO., LTD., Nanjing (CN)

( * ) Notice: Subject to any disclaimer, the term of this patent is extended or adjusted under 35 U.S.C. 154(b) by 96 days.

(21) Appl. No.: 18/688,586

(22) PCT Filed: Sep. 1, 2022

(86) PCT No.: PCT/IB2022/058200
§ 371 (c)(1),
(2) Date: Mar. 1, 2024

(87) PCT Pub. No.: WO2023/031837
PCT Pub. Date: Mar. 9, 2023

(65) Prior Publication Data
US 2024/0368820 A1 Nov. 7, 2024

(30) Foreign Application Priority Data
Sep. 1, 2021 (CN) ..... 202111023112.5
Nov. 30, 2021 (CN) ..... 202111450553.3
(Continued)

(51) Int. Cl.
*D06F 39/20* (2024.01)
*D06F 25/00* (2006.01)
(Continued)

(52) U.S. Cl.
CPC ..... *D06F 39/20* (2024.01); *D06F 25/00* (2013.01); *D06F 29/005* (2013.01); *D06F 39/04* (2013.01);
(Continued)

(58) Field of Classification Search
CPC ..... D06F 25/00; D06F 29/005; D06F 39/04; D06F 39/10; D06F 39/20; D06F 58/10;
(Continued)

(56) References Cited

U.S. PATENT DOCUMENTS 4,848,105 A 7/1989 O'Connell et al.
5,343,632 A 9/1994 Dinh
(Continued)

FOREIGN PATENT DOCUMENTS

CN 1139163 A 1/1997
CN 1481460 A 3/2004
(Continued)

OTHER PUBLICATIONS

Machine translation of JP-2002340372 A to Ishii et al. (Year: 2002).*
(Continued)

*Primary Examiner* — Joseph L. Perrin
(74) *Attorney, Agent, or Firm* — Calfee, Halter & Griswold LLP

(57) ABSTRACT

Laundry machines and methods for operating the same are disclosed. A laundry machine includes a container for containing laundry and a dehumidifier including a circulation fan for generating moist air flowing out of the container toward a moisture absorption and removal structure for absorbing moisture in the moist air, a regeneration fan for generating airflow including the moisture absorbed by the moisture absorption and removal structure to flow toward a condenser for condensing water from the generated airflow. The moisture absorption and removal structure is disposed adjacent to the circulation fan, the regeneration fan, and the condenser; wherein the moisture absorption and removal structure comprises a roller assembly, a functional roller is provided on at least one of a bottom portion of the roller assembly or a side of the roller assembly.

20 Claims, 45 Drawing Sheets

(30) Foreign Application Priority Data

Aug. 31, 2022 (WO) ..... PCT/CN2022/116142
Aug. 31, 2022 (WO) ..... PCT/CN2022/116242
Aug. 31, 2022 (WO) ..... PCT/CN2022/116387

(51) Int. Cl.

| | |
|---|---|
| ***D06F 29/00*** | (2006.01) |
| ***D06F 39/04*** | (2006.01) |
| ***D06F 39/10*** | (2006.01) |
| ***D06F 58/10*** | (2006.01) |
| ***D06F 58/20*** | (2006.01) |
| ***D06F 58/22*** | (2006.01) |
| ***D06F 58/24*** | (2006.01) |
| ***D06F 58/26*** | (2006.01) |

(52) U.S. Cl.
CPC ..... *D06F 39/10* (2013.01); *D06F 58/10* (2013.01); *D06F 58/206* (2013.01); *D06F 58/22* (2013.01); *D06F 58/24* (2013.01); *D06F 58/26* (2013.01); *D06F 58/20* (2013.01)

(58) Field of Classification Search
CPC ..... D06F 58/20; D06F 58/22; D06F 58/24; D06F 58/26; D06F 58/206
See application file for complete search history.

(56) References Cited

U.S. PATENT DOCUMENTS

| | | | | |
|---|---|---|---|---|
| 10,633,785 | B2 | 4/2020 | Bocchino | |
| 2006/0075577 | A1 | 4/2006 | Jeong et al. | |
| 2007/0119072 | A1 | 5/2007 | Kim et al. | |
| 2008/0276656 | A1 | 11/2008 | Kitamura et al. | |
| 2009/0249639 | A1 | 10/2009 | Kim et al. | |
| 2010/0146811 | A1 | 6/2010 | Steffens | |
| 2011/0041260 | A1 | 2/2011 | Belinski | |
| 2011/0225839 | A1 | 9/2011 | Marioni | |
| 2011/0302967 | A1* | 12/2011 | Grunert | D06F 58/45 134/18 |
| 2012/0055519 | A1 | 3/2012 | Hong et al. | |
| 2012/0090189 | A1 | 4/2012 | Kwon | |
| 2012/0102781 | A1 | 5/2012 | Beers et al. | |
| 2013/0019495 | A1 | 1/2013 | Colombo et al. | |
| 2013/0263630 | A1 | 10/2013 | Doh et al. | |
| 2013/0318813 | A1 | 12/2013 | Hong et al. | |
| 2014/0026433 | A1 | 1/2014 | Bison | |
| 2015/0020398 | A1* | 1/2015 | Bae | D06F 58/20 34/80 |
| 2015/0259847 | A1 | 9/2015 | Kohavi et al. | |
| 2015/0342441 | A1 | 12/2015 | Hahm et al. | |
| 2017/0191211 | A1 | 7/2017 | Kim et al. | |
| 2019/0292705 | A1 | 9/2019 | Boutiette | |
| 2020/0299892 | A1 | 9/2020 | Hahm et al. | |
| 2020/0308756 | A1 | 10/2020 | Hong et al. | |

FOREIGN PATENT DOCUMENTS

| | | | |
|---|---|---|---|
| CN | 1773179 | A | 5/2006 |
| CN | 1782170 | A | 6/2006 |
| CN | 1782200 | A | 6/2006 |
| CN | 1886628 | A | 12/2006 |
| CN | 1888268 | A | 1/2007 |
| CN | 1936160 | A | 3/2007 |
| CN | 200971444 | Y | 11/2007 |
| CN | 101277748 | A | 10/2008 |
| CN | 101343826 | A | 1/2009 |
| CN | 101403180 | A | 4/2009 |
| CN | 100519910 | C | 7/2009 |
| CN | 101517145 | A | 8/2009 |
| CN | 101530721 | A | 9/2009 |
| CN | 101876132 | A | 11/2010 |
| CN | 101967746 | A | 2/2011 |
| CN | 102031682 | A | 4/2011 |
| CN | 102206916 | A | 10/2011 |
| CN | 102286872 | A | 12/2011 |
| CN | 202116896 | U | 1/2012 |
| CN | 101530721 | B | 5/2012 |
| CN | 102482828 | A | 5/2012 |
| CN | 103080410 | A | 5/2013 |
| CN | 202983456 | U | 6/2013 |
| CN | 103266458 | A | 8/2013 |
| CN | 103712333 | A | 4/2014 |
| CN | 103797174 | A | 5/2014 |
| CN | 103797179 | A | 5/2014 |
| CN | 104169489 | A | 11/2014 |
| CN | 203980455 | U | 12/2014 |
| CN | 104514136 | A | 4/2015 |
| CN | 104520492 | A | 4/2015 |
| CN | 102441320 | B | 5/2015 |
| CN | 204491256 | U | 7/2015 |
| CN | 104947387 | A | 9/2015 |
| CN | 105297372 | A | 2/2016 |
| CN | 105324528 | A | 2/2016 |
| CN | 105421007 | A | 3/2016 |
| CN | 105463812 | A | 4/2016 |
| CN | 205483320 | U | 8/2016 |
| CN | 105951347 | A | 9/2016 |
| CN | 106016517 | A | 10/2016 |
| CN | 106120238 | A | 11/2016 |
| CN | 103668899 | B | 3/2017 |
| CN | 106498683 | A | 3/2017 |
| CN | 106592183 | A | 4/2017 |
| CN | 106592184 | A | 4/2017 |
| CN | 106676854 | A | 5/2017 |
| CN | 106868831 | A | 6/2017 |
| CN | 106917221 | A | 7/2017 |
| CN | 106948148 | A | 7/2017 |
| CN | 107083640 | A | 8/2017 |
| CN | 105324528 | B | 11/2017 |
| CN | 107447472 | A | 12/2017 |
| CN | 107558128 | A | 1/2018 |
| CN | 107663759 | A | 2/2018 |
| CN | 107663761 | A | 2/2018 |
| CN | 107675453 | A | 2/2018 |
| CN | 107690491 | A | 2/2018 |
| CN | 206956374 | U | 2/2018 |
| CN | 107773187 | A | 3/2018 |
| CN | 207159639 | U | 3/2018 |
| CN | 107869034 | A | 4/2018 |
| CN | 107974813 | A | 5/2018 |
| CN | 108004733 | A | 5/2018 |
| CN | 108085926 | A | 5/2018 |
| CN | 108265459 | A | 7/2018 |
| CN | 108362400 | A | 8/2018 |
| CN | 108729106 | A | 11/2018 |
| CN | 108930148 | A | 12/2018 |
| CN | 109112804 | A | 1/2019 |

(56) References Cited

FOREIGN PATENT DOCUMENTS

| | | | |
|---|---|---|---|
| CN | 109281118 | A | 1/2019 |
| CN | 109402988 | A | 3/2019 |
| CN | 208618146 | U | 3/2019 |
| CN | 109629168 | A | 4/2019 |
| CN | 109629206 | A | 4/2019 |
| CN | 109654867 | A | 4/2019 |
| CN | 110055730 | A | 7/2019 |
| CN | 110398062 | A | 11/2019 |
| CN | 209873396 | U | 12/2019 |
| CN | 209989600 | U | 1/2020 |
| CN | 210031236 | U | 2/2020 |
| CN | 105369574 | B | 4/2020 |
| CN | 111101350 | A | 5/2020 |
| CN | 111101351 | A | 5/2020 |
| CN | 111235844 | A | 6/2020 |
| CN | 111279028 | A | 6/2020 |
| CN | 210786526 | U | 6/2020 |
| CN | 211036459 | U | 7/2020 |
| CN | 111485403 | A | 8/2020 |
| CN | 111560642 | A | 8/2020 |
| CN | 111575986 | A | 8/2020 |
| CN | 111926524 | A | 11/2020 |
| CN | 111928355 | A | 11/2020 |
| CN | 111962252 | A | 11/2020 |
| CN | 212199700 | U | 12/2020 |
| CN | 212431694 | U | 1/2021 |
| CN | 112342732 | A | 2/2021 |
| CN | 112553849 | A | 3/2021 |
| CN | 112709040 | A | 4/2021 |
| CN | 112726111 | A | 4/2021 |
| CN | 112726155 | A | 4/2021 |
| CN | 112779718 | A | 5/2021 |
| CN | 112831995 | A | 5/2021 |
| CN | 113201899 | A | 8/2021 |
| CN | 213896424 | U | 8/2021 |
| CN | 213955461 | U | 8/2021 |
| CN | 113389024 | A | 9/2021 |
| CN | 113418242 | A | 9/2021 |
| CN | 113584800 | A | 11/2021 |
| CN | 113605036 | A | 11/2021 |
| CN | 214747116 | U | 11/2021 |
| CN | 113767193 | A | 12/2021 |
| CN | 113981647 | A | 1/2022 |
| CN | 113997532 | A | 2/2022 |
| CN | 114016266 | A | 2/2022 |
| CN | 114016267 | A | 2/2022 |
| CN | 114059260 | A | 2/2022 |
| CN | 114136000 | A | 3/2022 |
| CN | 114197183 | A | 3/2022 |
| CN | 114232272 | A | 3/2022 |
| CN | 114293357 | A | 4/2022 |
| CN | 114318814 | A | 4/2022 |
| CN | 216274879 | U | 4/2022 |
| CN | 114438727 | A | 5/2022 |
| CN | 216585700 | U | 5/2022 |
| CN | 114606738 | A | 6/2022 |
| CN | 114606745 | A | 6/2022 |
| CN | 216755943 | U | 6/2022 |
| CN | 216769611 | U | 6/2022 |
| CN | 216769639 | U | 6/2022 |
| CN | 114687150 | A | 7/2022 |
| CN | 114753102 | A | 7/2022 |
| CN | 114775216 | A | 7/2022 |
| CN | 216919741 | U | 7/2022 |
| CN | 217052784 | U | 7/2022 |
| CN | 114867903 | A | 8/2022 |
| CN | 114908538 | A | 8/2022 |
| CN | 114941226 | A | 8/2022 |
| CN | 114941236 | A | 8/2022 |
| CN | 115198476 | A | 10/2022 |
| CN | 115216913 | A | 10/2022 |
| CN | 115247341 | A | 10/2022 |
| CN | 115262161 | A | 11/2022 |
| CN | 115287866 | A | 11/2022 |
| CN | 218492015 | U | 2/2023 |
| CN | 218492017 | U | 2/2023 |
| CN | 218508054 | U | 2/2023 |
| CN | 218508057 | U | 2/2023 |
| CN | 218508058 | U | 2/2023 |
| CN | 218521469 | U | 2/2023 |
| CN | 218521470 | U | 2/2023 |
| CN | 218521471 | U | 2/2023 |
| CN | 218521473 | U | 2/2023 |
| CN | 218540129 | U | 2/2023 |
| CN | 115726127 | A | 3/2023 |
| CN | 115726129 | A | 3/2023 |
| CN | 218580287 | U | 3/2023 |
| CN | 218621460 | U | 3/2023 |
| CN | 115928365 | A | 4/2023 |
| CN | 218812688 | U | 4/2023 |
| CN | 218842642 | U | 4/2023 |
| CN | 218861140 | U | 4/2023 |
| DE | 3626887 | A1 | 2/1988 |
| DE | 19952751 | B4 | 1/2009 |
| EP | 2527527 | A1 | 11/2012 |
| EP | 3696313 | A1 | 8/2020 |
| EP | 3733955 | A1 | 11/2020 |
| JP | S58118796 | A | 7/1983 |
| JP | H02159299 | A | 6/1990 |
| JP | H02215500 | A | 8/1990 |
| JP | H0510669 | A | 1/1993 |
| JP | H0549796 | A | 3/1993 |
| JP | H0994388 | A | 4/1997 |
| JP | H1176696 | A | 3/1999 |
| JP | 2000051576 | A | 2/2000 |
| JP | 2000225288 | A | 8/2000 |
| JP | 2001170398 | A | 6/2001 |
| JP | 2002340372 | A | 11/2002 |
| JP | 2004313231 | A | 11/2004 |
| JP | 2005021601 | A | 1/2005 |
| JP | 2005205276 | A | 8/2005 |
| JP | 2006020754 | A | 1/2006 |
| JP | 2006281046 | A | 10/2006 |
| JP | 2007075241 | A | 3/2007 |
| JP | 2007098262 | A | 4/2007 |
| JP | 2007127339 | A | 5/2007 |
| JP | 2007225234 | A | 9/2007 |
| JP | 2007301010 | A | 11/2007 |
| JP | 2007306960 | A | 11/2007 |
| JP | 2007531552 | A | 11/2007 |
| JP | 2008029654 | A | 2/2008 |
| JP | 2008035958 | A | 2/2008 |
| JP | 2008055077 | A | 3/2008 |
| JP | 2008086693 | A | 4/2008 |
| JP | 2008086904 | A | 4/2008 |
| JP | 2008259665 | A | 10/2008 |
| JP | 2008289647 | A | 12/2008 |
| JP | 2009131786 | A | 6/2009 |
| JP | 2009240937 | A | 10/2009 |
| JP | 2009285237 | A | 12/2009 |
| JP | 2010167178 | A | 8/2010 |
| JP | 2010259994 | A | 11/2010 |
| JP | 2011036810 | A | 2/2011 |
| JP | 2011067510 | A | 4/2011 |
| JP | 2012029783 | A | 2/2012 |
| JP | 2012070956 | A | 4/2012 |
| JP | 2012161355 | A | 8/2012 |
| JP | 2014515468 | A | 6/2014 |
| JP | 2014128346 | A | 7/2014 |
| JP | 2015167694 | A | 9/2015 |
| JP | 2017093816 | A | 6/2017 |
| JP | 2018071901 | A | 5/2018 |
| JP | 2019051042 | A | 4/2019 |
| JP | 2019097580 | A | 6/2019 |
| JP | 2019150413 | A | 9/2019 |
| JP | 2019187613 | A | 10/2019 |
| JP | 2020521607 | A | 7/2020 |
| JP | 2021508568 | A | 3/2021 |
| JP | 2021517475 | A | 7/2021 |
| JP | 2021121262 | A | 8/2021 |
| JP | 2021134749 | A | 9/2021 |
| KR | 20050012100 | A | 1/2005 |
| KR | 20070076853 | A | 7/2007 |
| KR | 20090001073 | A | 1/2009 |

(56) References Cited

FOREIGN PATENT DOCUMENTS

| | | | |
|---|---|---|---|
| KR | 101579465 | A | 1/2015 |
| KR | 20150010584 | A | 1/2015 |
| KR | 101579465 | B1 | 12/2015 |
| KR | 20180027046 | A | 3/2018 |
| KR | 20180078083 | A | 7/2018 |
| KR | 20190000147 | A | 1/2019 |
| KR | 20190128469 | A | 11/2019 |
| RU | 2456392 | C2 | 7/2012 |
| RU | 2710409 | C1 | 12/2019 |
| TW | 1755824 | B | 2/2022 |
| WO | 2005/012623 | A1 | 2/2005 |
| WO | 2005/012624 | A1 | 2/2005 |
| WO | 2007/077072 | A1 | 7/2007 |
| WO | 2011042345 | A1 | 4/2011 |
| WO | 2011045914 | A1 | 4/2011 |
| WO | 2011045915 | A1 | 4/2011 |
| WO | 2012/134159 | A1 | 10/2012 |
| WO | 2012134159 | A2 | 10/2012 |
| WO | 2018196766 | A1 | 11/2018 |
| WO | 2019/141056 | A1 | 7/2019 |
| WO | 2023/030375 | A1 | 3/2023 |

OTHER PUBLICATIONS

Office action from Chinese Application No. 202211056654.7 dated Feb. 8, 2024.
International Search Report from PCT/CN2023/072664 dated Feb. 20, 2023.
International Search Report from PCT/CN2023/096634 dated Aug. 30, 2023.
Office action from Taiwanese Application No. 112132714 dated Jan. 9, 2024.
International Search Report from PCT/CN2023/115561 dated Nov. 4, 2023.
International Search Report for PCT/CN2023/072564 dated May 4, 2023.
International Search Report for PCT/CN2023/072662 dated May 8, 2023.
International Search Report for PCT/CN2023/072666 dated May 25, 2023.
International Search Report for PCT/CN2023/096639 dated Nov. 29, 2023.
International Search Report for PCT/CN2023/114624 dated Oct. 16, 2023.
International Search Report for PCT/CN2023/114751 dated Nov. 23, 2023.
International Search Report for PCT/CN2023/114753 dated Nov. 24, 2023.
International Search Report for PCT/CN2023/114994 dated Nov. 24, 2023.
First Office Action of TW application No. 112132359 dated Mar. 29, 2024.
First Office Action of TW application No. 112132636 dated Apr. 29, 2024.
First Office Action of TW application No. 112133025 dated Apr. 22, 2024.
Notice of Allowance of TW application No. 112132718 dated Feb. 27, 2024.
International Search Report from PCT/CN2022/116142 dated Nov. 30, 2022.
International Search Report from PCT/CN2022/116387 dated Nov. 29, 2022.
International Search Report from PCT/IB2022/058200 dated Feb. 6, 2023.
International Search Report from PCT/CN2022/135667 dated Feb. 20, 2023.
Office action from Taiwanese Application No. 111133042 dated Sep. 20, 2023.
International Search Report from PCT/CN2022/116242 dated Nov. 30, 2022.
International Search Report from PCT/CN2023/072661 dated May 16, 2023.
Office action from Chinese Application No. 202211057592.1 dated Aug. 18, 2023.
Second Office Action of CN application No. 202211056654.7 dated Jun. 14, 2024.
Decision of Rejection of CN application No. 202211056654.7 dated Aug. 23, 2024.
Notice of Allowance of RU application No. 2024106506 dated Aug. 28, 2024.
First Office Action of TW application No. 112132301 dated Nov. 30, 2023.
First Office Action of TW application No. 112132637 dated Jan. 29, 2024.
First Office Action of TW application No. 112132644 dated Apr. 29, 2024.
First Office Action of TW application No. 112132713 dated Jun. 21, 2023.
First Office Action of TW application No. 112132719 dated Jun. 21, 2023.
First Office Action of TW application No. 112132721 dated Jun. 21, 2023.
First Office Action of TW application No. 112132724 dated Jul. 12, 2023.
First Office Action of TW application No. 112132736 dated Dec. 28, 2022.
Paper named "Principle and Maintenance of Fully-Automatic Washing Machine" with a publication date of Jun. 30, 2000.
Extended European Search Report of application No. 22863556.1 dated Jul. 18, 2025.
Second Office Action of JP application No. 2024-514367 dated Sep. 9, 2025.
First Office Action after reexamination of TW application No. 112132724 dated Aug. 11, 2025.
First Office Action after reexamination of TW application No. 112132844 dated Aug. 8, 2025.
First Office Action of AU application No. 2022336912 dated Jun. 6, 2025.
First Office Action of CN application No. 202211056653.2 dated May 16, 2025.
First Office Action of CN application No. 202211056667.4 dated May 23, 2025.
First Office Action of CN application No. 202211057581.3 dated Apr. 19, 2025.
First Office Action of CN application No. 202211059234.4 dated May 16, 2025.
First Office Action of CN application No. 202211060628.1 dated May 16, 2025.
First Office Action of CN application No. 202211060807.5 dated Apr. 19, 2025.
First Office Action of CN application No. 202211066537.9 dated Apr. 19, 2025.
First Office Action of CN application No. 202211058646.6 dated May 24, 2025.
Second Office Action of RU application No. 2024117896 dated Apr. 28, 2025.
First Office Action of JP application No. 2024-514365 dated Jun. 3, 2025.
First Office Action of JP application No. 2024-514367 dated May 20, 2025.
First Office Action of JP application No. 2024-532426 dated Apr. 1, 2025.
First Office Action after reexamination of TW application No. 112132719 dated Oct. 2, 2025.
Notice of Allowance of TW application No. 112132721dated Oct. 2, 2025.
Notice of Allowance of TW application No. 112132713 dated Oct. 9, 2025.
Decision of Rejection of CN application No. 202211058646.6 dated Nov. 12, 2025.
Extended European Search Report of EP application No. 22900567.3 dated Oct. 24, 2025.

(56) References Cited

OTHER PUBLICATIONS

Decision of Rejection of CN application No. 202211057581.3 dated Oct. 28, 2025.
First Office Action of KR application No. 10-2024-7007632 dated Dec. 8, 2025.
First Office Action of KR application No. 10-2024-7007710 dated Dec. 11, 2025.
Third Office Action of JP application No. 2024-514384 dated Dec. 16, 2025.
First Office Action of CN application No. 202310110896.8 dated Dec. 25, 2025.
Book named "What Should Novice Cost Engineers Learn to Get Started Quickly—Installation Engineering Cost Estimation", Linhua Yang et al., May 2021, p. 75.
Book named "Hydraulic and Hydroelectric Drilling Manual", Ming Ma et al., Aug. 2021, p. 27.
Decision of Reexamination of CN application No. 202211056654.7 dated Jan. 7, 2026.
Decision of Rejection of CN application No. 202211060807.5 dated Jan. 29, 2026.
Non-final Office Action of U.S. Appl. No. 18/688,711 dated Jan. 27, 2026.
Non-final Office Action of U.S. Appl. No. 18/688,706 dated Jan. 30, 2026.
Washing machine-impeller, drum and stirring type, Edited by Wenxian XU, Jun. 1991, pp. 110-111.
First Office Action of CN application No. 2022800581731 dated Apr. 28, 2026.

* cited by examiner

1210

1210

DRYING SYSTEM AND LAUNDRY MACHINES USING THE SAME

CROSS-REFERENCE TO RELATED APPLICATION

This application a U.S. National Stage of International Application No. PCT/IB2022/058200, filed on Sep. 1, 2022, entitled "DRYING SYSTEM AND LAUNDRY MACHINES USING THE SAME", which claims priority to and the benefit of Chinese Patent Application No. CN202111023112.5, filed on Sep. 1, 2021, Chinese Patent Application No. CN202111450553.3, filed on Nov. 30, 2021, a PCT International Application No. PCT/CN2022/116142, filed on Aug. 31, 2022, a PCT International Application No. PCT/CN2022/116242, filed on Aug. 31, 2022, and a PCT International Application No. PCT/CN2022/116387, filed on Aug. 31, 2022, which are incorporated herein by reference in their entireties.

TECHNICAL FIELD

The present disclosure generally relates to the field of household appliances, in particular to a laundry machine, such as a washer, a dryer, or an integrated washing and drying system (e.g., a built-in, integrated, or all-in-one washer dryer), and methods of operating the same.

BACKGROUND

With the improvement of the living standard, the living style is changing continuously. People are no longer satisfied with the basic functions of the consumer appliances.

For example, in the washing machine industry, the fully automatic integrated washer dryer can dry the clothes after finish washing the clothes. This function is particularly suitable for humid weather. As such, the fully automatic integrated washer dryer is favored by more consumers. The drying system of the existing integrated washer dryer utilizes an evaporator to heat and absorb the moisture from the damp air in the inner drum of the integrated washer dryer. The obtained heated air enters the inner drum of the integrated washer dryer again, so that the moisture in clothes can be evaporated. However, the overall temperature of the evaporator is consistent. In the process of heating and absorbing moisture from the humid air, the moisture absorption capacity of the evaporator to the humid air is reduced, resulting in low moisture absorption efficiency, long drying time, and high power consumption. Particularly in areas with lower temperatures, the temperature of the humid air is also lower. As a result, the temperature of the evaporator is difficult to reach the moisture absorption temperature, which further results in reduced the moisture absorption efficiency, longer drying time, and higher power consumption.

In another example, for different members of the family, people have different washing and drying requirements for different laundry items, hence the twin load washing machines (or double load, dual load, etc.) become suitable. For example, the upper washing area of the twin load washing machine can be used for washing and drying laundry items made of particular fabrics, such as children's clothes and women's underwear, etc., to provide better care during the washing process. Meanwhile, the lower washing area can be mainly used for washing and drying common laundry items, such as adults' daily clothes. However, in the existing twin load washing machines, the upper washing area and the lower washing area use independent and separate washing systems and drying systems, respectively, resulting in the washing machine being too high, too bulky, inconvenient for users to operate, and high in cost.

SUMMARY

Consistent with embodiments of the present disclosure, a laundry machine is provided. The laundry machine comprises a container for containing laundry; and a dehumidifier including a circulation fan configured to circulate moist air flowing out of the container toward a moisture absorption and removal structure configured to absorb moisture in the moist air, a regeneration fan configured to generate airflow to exhaust the moisture absorbed by the moisture absorption and removal structure and drive the airflow to flow toward a condenser configured to condense water from the generated airflow, wherein the moisture absorption and removal structure is disposed adjacent to the circulation fan, the regeneration fan, and the condenser; wherein the moisture absorption and removal structure comprises a roller assembly, a functional roller is provided on at least one of a bottom portion of the roller assembly or a side of the roller assembly.

In some embodiments, the circulation fan and the condenser are disposed adjacent to and on opposite sides of the regeneration fan.

In some embodiments, the moisture absorption and removal structure is disposed in a common plane with at least one of the circulation fan, the regeneration fan, and the condenser.

In some embodiments, the circulation fan, the moisture absorption and removal structure, the regeneration fan, and the condenser are disposed in a common plane.

In some embodiments, two or more of respective rotation axes of the circulation fan, the roller assembly, and the regeneration fan in the dehumidifier are parallel to each other.

In some embodiments, the the functional roller further comprises a plurality of auxiliary rollers provided on the side of the roller assembly, the plurality of auxiliary rollers are contained in respective housings on a lower casing for containing one or more parts of the dehumidifier, wherein rotation axes of the plurality of auxiliary rollers are placed parallel to a rotation axis of a roller of the roller assembly.

In some embodiments, the functional roller further comprises: a plurality of vertical rollers provided on the bottom portion of the roller assembly, wherein the plurality of vertical rollers are distributed on a lower casing for containing one or more parts of the dehumidifier and rotation axes of the plurality of vertical rollers are placed vertically relative to a rotation axis of a roller of the roller assembly.

In some embodiments, one or more of respective rotation axes of the circulation fan, the roller assembly, and the regeneration fan in the dehumidifier are perpendicular to a rotation axis of the container.

In some embodiments, one or more of respective rotation axes of the circulation fan, the roller assembly, and the regeneration fan in the dehumidifier are parallel to a rotation axis of the container.

In some embodiments, the laundry machine further comprises a lower casing including a plurality of areas configured to contain two or more of the circulation fan, the moisture absorption and removal structure, the regeneration fan, and the condenser, respectively.

In some embodiments, the lower casing is a single integrated part.

In some embodiments, the moisture absorption and removal structure comprises a moisture absorption area and a moisture removal area. In some embodiments, the moisture absorption area comprises at least a first portion of the moisture absorption and removal structure for absorbing the moisture from the moist air circulated from the circulation fan. In some embodiments, the moisture removal area comprises a heating section disposed over a second portion of the moisture absorption and removal structure adjacent the regeneration fan.

In some embodiments, the dehumidifier further comprises a moisture absorption passage, wherein the moisture absorption area is disposed on the moisture absorption passage, and wherein the moisture absorption passage is configured to flow airflow generated by circulation fan from the container to the moisture absorption area.

In some embodiments, the dehumidifier further comprises a moisture removal passage, wherein the moisture removal area is disposed on the moisture removal passage, and wherein the moisture removal passage is configured to flow airflow generated by regeneration fan to flow toward condenser for removing moisture in the airflow.

In some embodiments, the heating section comprises a plurality of heating elements placed adjacent a plurality of air holes in a mesh plate.

In some embodiments, the heating section has a fan-shaped structure, and the plurality of air holes have respective diameters reducing along a radius direction toward a center of the fan-shaped structure.

In some embodiments, the plurality of heating elements are disposed adjacent the plurality of air holes and with an offset along the radius direction toward the center of the fan-shaped structure.

In some embodiments, the laundry machine further comprises an air exhaust passage coupled to an air outlet of the container; and a filter assembly disposed on the air exhaust passage, the filter assembly including a filter screen; and a filter self-cleaning device for cleaning the filter screen.

In some embodiments, the dehumidifier further comprises: a volute casing configured to cover and attach the circulation fan to a lower casing for containing one or more parts of the dehumidifier.

There is also provided an integrated washer dryer including an inner drum, a drying module, a circulation fan, and a regeneration fan, wherein the circulation fan is disposed on the moisture absorption passage to form circulating airflow in the inner drum and the moisture absorption passage, and the regeneration fan is disposed on the regeneration passage to form a dehumidification airflow in the regeneration passage; and wherein the moisture absorption component is disposed on the moisture absorption passage and the regeneration passage to enable the circulating airflow and the dehumidification airflow to flow through the moisture absorption component, wherein the moisture absorption component is configured to absorb moisture of the circulating airflow in the moisture absorption passage during rotation of the moisture absorption component, and discharge the moisture through the moisture exhaust airflow of the regeneration passage.

In some embodiments, the integrated washer dryer further comprises a water inlet and a water outlet respectively coupled with the inner drum.

In some embodiments, the integrated washer dryer further comprises a driving coupled with the inner drum and configured to drive the inner drum to rotate.

In some embodiments, the integrated washer dryer further comprises a filtering part is disposed on the moisture absorption passage, and the filtering part is disposed at the upstream of the moisture absorption component.

In some embodiments, a filtering part is disposed on the regeneration passage.

In some embodiments, a heating member is further disposed on the moisture absorption passage.

In some embodiments, moisture absorption component comprises a moisture absorption rotary disc and a heating assembly.

In some embodiments, the heating assembly covers the regeneration area of the moisture absorption rotary disc, and the moisture absorption area of the moisture absorption rotary disc is positioned in the moisture absorption passage; the regeneration area is an area on the moisture absorption rotary disc, through which the moisture exhaust airflow flows, and the moisture absorption area is an area on the moisture absorption rotary disc, through which the circulating airflow flows.

In some embodiments, the heating assembly comprises a cover; the cover covers a regeneration area of the moisture absorption rotating disc, an area of the cover corresponding to the regeneration area includes an opening connected to a regeneration passage, and a regeneration heating portion is disposed on the housing.

In some embodiments, the moisture absorption rotary disc comprises a moisture absorption roller and a rotary part coupled to the moisture absorption roller; a shell is covered outside the moisture absorption roller, and the moisture absorption roller is configured to rotate relative to the shell when driving by the rotary part; the shell is respectively connected to the moisture absorption passage and the regeneration passage.

In some embodiments, a condensing member is disposed on the regeneration passage, and the condensing member is configured to cool the dehumidification airflow in the regeneration passage to dry the dehumidification airflow.

In some embodiments, the integrated washer dryer further comprises a controller, a temperature sensor is further arranged in the moisture absorption passage, and the controller is electrically connected with the temperature sensor and the heating member respectively; the controller is used for controlling the heating member to be switched on or switched off according to the detected temperature of the temperature sensor.

In some embodiments, a humidity sensor for detecting humidity of the inner drum is further arranged in the inner drum.

In some embodiments, the number of the humidity sensors includes two or more, and the temperature sensors are located at different locations of the inner drum.

In some embodiments, the integrated washer dryer further comprises a housing; the inner drum and the driving part are positioned in the housing, and the regeneration passage is at least partially positioned between the inner drum and the housing; and a second air outlet and a second air inlet are arranged on the side surface of the housing, the second air outlet is connected to the air outlet end of the regeneration passage, and the second air inlet is connected to the air inlet end of the regeneration passage.

In some embodiments, the integrated washer dryer further comprises a housing, the moisture absorption component is located in the housing, the moisture absorption component is fixed, and the housing rotates relative to the moisture absorption component.

According to the integrated washer dryer provided by the embodiments of the disclosure, the moisture absorption component is used for absorbing the moisture of the humid air entering the moisture absorption passage from the inner drum, and then the air after moisture absorption is discharged into the inner drum, so that the moisture in the inner drum is gradually reduced to achieve the drying purpose. Therefore, the integrated washer dryer does not need an evaporator to heat and dehumidify the humid air in the inner drum. Further, by using dehumidifying component insensitive to temperature, the application range of the integrated washer dryer is increased, and the dehumidifying effect is good. Compared with a washer dryer with a heat pump, the integrated washer dryer disclosed in the present disclosure has smaller size, higher economic efficiency, and lower energy consumption.

There is further provided a laundry machine including a housing including a plurality of containers for holding laundry, each of the plurality of containers including an air inlet passage and an air outlet passage; and a dehumidification device configured to selectively dehumidify laundry from a selected container of the plurality of containers, the dehumidification device including an air inlet for connecting with the air outlet passage of the selected container and an air outlet for connecting with the air inlet passage of the selected container.

In some embodiments, the laundry machine further includes a filter assembly, comprising a filter, arranged on the air outlet passage of the selected container or the air inlet of the dehumidification device; and a filter self-cleaning device for cleaning the filter.

In some embodiments, the dehumidification device selectively communicates with one of the plurality of containers in fluid communication through a switching mechanism.

In some embodiments, the dehumidification device includes a moisture absorption channel, a moisture removal channel, and a moisture absorption and moisture removal member, the moisture absorption and moisture removal member includes a moisture absorption area that communicates with the moisture absorption channel and a moisture removal area that communicates with the moisture removal channel; the moisture absorption channel includes the air inlet of the dehumidification device located at an air inlet side on the moisture absorption area of the moisture absorption and moisture removal member and the air outlet of the dehumidification device located at an air outlet side of the moisture absorption area of the moisture absorption and moisture removal member; the moisture removal channel includes an air intake section located on the air inlet side of a moisture removal area of the moisture absorption and moisture removal member, and an air removal section located at the air outlet side of the moisture removal area of the moisture absorption and moisture removal member; the air inlet section of the moisture absorption channel is selectively in communication with the air outlet passage of the selected container, and the air outlet section of the moisture absorption channel is in communication with the air inlet passage of the selected container; or the moisture absorption and moisture removal member is rotatably arranged on the moisture absorption channel and the moisture removal channel.

In some embodiments, the laundry machine further comprises a switching structure including a first switching mechanism and a second switching mechanism, the air inlet passage of the selected container being connected with the air outlet section of the moisture absorption channel through the first switching mechanism, and the air outlet passage of the selected container is connected with the air inlet section of the moisture absorption channel through the second switching mechanism.

In some embodiments, the filter and the filter self-cleaning device are arranged in the air inlet section of the dehumidification device and between the second switching mechanism and the moisture absorption and moisture removal member.

In some embodiments, the second switching mechanism is placed at a joint between the air inlet section of the dehumidification device and the air outlet passage of the container; or the laundry machine includes more than one second of the switching mechanisms arranged in the air outlet passage of the container.

In some embodiments, the laundry machine further comprises more than one set of the filter and the filter self-cleaning device respectively arranged on the air outlet passage of the container and located upstream or downstream of the second switching mechanism.

In some embodiments, the filter self-cleaning device includes a spray mechanism for spraying the filter; or the filter self-cleaning device includes a vibration mechanism for vibrating the filter; or the filter self-cleaning device includes a blowing mechanism for blowing the filter; or the filter self-cleaning device includes a scraping mechanism for scraping the filter.

In some embodiments, a direction in which the fluid of the spray mechanism flows through the filter is opposite to a direction of the airflow through the filter; or the filter and the filter self-cleaning device are arranged in the air inlet section of the dehumidification device, and are located between a switching mechanism and the moisture absorption and moisture removal member, the filter self-cleaning device including a spraying mechanism for spraying the filter, wherein the fluid spraying direction of the spraying mechanism is a direction away from the moisture absorption and moisture removal member.

In some embodiments, a nozzle of the spray mechanism is arranged above a centerline of the filter; or the nozzle of the spray mechanism is arranged on the side of an air outlet of the filter.

In some embodiments, the laundry machine further comprises a fan and a heater are arranged in the moisture removal channel, the heater being located in a vicinity of the moisture removal area of the moisture absorption and moisture removal member.

In some embodiments, the laundry machine further comprises a heat exchanger arranged in the moisture removal channel, the heat exchanger being located on the air outlet side of the moisture removal area, and the heat exchanger includes a ventilation passage in communication with the moisture removal area and a water outlet for draining condensed water; wherein the heat exchanger includes a cooling passage for a coolant to pass through, and an exhaust port of the ventilation passage of the heat exchanger communicates with an air inlet of the fan; or the heat exchanger includes a cooling passage for the coolant to pass through, and the exhaust port of the ventilation passage of the heat exchanger communicates with the outside of the laundry machine; or the fan includes an air inlet passage that passes through the interior of the heat exchanger.

In some embodiments, the laundry machine further comprises a heat exchanger on the air outlet passage of the selected container or in the air inlet section of the dehumidification device to dehumidify and lower the temperature of the air flow discharged from the selected container, the moisture exhaust channel being located upstream of a moisture removal area through inside of the heat exchanger, so that hot and humid air in the air outlet passage of the container or in the air inlet section of the dehumidification device can perform heat exchange with dry and cold air in a moisture discharge passage located on an upstream of the moisture removal area.

In some embodiments, the plurality of containers include an upper tub and a lower tub stacked on top of each other, and the dehumidification device is located between the upper tub and the lower tub, above the upper tub, or below the lower tub.

In some embodiments, the upper tub and the lower tub are both inner tubs of the laundry machine; or the upper tub is the inner tub of a dryer and the lower tub is the inner tub of a washing machine; or the upper tub is the inner tub of the washing machine and the lower tub is the inner tub of the dryer.

There is further provided a method of operating a laundry machine comprising a housing including a plurality of containers for holding laundry, a dehumidification device, and a filter assembly between the dehumidification device and the plurality of containers, the filter assembly including a filter and a filter self-cleaning device. The method comprises performing a dehumidification step including performing moisture removal of one of the containers selected and connected by the dehumidification device, wherein an air flow exhaust from the selected container flows into the dehumidification device via the filter assembly; and performing a cleaning step including cleaning, by the filter self-cleaning device, the filter.

In some embodiments, the filter self-cleaning device cleans the filter by a spraying method, a blowing method, a vibration method, or a scraping method.

It is to be understood that both the foregoing general description and the following detailed description are exemplary and explanatory only and are not restrictive of the invention as claimed. Other features of the present invention will become apparent by a review of the specification, claims, and appended figures.

DETAILED DESCRIPTION

Figure 1:
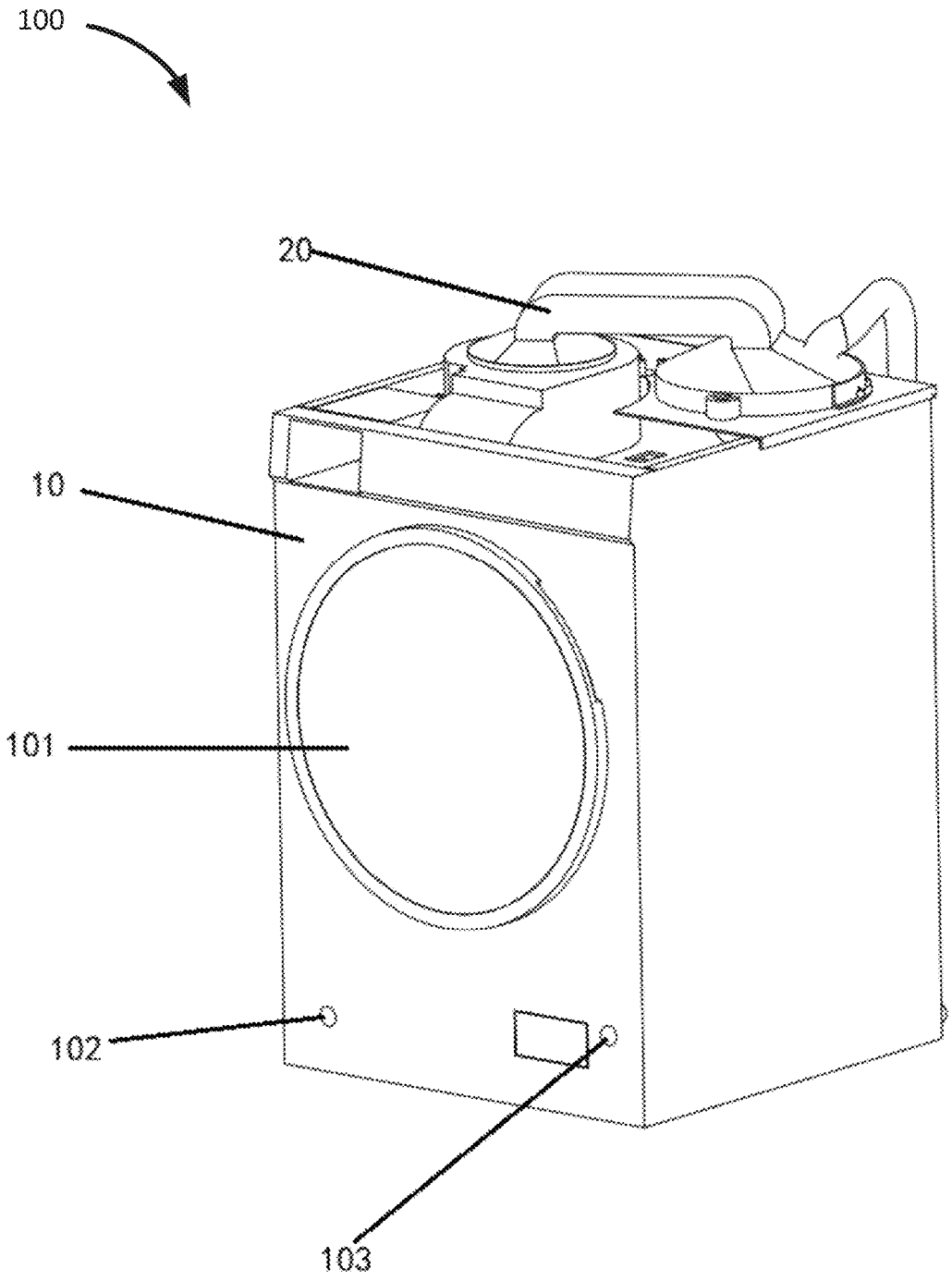
FIG. 1 shows a perspective view of an exemplary integrated washer dryer, in accordance with some embodiments of the present disclosure.

The following detailed description refers to the accompanying drawings. Wherever possible, the same reference numbers refer to the same or similar parts. While several illustrative embodiments are described herein, modifications, adaptations and other implementations are possible. For example, substitutions, additions or modifications may be made to the components illustrated in the drawings. Accordingly, the following detailed description is not limited to the disclosed embodiments and examples. Instead, the proper scope is defined by the appended claims.

In the following description, numerous embodiments are set forth in order to provide a more thorough understanding of the present disclosure. It will be apparent, however, to one skilled in the art, that the present disclosure may be practiced without one or more of these specific embodiments.

It should be noted that the terminology used herein is for the purpose of describing particular embodiments only and is not intended to be limiting of exemplary embodiments according to the present disclosure. As used herein, the singular format may include the plural format unless the context clearly dictates otherwise. It will be further understood that the terms "comprises" and/or "comprising," when used in this disclosure, specify the presence of the stated features, integers, steps, operations, elements, and/or components, but do not preclude the presence or addition of one or more other features, integers, steps, operations, elements, components, and/or groups thereof.

Figure 2:
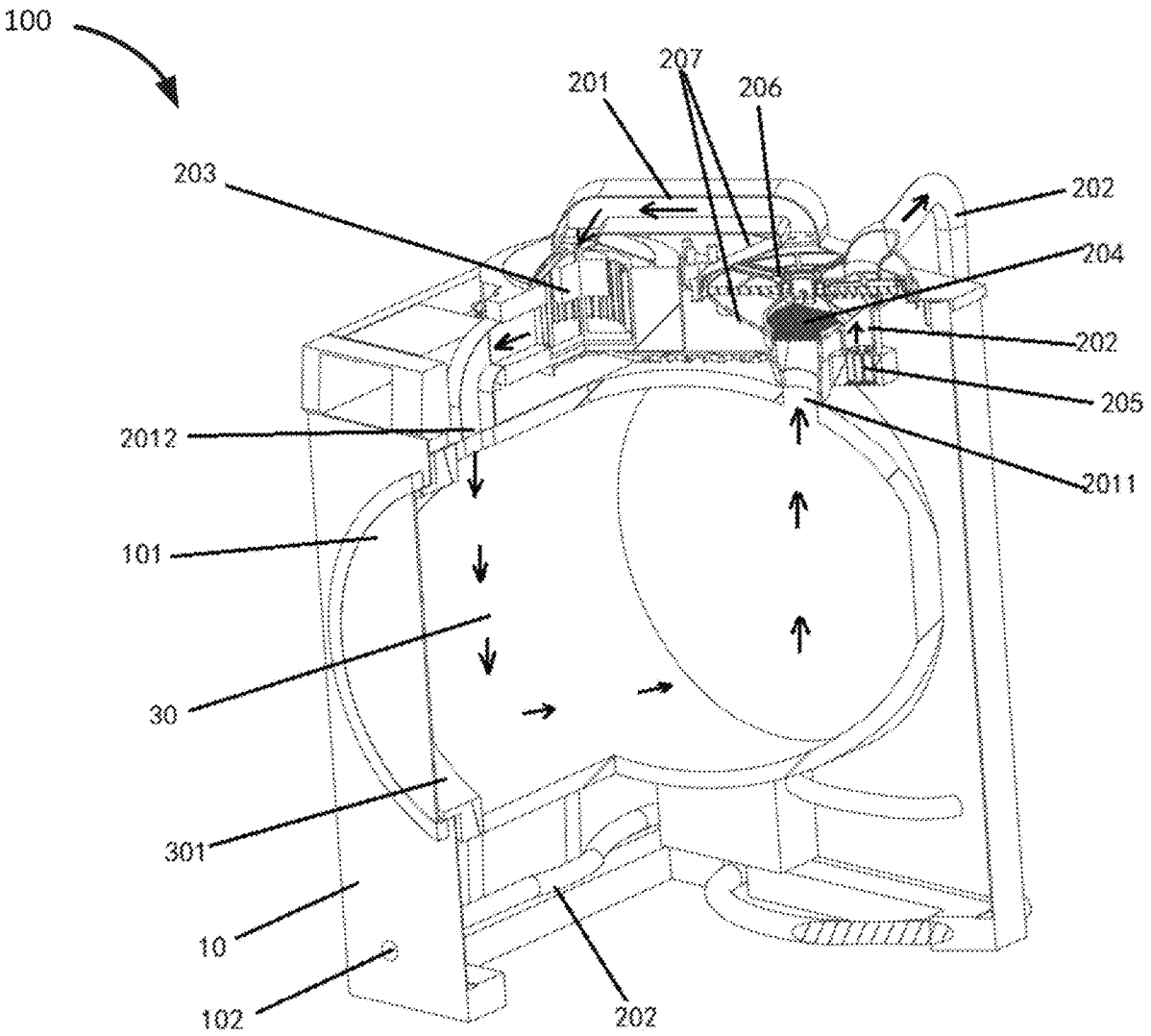
FIG. 2 shows a partial cross-sectional view of the exemplary integrated washer dryer in FIG. 1, in accordance with some embodiments of the present disclosure.

FIG. 1 shows a perspective view of an integrated washer dryer 100 (e.g., a built-in washer dryer, an all-in-one washer dryer), in accordance with certain embodiments of the present disclosure. FIG. 2 shows a partial cross-sectional view of the exemplary integrated washer dryer 100 in FIG. 1, in accordance with some embodiments of the present disclosure. As shown in FIGS. 1-2, in some embodiments, integrated washer dryer 100 in the present disclosure includes a water inlet (not shown), a water outlet (not shown), an inner drum 30, a driving component (not shown), and a drying module 20. In some embodiments, the driving component is coupled with, with inner drum 30 to provide power transmission so as to drive inner drum 30 to rotate. In some embodiments, the water inlet and the water outlet are respectively connected (e.g., directly or indirectly through other part(s)) to inner drum 30. In some embodiments, drying module 20 includes a moisture absorption passage 201, a regeneration passage 202, and a moisture absorption member 206. In some embodiments, moisture absorption passage 201 includes a first air inlet 2011 and a first air outlet 2012. In some embodiments, first air inlet 2011 and first air outlet 2012 are respectively connected (e.g., directly or indirectly through other part(s)) to inner drum 30. In some embodiments, a circulation fan 203 is arranged on moisture absorption passage 201 so as to form circulating airflow in inner drum 30 and moisture absorption passage 201. In some embodiments, a regeneration fan 205 is arranged on regeneration passage 202 so as to form moisture exhaust airflow in regeneration passage 202. In some embodiments, moisture absorption member 206 is disposed on moisture absorption passage 201, so that the circulating airflow passes through moisture absorption member 206. In some embodiments, moisture absorption member 206 is configured to absorb moisture from the circulating airflow in the moisture absorption passage 201 during rotation, and discharge the absorbed moisture through the moisture exhaust airflow through regeneration passage 202.

In some embodiments, integrated washer dryer 100 may further include, but is not limited to, a housing 10, a controller (not shown), and the like. Inner drum 30 and the driving component are located in housing 10. In some embodiments, inner drum 30 has a receiving space for receiving laundry such as clothes, and an opening 301 (e.g., pick-and-place opening) is formed in a side surface of housing 10 for placing and picking the laundry into and from inner drum 30. A door 101 is opened in housing 10 at a position corresponding to opening 301, and door 101 is pivotably connected to housing 10. The opening and closing of door 101 may be manually operated by a user or electronically controlled.

In some embodiments, the side or upper part of housing 10 is provided with a display device (not shown) for displaying information related to the working state of integrated washer dryer 100. The display device may include, but is not limited to, a liquid crystal display, a light emitting diode, and the like. In some embodiments, housing 10 is further provided with one or more buttons, such as mechanical buttons operated by pressing, or touch buttons operated by touching. In some embodiments, the one or more buttons are used for inputting a control instruction to operate integrated washer dryer 100 to the controller, so that the controller controls the corresponding component to execute the control instruction accordingly. The controller may be implemented using, among other things, various Application Specific Integrated Circuits (ASICs), Digital Signal Processors (DSPs), Digital Signal Processing Devices (DSPDs), Programmable Logic Devices (PLDs), Field Programmable Gate Arrays (FPGAs), micro-controllers, microprocessors, or other electronic components.

When washing the laundry, a user first puts the laundry into integrated washer dryer 100 through opening 301, adds cleaning solution from a cleaning solution adding opening, and closes door 101. Water is flown into inner drum 30 via a water inlet through a water inlet pipe connected to a water source and under the control of the controller according to the user's instruction. The user inputs instructions for washing and spin-drying via one or more buttons. The controller controls the driving component to drive inner drum 30 to rotate according to the washing instruction so as to wash the laundry. During the washing process, drain water can flow to a drain outlet through the drain hose to finish washing. Then the controller can control the driving component to continuously drive the inner drum 30 to spin according to the spin-drying instruction, so that the excess water remained on the washed laundry is removed by centrifugal force and is discharged through the water outlet, so as to accelerate the drying process of the washed laundry.

After the laundry is dried, according to a drying command input by the user, the controller activates circulation fan 203 and regeneration fan 205, and controls moisture absorption member 206 to rotate. As shown by arrows in FIG. 2, a circulating airflow is formed by circulation fan 203 to be circulated between inner drum 30 and moisture absorption passage 201. In some embodiments, when circulation fan 203 rotates, an air pressure difference is formed between two sides of circulation fan 203, so as to form an airflow that takes the humid air from inner drum 30 to enter moisture absorption passage 201 via first air inlet 2011 of moisture absorption passage 201. Then the air after moisture absorption is discharged into inner drum 30 through first air outlet 2012 of moisture absorption passage 201, so as to circulate the air between inner drum 30 and moisture absorption passage 201 to form the circulating airflow. Through the circulating airflow, the humid air in inner drum 30 continuously enters moisture absorption passage 201 through first air inlet 2011, and is subjected to moisture absorption treatment by moisture absorption member 206. The dried air after moisture absorption is continuously discharged into inner drum 30 through first air outlet 2012 of moisture absorption passage 201. As such, residual moisture in the laundry in inner drum 30 can be removed by the above process between the humid air and dried air by the circulating airflow, thereby drying the laundry.

Meanwhile, regeneration fan 205 is used to form a moisture exhaust airflow in regeneration passage 202. An air inlet end 2022, and an air outlet end 2021 (e.g., see FIG. 5) of regeneration passage 202 are located outside inner drum 30, so that when regeneration fan 205 rotates, an air pressure difference is formed on two sides of regeneration fan 205 to form a flowing airflow, so that air outside inner drum 30 can enter regeneration passage 202 through air inlet end 2022, then flow through moisture absorption member 206, to remove moisture on moisture absorption member 206, and discharge the moisture to the environment outside inner drum 30 through air outlet end 2021. As such, moisture of moisture absorption member 206 can be removed, to maintain higher water absorption capacity and improved water absorption effect of moisture absorption member 206.

During the drying process, moisture absorption member 206 continuously rotates, so that when a part of moisture absorption member 206 in moisture absorption passage 201 that absorbs moisture from the humid air rotates to regeneration passage 202, the moisture on this part of moisture absorption member 206 is carried away by the regeneration airflow. After the moisture content of this part of moisture absorption member 206 is reduced, this part of moisture absorption member 206 can absorb more moisture when rotating moisture absorption passage 201. As such, the reduction of the absorption effect due to the saturation of moisture absorption member 206 is avoided.

Integrated washer dryer 100 in the present disclosure can remove the moisture of the humid air entering moisture absorption passage 201 from inner drum 30 by moisture absorption member 206, and then discharge the dried air after moisture absorption to inner drum 30, so as to reduce the moisture in inner drum 30 by continuous circulation, and achieve the purpose of drying. As disclosed herein, integrated washer dryer 100 provided in the present disclosure does not need an evaporator to heat and dehumidify the humid air in inner drum 30. The moisture absorption performance of moisture absorption member 206 is also not very sensitive to the temperature change. Moisture absorption member 206 is heated to discharge the moisture in the moisture desorption process. Accordingly, the defect of having poor dehumidification in a low-temperature environment effect in the conventional condensing or dehumidification system using a heat pump can be avoided, to provide a wider application environment.

Figure 3:
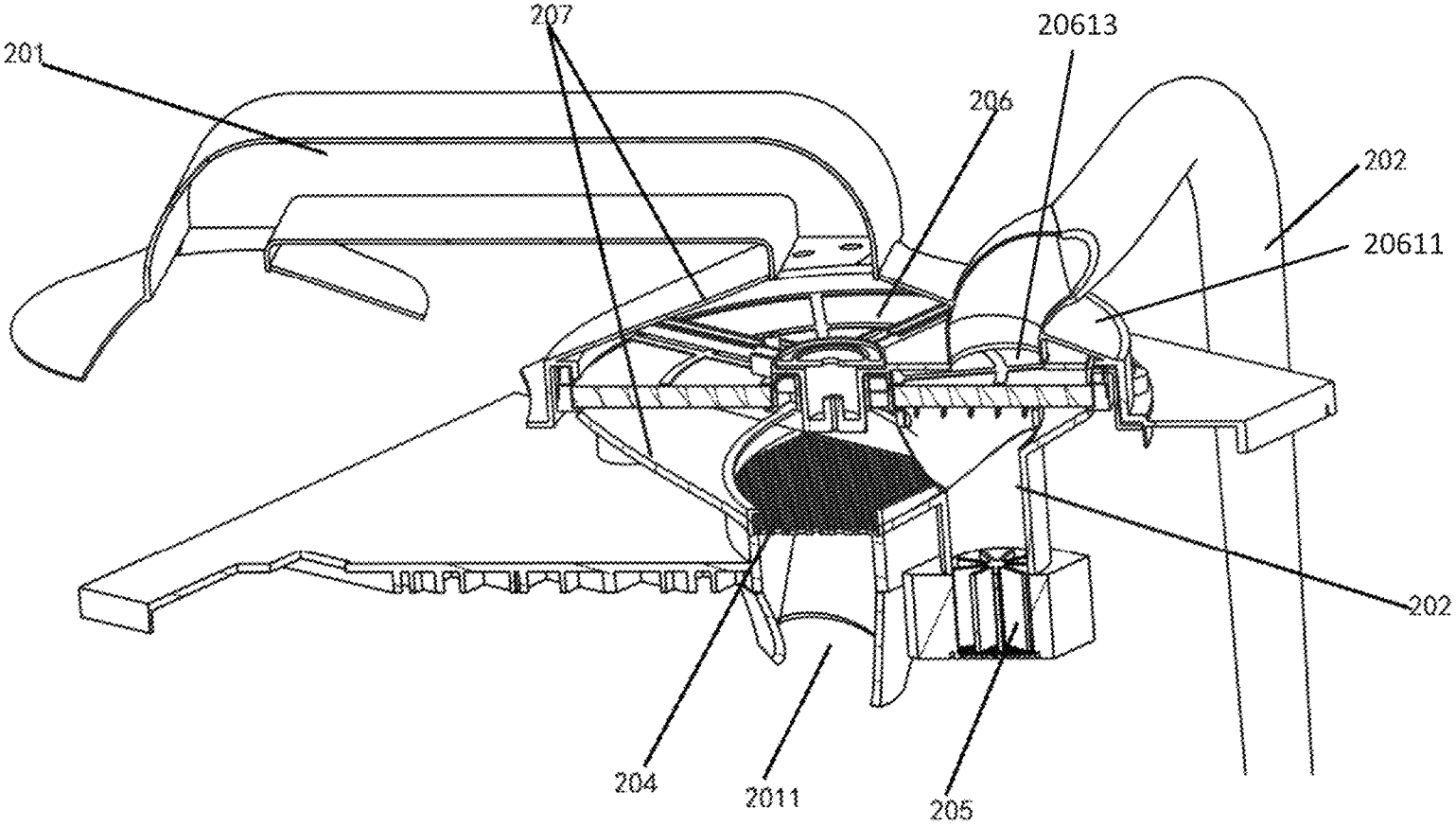
FIG. 3 shows an enlarged view of a portion of the exemplary integrated washer dryer in FIG. 2, in accordance with some embodiments of the present disclosure.
Figure 4:
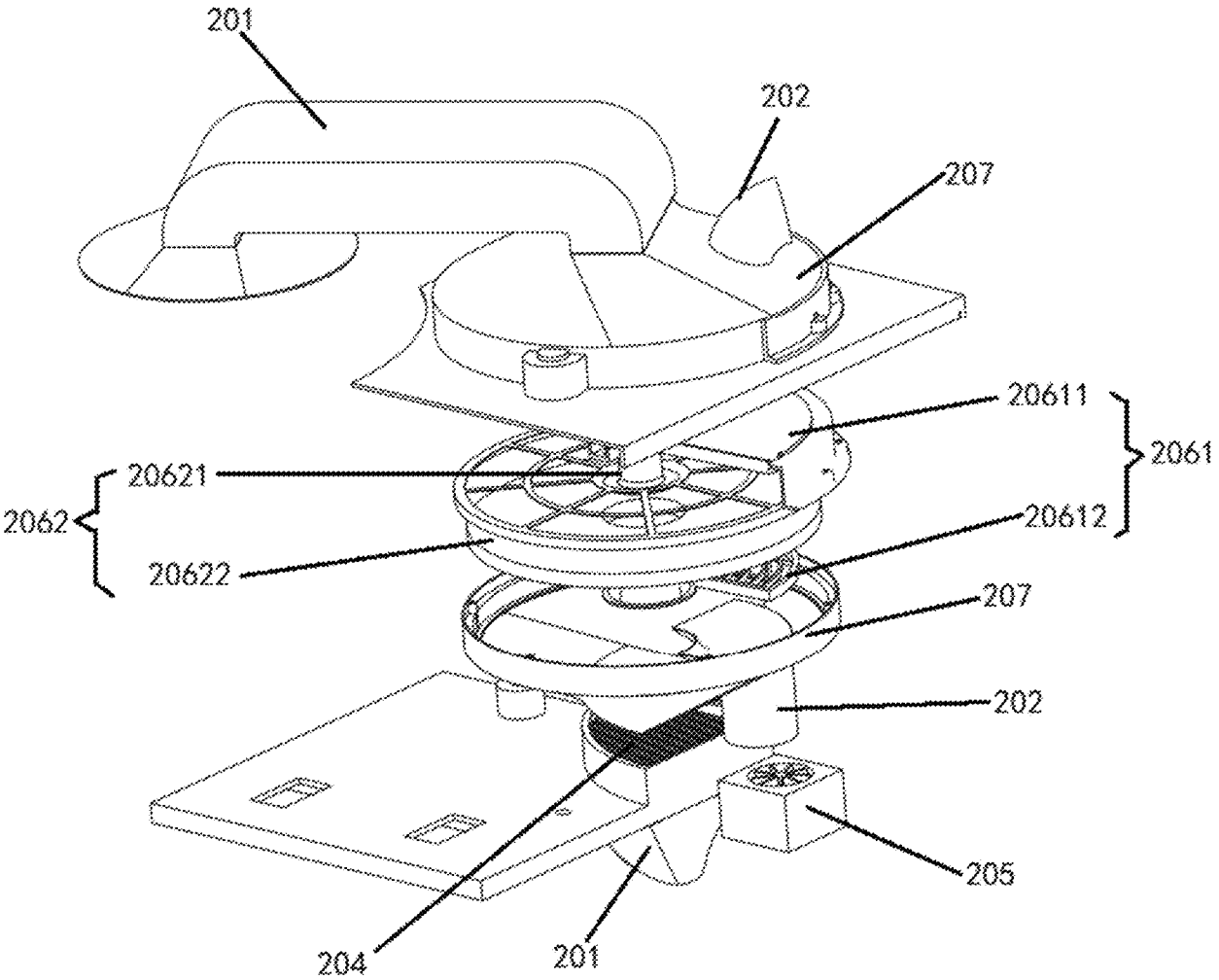
FIG. 4 shows an exploded view of the portion of the exemplary integrated washer dryer in FIG. 3, in accordance with some embodiments of the present disclosure.

In some embodiments, as shown in FIGS. 2, 3 and 4, moisture absorption passage 201 is further provided with a filter member 204, and filter member 204 is located on a side of moisture absorption member 206 near first air inlet 2011, e.g., located upstream of moisture absorption member 206, so as to filter the airflow before entering moisture absorption member 206. In some embodiments, regeneration passage 202 is provided with a filter member.

In some embodiments, filter member 204 may have a mesh structure, or any other structures capable of blocking debris, which is not limited in this embodiment.

In some embodiments, filter member 204 is disposed on the side of moisture absorption member 206 close to first air inlet 2011, so as to filter the moist air entering moisture absorption passage 201, and prevent the debris in the moist air from contacting moisture absorption member 206 to affect the working performance of moisture absorption member 206. At the same time, the lint in the laundry is prevented from adhering to moisture absorption member 206, to avoid damage to moisture absorption member 206 by possibly igniting the lint when moisture absorption member 206 is heated and desorbed.

In some embodiments, a filter member for filtering debris, such as a screen, may be disposed upstream of regeneration fan 205 to prevent external contaminants from damaging regeneration fan 205 and to prevent the air pollution by the airflow discharged to the outside.

In some embodiments, a heating member is provided on moisture absorption passage 201.

In some embodiments, in the heat exchange process in inner drum 30, the temperature of the entering drying air is higher, which can accelerate the moisture to be exchanged out from the laundry, thereby shortening the drying time. In some embodiments, a heating member can be added to moisture absorption passage 201, and the heating member can be disposed at the upstream or downstream of moisture absorption member 206, so that the moisture from the heated moist air can be absorbed, or the dried air after moisture absorption can be heated, and the dried heated air can enter inner drum 30 from first air outlet 2012. As the air heated by the heating member has a higher temperature, it can increase the temperature in inner drum 30, thereby accelerating the evaporation of the moisture from the laundry, making the drying efficiency higher and the drying effect better.

In some embodiments, the heating member and moisture absorption member 206 perform the drying process on the humid air together, so that the temperature of the heating member is not too high, thereby reducing the power consumption of the heating member and saving resources. In some embodiments, the heating member may be an electric heating wire, a positive temperature coefficient (PTC) heater, or the like having a heating function. In some embodiments, the PTC heater is composed of a ceramic heating element and an aluminum tube. In some embodiments, the PTC heater has the advantages of having a small thermal resistance and high heat exchange efficiency, and is an automatic, constant-temperature, and electricity-saving electric heater.

In some embodiments, as shown in FIG. 4, moisture absorption member 206 includes a moisture absorption roller assembly 2062 and a heating assembly 2061. In some embodiments, heating assembly 2061 covers the regeneration region of moisture absorption roller assembly 2062. In some embodiments, the moisture absorption region of moisture absorption roller assembly 2062 is located in moisture absorption passage 201. In some embodiments, the regeneration region is a region of moisture absorption roller assembly 2062 through which a moisture removing airflow passes, and the moisture absorption region is a region of moisture absorption roller assembly 2062 through which a circulating airflow passes.

In some embodiments, the area of the regeneration region and the area of the moisture absorption region can be determined according to the radial cross-sectional areas of the moisture absorption pipeline and the regeneration pipeline. In some embodiments, the radial cross-sectional area of the moisture absorption pipeline is larger than the radial cross-sectional area of the regeneration pipeline, and the area of the regeneration region is smaller than the area of the moisture absorption region, so that the air flow rate of the moisture absorption pipeline can be increased, and most of moisture absorption roller assembly 2062 can be in the moisture absorption region, to further increase the moisture absorption efficiency and improve the moisture absorption effect.

During the rotation of moisture absorption roller assembly 2062, each part of moisture absorption roller assembly 2062 rotates from moisture absorption passage 201 to regeneration passage 202, then rotates from regeneration passage 202 to moisture absorption passage 201. In some embodiments, each part of moisture absorption roller assembly 2062 rotates from the moisture absorption region to the regeneration region, and then rotates from the regeneration region to the moisture absorption region, so that the part of moisture absorption roller assembly 2062 located in the moisture absorption region absorbs the moisture in the humid air in moisture absorption passage 201, then rotates to the regeneration region, and is heated by heating assembly 2061 to rapidly desorb the moisture in the part. The moisture is then carried by the moisture exhaust airflow to air outlet end 2021 of regeneration passage 202 to be exhausted to the outside. As such, during the rotation of moisture absorption roller assembly 2062, the moisture in the humid air in moisture absorption passage 201 can be continuously absorbed by moisture absorption roller assembly 2062, and the moisture absorbed by moisture absorption roller assembly 2062 can be continuously exhausted, so that moisture absorption roller assembly 2062 has good water absorbing capacity all the time, thereby improving the moisture absorbing efficiency and effect.

In some embodiments, as shown in FIG. 4, heating assembly 2061 includes a cover 20611. In some embodiments, cover 20611 is disposed over (e.g., covers or partially covers) the regeneration region of the moisture absorption roller assembly 2062. In some embodiments, the part of cover 20611 corresponding to the regeneration region (e.g., the part disposed over the regeneration region, or in connection with, communication with, or other interactive relationship with the regeneration region) includes an opening (e.g., an opening 20613 in FIG. 3) in connection with regeneration passage 202. In some embodiments, cover 20611 includes a regeneration heating portion 20612.

In some embodiments, cover 20611 covers the regeneration area of moisture absorption roller assembly 2062, and is located on the side of moisture absorption roller assembly 2062 that is away from first air inlet 2011, so that the contact between the moisture exhaust airflow and the part of moisture absorption roller assembly 2062 in the regeneration area is not blocked. In some embodiments, the contact area between the moisture exhaust airflow in regeneration passage 202 and moisture absorption roller assembly 2062 is maximized, so that more moisture can be carried away and removed. In some embodiments, cover 20611 is used to partition the moisture absorption region and the regeneration region of moisture absorption roller assembly 2062, and fix regeneration heating portion 20612. In some embodiments, cover 20611 and heating assembly 2061 do not rotate during the rotation of moisture absorption roller assembly 2062. In some embodiments, moisture absorption roller assembly 2062 rotates relative to cover 20611 and heating assembly 2061, so that regeneration heating portion 20612 can heat the region of moisture absorption roller assembly 2062 that rotates to the vicinity of regeneration heating portion 20612. In some embodiments, regeneration heating portion 20612 is located as close to moisture absorption roller assembly 2062 as possible for the purpose of better heating and desorbing moisture in the regeneration region of moisture absorption roller assembly 2062.

In some embodiments, under effect of regeneration fan 205, the airflow enters regeneration passage 202 from the outside, passes through regeneration heating portion 20612 and the regeneration area of moisture absorption roller assembly 2062 in sequence, and then is discharged to the outside from the outlet of regeneration passage 202. In some embodiments, regeneration heating portion 20612 is located upstream of the regeneration region, and the heated airflow exchanges heat with the regeneration region to desorb moisture therein. In some embodiments, regeneration heating portion 20612 may be located downstream of the regeneration region. In some embodiments, regeneration heating portion 20612 may be provided both upstream and downstream of the regeneration region.

In some embodiments, in order to prevent regeneration fan 205 from being damaged by external contaminants and prevent air from being polluted by the airflow discharged to the outside, a filtering member, such as a filter screen, may be provided upstream of regeneration fan 205. In some embodiments, an air filter member, such as a hepa filter screen, is provided in regeneration passage 202 downstream of moisture absorption roller 20622.

In some embodiments, regeneration heating portion 20612 may use a heating element such as a heating wire or a PTC heater.

In some embodiments, as shown in FIG. 4, moisture absorption roller assembly 2062 includes a moisture absorption roller 20622 and a rotating portion coupled to drive moisture absorption roller 20622 to rotate. In some embodiments, a shell 207 covers outside moisture absorption roller 20622, and moisture absorption roller 20622 can rotate relative to shell 207 under the drive of the rotating portion. In some embodiments, shell 207 is respectively coupled to the moisture absorption pipeline and the regeneration pipeline. In some embodiments, shell 207 includes a connection port configured to connect to the moisture absorption pipeline and a connection port configured to connect to the regeneration pipeline, respectively. In some embodiments, the internal space of shell 207 is divided into a part connected to moisture absorption passage 201 via the connection port connected to the moisture absorption pipeline and a part connected to regeneration passage 202 via the connection port connected to the regeneration pipeline.

In some embodiments, moisture absorption roller 20622 has a disk-like structure with a certain thickness, so that the space occupied by moisture absorption roller 20622 can be reduced, thereby reducing the overall volume of moisture absorption roller assembly 2062. In some embodiments, moisture absorption roller 20622 is made of a material having a high absorption capacity, such as cotton cloth or fiber. In some embodiments, the rotating portion includes a rotating shaft 20621 and a motor connected to rotating shaft 20621. Rotating shaft 20621 is provided in the middle of moisture absorption roller 20622, so that rotating shaft 20621 is driven by the motor to rotate rotating moisture absorption roller 20622 connected to rotating shaft 20621. In some embodiments, shell 207 can be used for accommodating moisture absorption roller 20622, rotating shaft 20621, and the motor. The edge of cover 20611 is fixedly connected to shell 207, so that moisture absorption roller 20622 can rotate, while cover 20611 does not rotate. In some embodiments, shell 207 is connected to moisture absorption passage 201 and regeneration passage 202, so as to smoothly circulate the airflow in moisture absorption passage 201 and the airflow in regeneration passage 202.

In some embodiments, integrated washer dryer 100 includes shell 207, and moisture absorption member 206 is located in the shell 207. Moisture absorption member 206 is configured to be fixed and shell 207 is configured to rotate relative to moisture absorption member 206. For example, moisture absorption roller 20622 is configured to be fixed and shell 207 is configured to rotate relative to moisture absorption roller 20622 via rotating shaft 20621. In some embodiments, shell 207 may be provided with inlet and outlet openings at the center positions of both sides to communicate with moisture absorption passage 201 and regeneration passage 202, In some embodiments, regeneration heating portion 20612 may be configured to rotate relative to moisture absorption roller 20622, and whether regeneration heating portion 20612 may rotate synchronously or asynchronously with shell 207, and it is not limited herein, as long as regeneration heating portion 20612 can divide moisture absorption roller 20622 into a moisture absorption region and a regeneration region during the rotation. In some embodiments, it is possible to provide shell 207 with openings communicating with moisture absorption passage 201 and regeneration passage 202, which are offset from the center. This can be achieved by means of the general knowledge in the art, and the embodiments provided in the present disclosure are not intended to be limiting.

Figure 5:
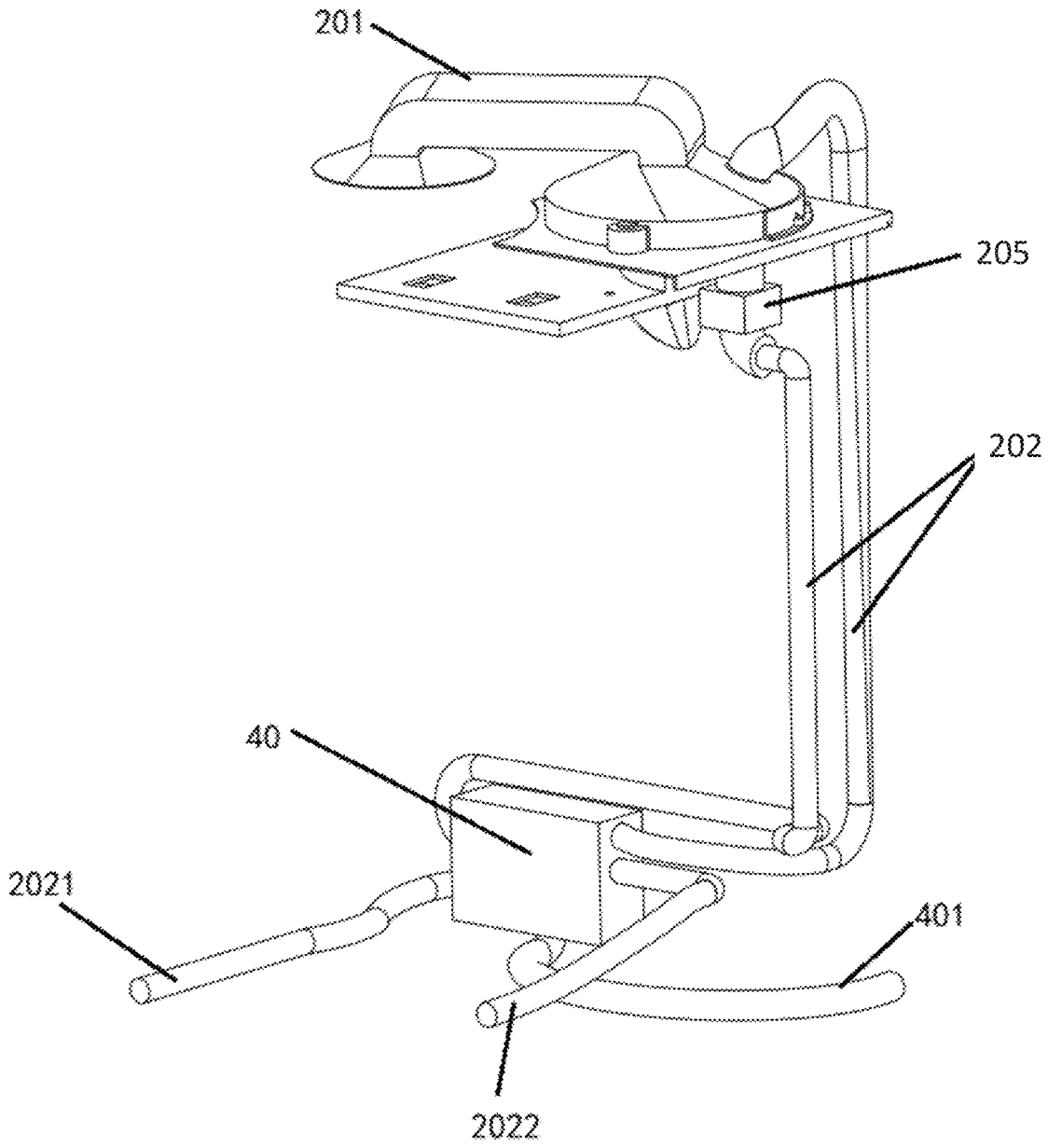
FIG. 5 shows a perspective view of a drying assembly of an exemplary integrated washer dryer, in accordance with some embodiments of the present disclosure.

In other embodiments, as shown in FIG. 5, regeneration passage 202 is provided with a condensation component 40. In some embodiments, condensation component 40 is used for cooling the dehumidification airflow in regeneration passage 202 to dry the dehumidification airflow. In some embodiments, in the structure that does not include the condensation component, the regeneration passage is arranged to exhaust the moist airflow containing moisture form from the regeneration area. To the integrated washer dyer placed in bathroom or laundry room, this can lead to growth of indoor air humidity, bringing negative experience to hot and damp areas. But to dry area, having increased humidity can increase the comfort level in the room. As such, condensation component 40 can be an option for user selection as suitable for different areas.

In some embodiments, condensation component 40 may be an existing condensation device. In some embodiments, air inlet 2022 and air outlet 2021 of regeneration passage 202 both pass through the condensation device, so that the air entering regeneration passage 202 from air inlet 2022 is cooled by condensation component 40, and part of moisture in the air is condensed into liquid, so as to dry the air. The dried air then passes through the regeneration region of moisture absorption roller assembly 2062 to remove the moisture on moisture absorption roller assembly 2062. The air carrying the moisture from moisture absorption roller assembly 2062 then passes through condensation component 40 to condense the absorbed moisture into liquid, so as to reduce the moisture discharged to the outside air, thereby preventing a large amount of moisture from being discharged to the outside air, to affect the outside humidity and environment. In some embodiments, the condensed moisture can be discharged through a drain pipe 401 of condensation component 40. In some embodiments, drain pipe 401 and the drain pipe for discharging the drain water from inner drum 30 can share the same pipe in order to make the structure more compact and facilitate the user operation.

Figure 6:
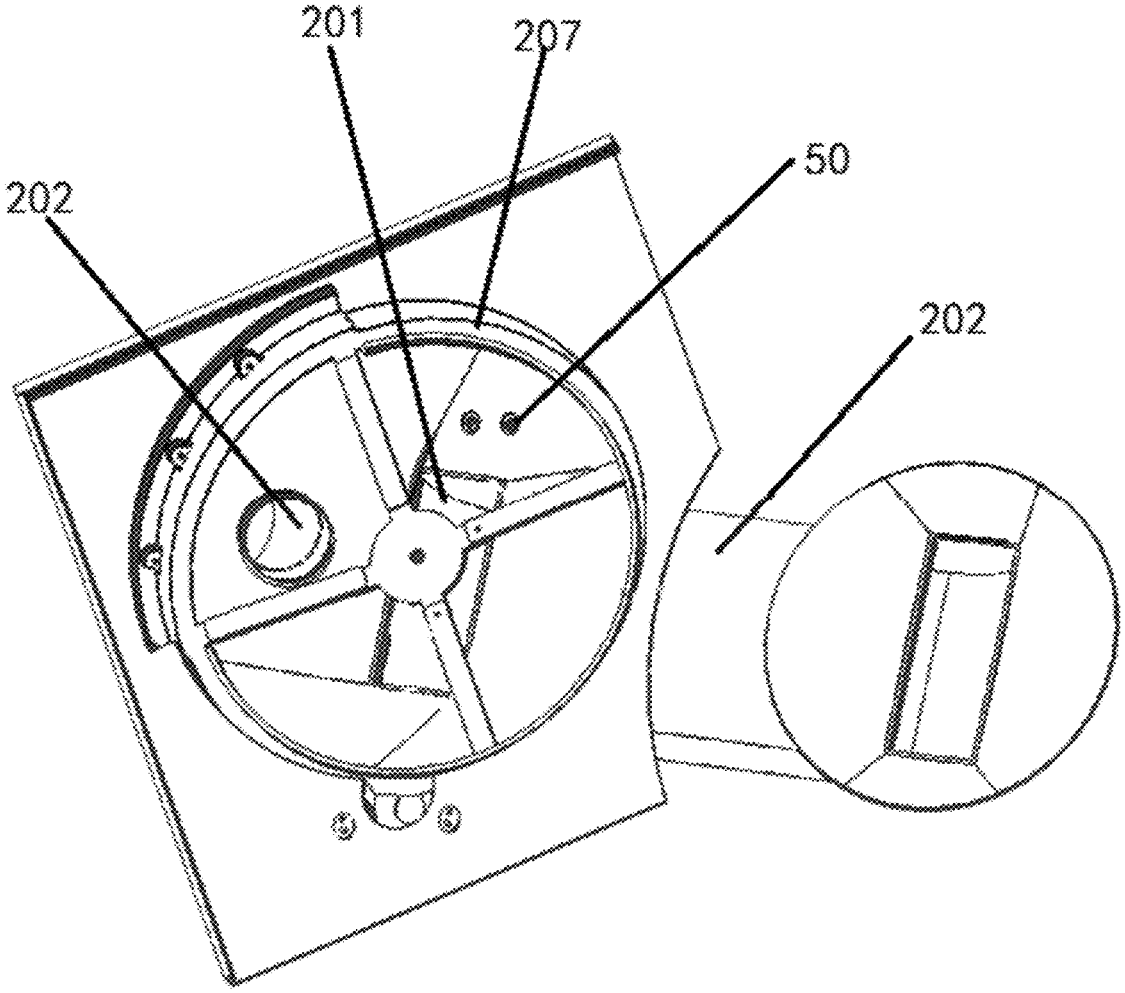
FIG. 6 shows a perspective view of a temperature sensor, a moisture absorption path, and a regeneration path, in accordance with some embodiments of the present disclosure.

In some embodiments, as shown in FIG. 6, integrated washer dryer 100 can further include a controller, and a humidity sensor 50 disposed in moisture absorption passage 201. In some embodiments, the controller is electrically connected to humidity sensor 50 and the heating member respectively. The controller may be used for controlling the heating member to be turned on or off according to the humidity detected by humidity sensor 50. The controller may also control and adjust other parts of the dehumidifier, such as circulation fan 203, regeneration fan 205, roller assembly 2062 to adjust the humidity.

In some embodiments, humidity sensor 50 is used to detect the humidity of the air in moisture absorption passage 201. The controller may compare the humidity detected by humidity sensor 50 and a preset humidity threshold, and further controls and adjusts one or more parts of the dehumidifier to keep the humidity in control. In some embodiments, the temperature sensor is used to detect the temperature of the air in moisture absorption passage 201. Then the controller compares the temperature detected by the temperature sensor and a preset temperature. If the detected temperature is higher than or equal to the preset temperature, then the controller turns off the heating member. If the detected temperature is lower than the preset temperature, then the controller turns on the heating member. As such, it can be guaranteed that the circulating airflow has relatively stable temperature, and damages to the laundry in inner drum 30 caused by high-temperature circulating airflow can be possibly avoided.

In some embodiments, a humidity sensor for detecting humidity of inner drum 30 is further disposed in inner drum 30.

In some embodiments, the humidity sensor may detect humidity in inner drum 30 and display the detected humidity value on the display device of housing 10, so that a user can know the drying condition in the inner drum 30. The user can also control the drying time according to the humidity value.

In some embodiments, the integrated washer dryer can include two or more humidity sensors 50, and one or more temperature sensors is located at different positions of the inner drum 30.

In some embodiments, the number of humidity sensors is increased to detect the humidity at different locations in the inner drum 30, so that the humidity condition of the inner drum 30 can be comprehensively known, and inaccurate detection caused by detecting one location using a single humidity sensor can be avoided. The number of humidity sensors can be designed according to the size of inner drum 30, and the embodiment is not limited strictly.

In some embodiments, as shown in FIG. 1, integrated washer dryer 100 comprises a housing 10, and inner drum 30 and the driving part are disposed in housing 10. In some embodiments, regeneration passage 202 is at least partially positioned between inner drum 30 and housing 10. The side of housing 10 is provided with a second air outlet 102 and a second air inlet 103, where second air outlet 102 is connected to an air outlet end 2021 of regeneration passage 202, and second air inlet 103 is connected to an air inlet end 2022 of regeneration passage 202 (e.g., see FIGS. 1 and 5). In some embodiments, the side of housing 10 with second air outlet 102 and second air inlet 103 is facing a user when integrated washer dryer 100 works, so that second air outlet 102 and second air inlet 103 are respectively arranged on this side, to facilitate the user placing the integrated washer dryer.

In some embodiments, the side of housing 10 with second air outlet 102 and second air inlet 103 is the side with door 101. As such, in the process of drying the laundry in the integrated washer dryer, second air outlet 102 and second air inlet 103 will not be blocked by external objects (such as a wall), so that sufficient air can be ensured to enter regeneration passage 202, and the air can also be discharged from regeneration passage 202.

In some embodiments, regeneration passage 202 is arranged between inner drum 30 and housing 10, and the space between inner drum 30 and housing 10 can be fully utilized, so that the structure of the integrated washer dryer is more compact.

Figure 7:
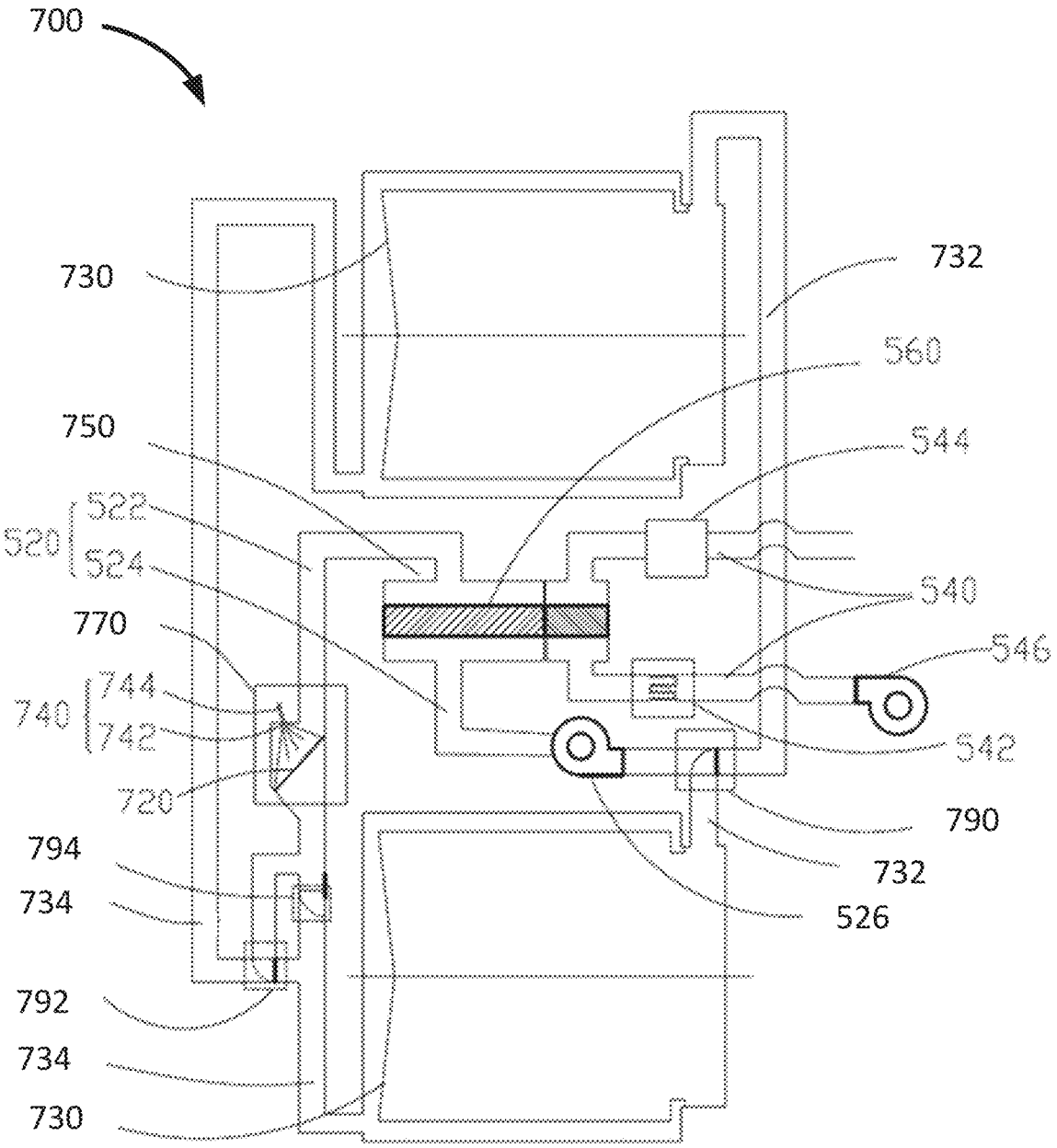
FIG. 7 shows a schematic structural diagram of a laundry machine, in accordance with some embodiments of the present disclosure.

FIG. 7 shows a schematic structural diagram of a laundry machine 700, in accordance with some embodiments of the present disclosure. In some embodiments, laundry machine includes washing and/or drying laundry. In some embodiments, laundry machine 700 includes at least two containers 730 (e.g., the container may also be referred to as a tub, an inner tub, an inner drum, a rotary drum) for containing laundries during washing and/or drying, a dehumidification device 750, and a filter assembly 770. In some embodiments, one container 730 can perform washing and drying, or can perform drying only. In some embodiments, laundry machine 700 is an integrated washer dryer that performs washing and drying functions. In some embodiments, laundry machine 700 is a dryer that only performs the drying function. In some embodiments, dehumidification device 750 with a plurality of containers 730 dehumidifies the laundries in respective containers 730 selectively. In some embodiments, filter assembly 770 is used for filtering the airflow flowing out of one or more containers 730 to enter dehumidification device 750. In some embodiments, a plurality of containers 730 share the same dehumidification device 750, thereby simplifying the structure and reducing the overall height or width of laundry machine 700, with reduced volume and cost of laundry machine 700. In some embodiments, the use of filter assembly 770 can prevent flying fluff, lint, dust, or other debris, from entering the interior of dehumidification device 750, or covering the surface of the dehumidification device 750, to affect the dehumidification effect.

In some embodiments, each container includes an air inlet passage 732 and an air outlet passage 734.

In some embodiments, dehumidification device 750 selects to dehumidify the laundry in one container 730 at a time. In some embodiments, dehumidification device 750 includes an air inlet section 522 for connecting with air outlet passage 734 of container 730, and an air outlet section 524 for connecting with air inlet passage 732 of container 730.

In some embodiments, dehumidification device 750 includes a moisture absorption passage 520, a moisture exhaust passage 540, and a moisture absorption and moisture exhaust member 560.

In some embodiments, moisture absorption and moisture exhaust member 560 is rotatably disposed on moisture absorption passage 520 and moisture exhaust passage 540. During rotation, moisture absorption and moisture exhaust member 560 is configured to absorb the moisture from the circulating airflow discharged from container 730 into moisture absorption passage 520, and exhaust the moisture via the moisture exhaust airflow through moisture exhaust passage 540. In some embodiments, moisture absorption and moisture exhaust member 560 includes a moisture absorption area connected to moisture absorption passage 520, and a moisture exhaust area (or moisture removal area) connected to moisture exhaust passage 540. In some embodiments, moisture absorption and moisture exhaust member 560 includes a disc-shaped structure with a certain thickness. In some embodiments, moisture absorption and moisture exhaust member 560 is made of materials with strong absorption capacity, such as cotton cloth and/or fibers, etc. In some embodiments, moisture absorption and moisture exhaust member 560 is driven by a driving mechanism (not shown) such as a driving motor to rotate relative to moisture absorption passage 520 the moisture removal passage 540.

In some embodiments, moisture absorption passage 520 includes an air inlet section 522 located on the air incoming side of moisture absorption and moisture exhaust member 560 (e.g., the moisture absorption area of the moisture absorption and moisture exhaust member 560), and an air outlet section 524 located on the air outgoing side of moisture absorption and moisture exhaust member 560 (e.g., the moisture exhaust area of the moisture absorption and moisture exhaust member 560). In some embodiments, air inlet section 522 of moisture absorption passage 520 forms air inlet section 522 of the dehumidification device 750, and air outlet section 524 of moisture absorption passage 520 forms air outlet section 524 of the dehumidification device 750. In some embodiments, air inlet section 522 and air outlet section 524 are in fluid communication with air outlet passage 734 and air inlet passage 732 of container 730, respectively. In some embodiments, when the laundries in one of containers 730 are to be dried, air inlet section 522 and air outlet section 524 of moisture absorption passage 520 are in fluid communication with air outlet passage 734 and air inlet passage 732 of the corresponding container 730, respectively. In some embodiments, the communication with air outlet passages 734 and air inlet passages 732 of one or more other containers 730 that are not in drying process is cut off. In some embodiments, a fan 526 is disposed in moisture absorption passage 520 to form the circulating airflow in container 730 and moisture absorption passage 520. In some embodiments, a heater is provided in air outlet section 524 of moisture absorption passage 520 to increase the temperature of the drying airflow entering container 730 to be dried laundries and speed up the drying process of the laundries in this container 730. In some embodiments, a condenser is provided in air inlet section 522 of moisture absorption passage 520 for pre-dehumidifying the airflow discharged from this container 730 to be dried. In some embodiments, the condenser is disposed upstream of the airflow direction of filter assembly 770. Accordingly, the humidity of the airflow entering moisture absorption and moisture exhaust member 560 can be reduced, and further, part of the fluff or lint can be taken away by the condensed water, thereby increasing the single-use duration of a filter 720 of filter assembly 770. For example, the cleaning frequency of filter assembly 770 can be reduced. In some embodiments, a heater 542, a heat exchanger 544, and a fan 546 are provided in moisture exhaust passage 540. In some embodiments, heater 542 is located on the air inlet side of the moisture exhaust area, and heat exchanger 544 is located on the air outlet side of the moisture exhaust area. In some embodiments, fan 546 operates to generate a forced airflow, and the airflow is heated when passing through heater 542. The heated dry airflow flows through the moisture exhaust area, thereby taking away the moisture in the moisture exhaust area. In some embodiments, heater 542 can also be located at the air outlet side of the moisture exhaust area and close to moisture absorption and moisture exhaust member 560, to heat the moisture exhaust area of moisture absorption and moisture exhaust member 560, and to accelerate the dehumidification of the moisture in the moisture exhaust area. In some embodiments, heater 542 may not be provided, and the air exhaust section of heat exchanger 544 may be used to heat the airflow. In some embodiments, a filter device such as a filter screen may be disposed in the air intake section of the moisture removal channel 540. In some embodiments, the filter device is located in the upstream side of the moisture exhaust area, and/or heater 542, and/or fan 546, to protect the moisture exhaust area, and/or heater 542, and/or fan 546. During operation, the airflow (e.g., the moist airflow) discharged from container 730 to be dried passes through filter assembly 770, and then enters the moisture absorption area. The part of moisture absorption and moisture exhaust member 560 located in the moisture absorption area absorbs the moisture in the airflow passing through it, e.g., the water vapor, so that the humidity of the airflow passing through it is reduced to form a dry airflow. The dry airflow flowing out from the moisture absorption area flows back into container 730 through air outlet section 524 of the moisture absorption passage 520 and air inlet passage 732 of container 730, for the next circulation, thereby forming a circulating airflow, until the humidity in container 730 reaches a predetermined value. In some embodiments, as moisture absorption and moisture exhaust member 560 rotates, the part of moisture absorption and moisture exhaust member 560 located in the moisture absorption area that has absorbed moisture rotates to enter the moisture exhaust area. The moisture is then carried away by the heated dry airflow in the moisture exhaust area, so that the dry portion of moisture absorption and moisture exhaust member 560 can absorb moisture again when it rotates to the moisture absorption area next time.

Figure 8:
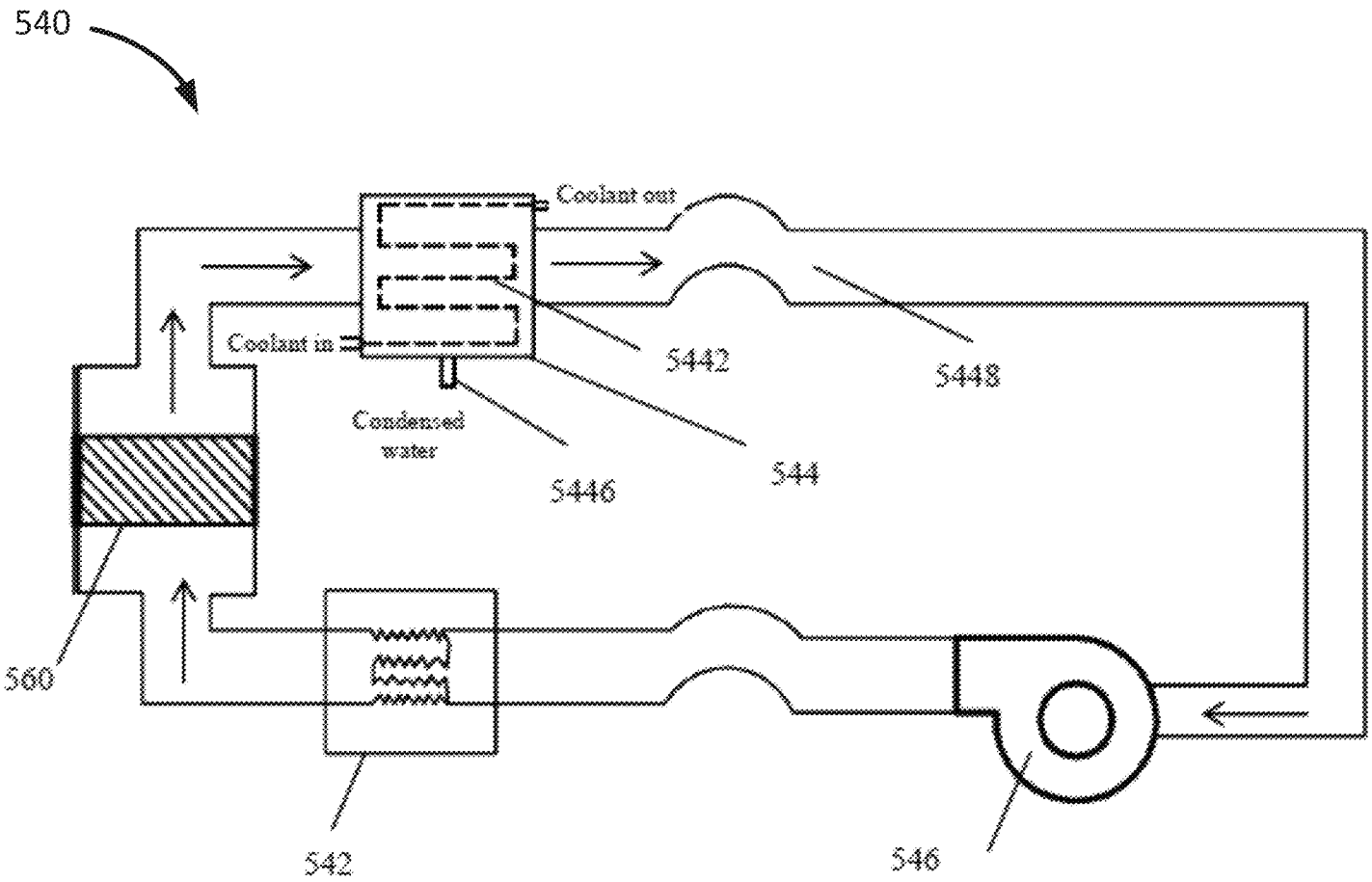
FIG. 8 shows a schematic diagram of a structure of a moisture exhaust passage of the laundry machine, in accordance with some embodiments of the present disclosure.

FIG. 8 shows a schematic diagram of some embodiments of a moisture exhaust passage 540 of laundry machine 100 of FIG. 7, in accordance with some embodiments of the present disclosure. As shown in FIG. 8, in some embodiments, heat exchanger 544 includes a cooling passage 5442 for passing a cooling medium such as condensed water, a ventilation passage for passing airflow, and a condensed water discharge port 5446. In some embodiments, when the hot and humid airflow flowing out of the moisture exhaust area of dehumidification device 750 passes through heat exchanger 544, the heat exchange occurs with cooling passage 5442, and most of the moisture condenses into condensed water, which is discharged from condensed water discharge port 5446. In some embodiments, the ventilation passage is in communication with the moisture exhaust area (or moisture removal area) and a water outlet for draining condensed water. the cooled dry airflow is discharged from an exhaust port 5448 of the ventilation passage of heat exchanger 544. In some embodiments, exhaust port 5448 is connected to air inlet of the fan 546, so that a circulation loop is formed in moisture exhaust passage 540, to reduce the impact on the external environment.

Figure 9:
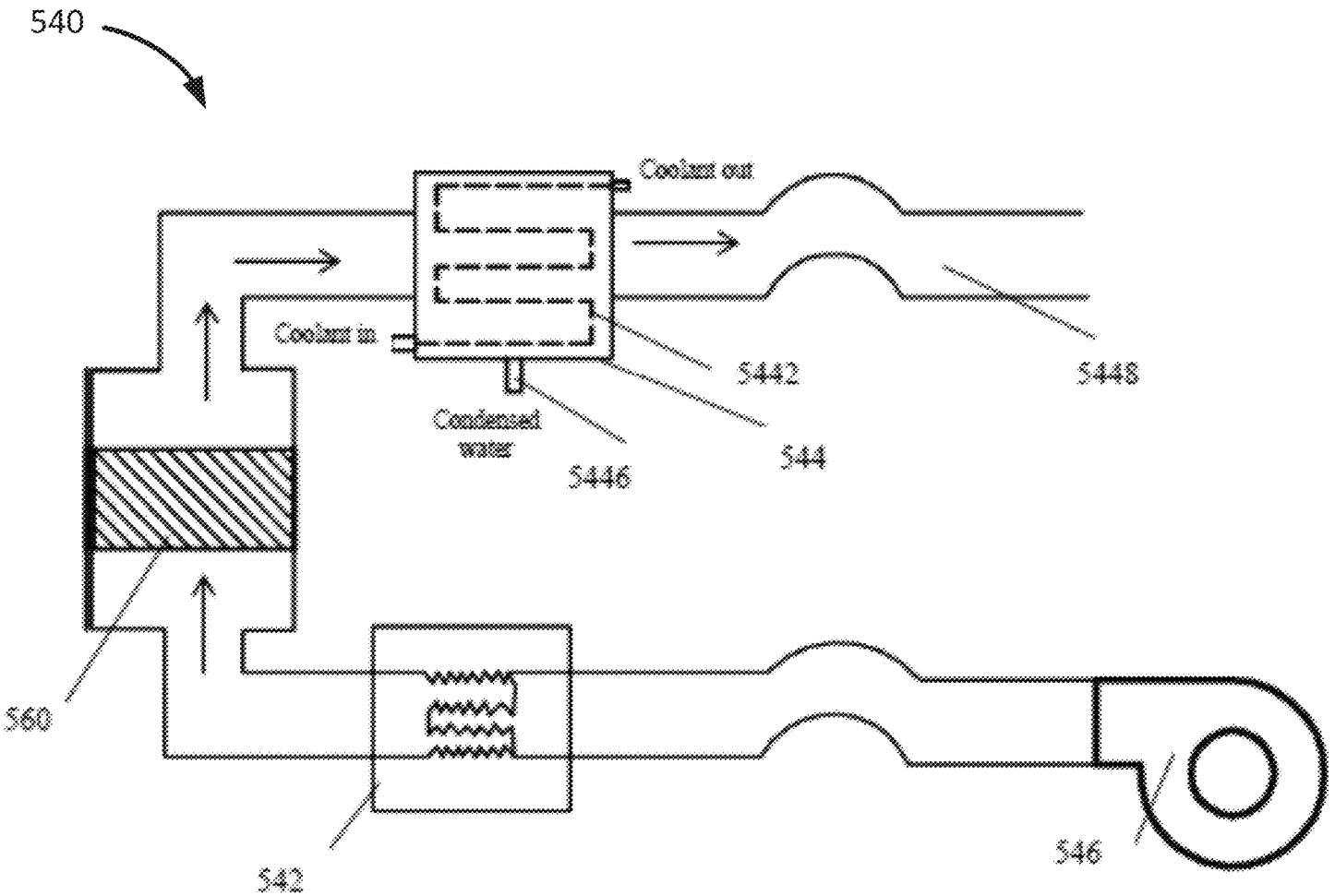
FIG. 9 shows a schematic diagram of a structure of a moisture exhaust passage of the laundry machine, in accordance with some embodiments of the present disclosure.

FIG. 9 shows a schematic diagram of some embodiments of a moisture exhaust passage 540 of laundry machine 100 of FIG. 7, in accordance with some embodiments of the present disclosure. As shown in FIG. 9, in some embodiments, exhaust port 5448 of heat exchanger 544 may be communicated with the outside of laundry machine 100, so that the airflow treated by the heat exchanger 544 can be directly discharged to the outside of laundry machine 100.

Figure 10:
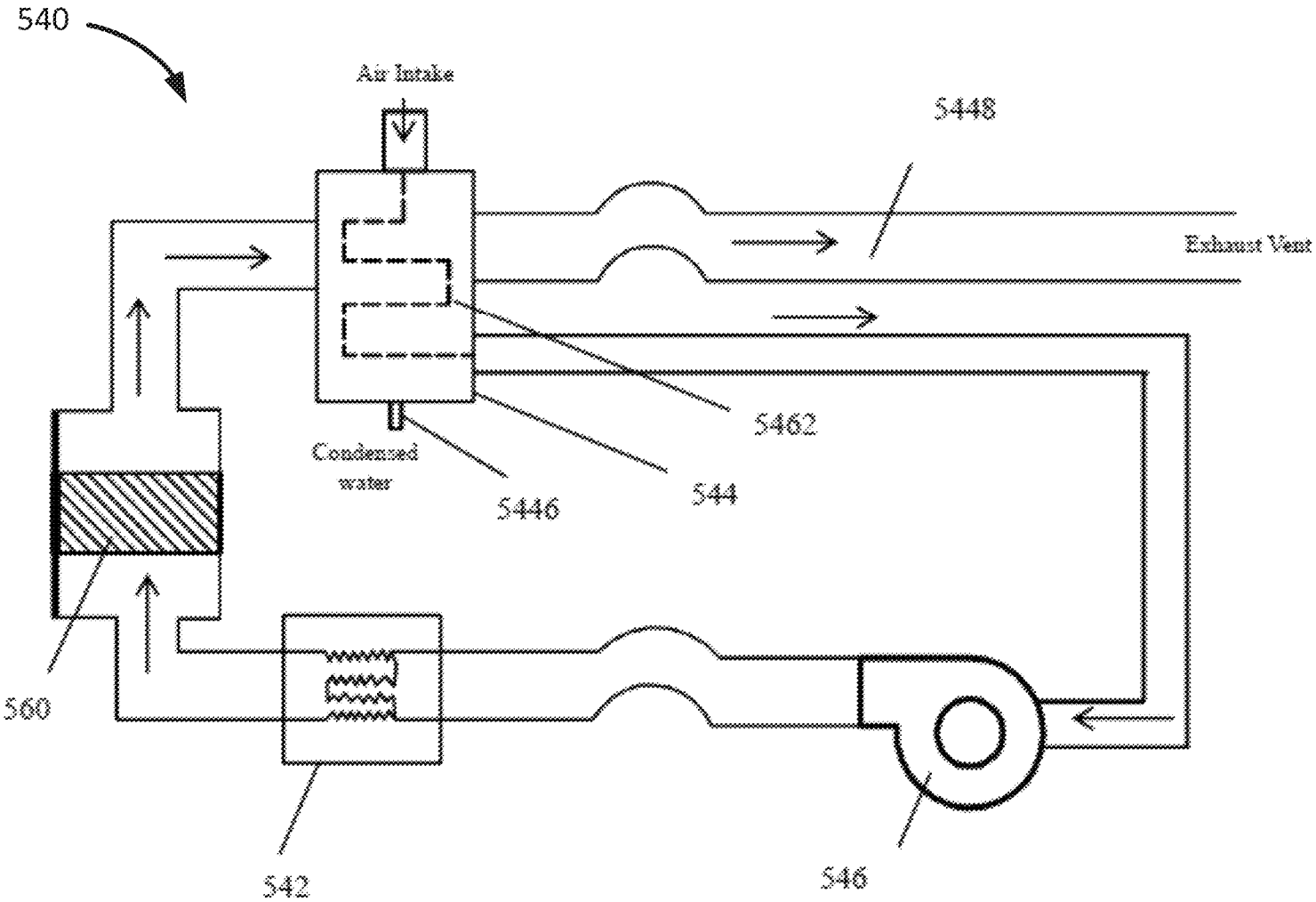
FIG. 10 shows a schematic structural diagram of a moisture exhaust passage of the laundry machine, in accordance with some embodiments of the present disclosure.

FIG. 10 shows a schematic diagram of some embodiments of a moisture exhaust passage 540 of laundry machine 100 of FIG. 7, in accordance with some embodiments of the present disclosure. As shown in FIG. 10, in some embodiments, air inlet passage 5462 of fan 546 passes through the interior of heat exchanger 544. The hot and humid airflow discharged out of the moisture exhaust area of dehumidification device 750, when passes through heat exchanger 544, undergoes heat exchange with the cold air in air inlet passage 5462 of fan 546, so that the moisture in the hot and humid airflow can be removed and the temperature of the hot and humid air flow can be removed. The moisture is finally discharged through exhaust port 5448 of heat exchanger 544. In some embodiments, the airflow in air inlet passage 5462 of fan 546 is preheated when passing through heat exchanger 544, so that at least part of the energy can be recycled and used to save energy.

In some embodiments, heat exchanger 544 can also be omitted, and the airflow discharged from the air outlet side of moisture exhaust passage 540 is directly discharged to the outside of the laundry machine 100.

In some embodiments, as shown in FIG. 7, dehumidification device 750 chooses to establish fluid communication with any one of the plurality of containers 730 through switching mechanisms 790, 792, and 794. In some embodiments, switching mechanisms 790, 792, and 794 can include valves, solenoid valves, etc.

In some embodiments, moisture absorption passage 520 of dehumidification device 750 can choose to establish fluid communication with any one of containers 730 through switching mechanisms 790, 792, and 794. In some embodiments, switching mechanisms 790, 792, and 794 include a first switching mechanism 790 disposed at the connection between air outlet section 524 of dehumidification device 750 and air inlet passage 732 of container 730. In some embodiments, switching mechanisms 790, 792, and 794 further include second switching mechanism 792 and 794 disposed on air outlet passages 734 of respective containers 730. In some embodiments, first switching mechanism 790 and second switching mechanism 792 can provide connection between one container 730 and air inlet section 522 and air outlet section 524 of dehumidification device 750, and cut off connection between the other container(s) 730 and air inlet section 522 and air outlet section 524 of dehumidification device 750. In some embodiments, first switching mechanism 790 and/or second switching mechanisms 792, 794 may be disposed at the connection between air outlet section 524 and/or air inlet section 522 of dehumidifier apparatus 750 and air inlet passage 732 and/or air outlet passage 734 of container 730. In some embodiments, laundry machine 700 includes a plurality of first switching mechanisms 790 and/or second switching mechanisms 792, and they are respectively provided in air inlet passage 732 and/or air outlet passage 734 of each container 730 of the plurality of containers. In some embodiments, FIG. 7 shows that two second switching mechanisms 792 and 794 are provided in laundry machine 700. In some embodiments, first switching mechanism 790 and one of second switching mechanisms 792 and 794 corresponding to one container 730 are selected to open so that air inlet passage 732 and air outlet passage 734 of the corresponding container 730 are open.

Switching mechanisms 790 and the other one of 792 and 794 are closed, so that one of the containers 730 is in fluid communication with dehumidifier apparatus 750, and the fluid communication between the other container(s) 730 and dehumidifier apparatus 750 is cut off. In some embodiments, filter assembly 770 is used to filter the airflow discharged from container 730 and before it enters dehumidification device 750, so as to prevent foreign matters, such as flying fluff, flint, discharged from container 730 from entering dehumidification device 750. For example, filter assembly 770 is used to prevent the flying fluff discharged from container 730 from entering into the interior of the moisture absorption and moisture exhaust member 560, or covering the surface of the moisture absorption and moisture exhaust member 560 to affect the dehumidification effect of the moisture absorption and moisture exhaust member 560.

In some embodiments, filter assembly 770 is used to filter the airflow discharged from container 730 before entering the dehumidification device 750, so as to prevent foreign matter such as flying fluff discharged from container 730 from entering the dehumidification device 750. For example, filter assembly 770 is used to prevent the flying fluff discharged from container 730 from entering into the interior of the moisture absorption and moisture exhaust member 560, or covering the surface of the moisture absorption and moisture exhaust member 560 to affect the moisture absorption and moisture exhaust effect of moisture absorption and moisture exhaust member 560.

In some embodiments, the filter assembly 770 is disposed in air inlet section 522 of dehumidification device 750, e.g., between the second switching mechanism and the dehumidification device (e.g., the moisture absorption and moisture exhaust member 560). In some embodiments, filter assembly 770 can also be disposed on air outlet passage 734 of container 730, and the second switching mechanism can be located downstream of filter assembly 770 in the airflow direction. For example, along the airflow direction, filter assembly 770 is located between the second switching mechanism and container 730, or the second switching mechanism is located between filter assembly 770 and the dehumidification device 750. In some embodiments, the second switching mechanism can be located upstream of filter assembly 770 in the airflow direction. For example, along the airflow direction, the second switching mechanism is located between filter assembly 770 and container 730, or filter assembly 770 is located between the second switching mechanism and dehumidification device 750. In some embodiments, there are one or more filter assemblies 770. In some embodiments, when there is one filter assembly 770, it can be provided on air inlet section 522 of dehumidification device 750. In some embodiments, if there are multiple filter assemblies 770, they can be respectively arranged on air outlet passages 734 of the multiple containers 730.

In some embodiments, filter assembly 770 includes a filter 720 and a filter self-cleaning device 740. In some embodiments, filter assembly 770 includes a detachable filter 720 and its mounting bracket. When filter 720 is detachable, the user can manually clean filter 720 according to the sensing data of the sensor. In some embodiments, filter 720 can also be cleaned after each job is completed, or it can be cleaned as suitable, or as wanted. In some embodiments, filter 720 can be manually disassembled and removed, rinsed, wiped, and/or washed, etc.

In some embodiments, filter 720 includes, but not limited to, a filter screen. In some embodiments, the mesh number of the filter screen is not restricted, and can be set as suitable or required by the system. In some embodiments, one-stage filtration can be used, and filter 720 is set on air outlet passage 734 of container 730, or air inlet section 522 of dehumidification device 750. In some embodiments, two-stage or multi-stage filtration can also be used. In some embodiments, a filter 720 is provided on air outlet passage 734 of container 30 and air inlet section 522 of dehumidifier apparatus 750 to enhance the filtering effect.

In some embodiments, filter self-cleaning device 740 is used to automatically clean filter 720 to ensure that the filtering function of filter 720 functions properly. In some embodiments, the cleaning method of filter self-cleaning device 740 includes liquid spray, vibration, blowing, scraping, or sweeping. In some embodiments, filter self-cleaning device 740 includes a spray mechanism for spraying at filter 720, a vibration mechanism for vibrating filter 720 (e.g., a vibration motor is used to vibrate the filter screen), an air blowing mechanism for blowing at filter 720, and/or a scraping mechanism for scraping the filter 720. In some embodiments, the air blowing mechanism includes a reverse air flow generated by the reversed rotation of fan 526 of moisture absorption passage 520. For example, the direction of the reverse air flow through filter 720 during cleaning has an opposite direction from the air flow through filter 720 during drying. In some embodiments, when fan 526 is arranged in air inlet section 522 of moisture absorption passage 520, the effect is better. In some embodiments, a fan for generating reverse air flow for blowing at filter 720 can be a separate and different fan from fan 526. In some embodiments, the scraping mechanism includes a scraper that can be manpowered, or an electric scraper. For example, when it is detected according to the sensor signal that filter 720 is blocked to a certain extent, the control system controls the electric scraper to scrape along the absorption surface of filter 720 to remove the lint and other debris absorbed thereon. In some embodiments, the controller of the laundry machine can control filter self-cleaning device 740 to proactively and automatically clean filter 720 as suitable.

Taking the liquid spraying method as an example, in some embodiments, the spray mechanism of filter self-cleaning device 740 includes a nozzle 742 and a water supply system 744 for supplying water to the nozzle. In some embodiments, nozzle 742 is facing filter 720, and water supply system 744 is connected to the water inlet water circuit (not shown) of the laundry machine through a switch such as a valve (not shown). The switch may be turned on or off through the controller of the laundry machine. In some embodiments, nozzle 742 of the spray mechanism of filter self-cleaning device 740 is arranged on the side of filter 720 close to dehumidification device 750 (e.g., the side away from the air outlet of container 730). Foreign matters, such as fluff, discharged from container 730 is usually absorbed on the side of filter 720 that is away from dehumidification device 750 (e.g., the side close to the air outlet of container 730). Accordingly, the direction in which the fluid, such as water, sprayed by the spray mechanism of filter self-cleaning device 740 flows through filter 720 is opposite to the direction in which the airflow discharged from container 730 flows through filter 720. In this way, the fluid sprayed by the spray mechanism of filter self-cleaning device 740 can easily make the fluff absorbed on filter 720 detached from filter 720 and enter the drainage passage of laundry machine 700 together with the water flow to be discharged from the laundry machine. For example, when filter 720, such as the filter screen, is inclined in the air outlet channel of container 730 or air inlet section 522 of moisture absorption passage 520, nozzle 742 of the spray mechanism is disposed on the side of the filter screen close to dehumidification device 750 and located above the middle line of the filter screen, so that the liquid sprayed from nozzle 744 can cover the entire filter screen as much as possible, to effectively clean the filter screen. It some embodiments, the filter screen can be arranged horizontally, vertically, partially inclined and partially vertical, or partially horizontal and partially inclined, etc. The spraying direction of nozzle 742 can be set to facilitate spraying to the full area of filter 720 as much as possible when starting the self-cleaning process.

In some embodiments, when using the liquid spraying method, filter 720 and filter self-cleaning device 740 can be arranged in air inlet section 522 of the dehumidification channel. The fluid after cleaning can pass from air inlet section 522 of moisture absorption passage 520, through air outlet passage 734 of one of containers 730 that is connected to air inlet section 522, flow toward the drainage passage of the connected container 730, and then discharge from laundry machine 700. For example, when containers 730 are stacked vertically up and down, during the cleaning process or after cleaning is completed, container 730 in the lower part is connected to air inlet section 522 of moisture absorption passage 520, while the connection between container 730 in the upper part and air inlet section 522 of moisture absorption passage 520 is cut off by second switching mechanisms 792 and 794. For example, when the clothes in upper container 730 in FIG. 7 need to be dried, the controller can control first switching mechanism 790 to connect air outlet section 524 of dehumidification device 750 with air inlet passage 732 of upper container 730, and cut off the connection between air outlet section 524 of dehumidification device 750 and air inlet passage 732 of the lower container 730. Meanwhile, the controller can also control second switching mechanism 792 located in air outlet passage 734 of the upper container 730 to connect air inlet section 522 of dehumidification device 750 and air outlet passage 734 of the upper container 730. The controller can further control second switching mechanism 794 located in air outlet passage 734 of the lower container 730 to cut off air inlet section 522 of dehumidification device 750 and air outlet passage 734 of the lower container 730. In another example, when the clothes in the lower container 730 in FIG. 7 need to be dried, the controller can control first switching mechanism 790 to connect air outlet section 524 of dehumidification device 750 with air inlet passage 732 of the lower container 730, and cut off the connection between air outlet section 524 of dehumidification device 750 and air inlet passage 732 of the upper container 730. Meanwhile, the controller can control second switching mechanism 794 located in air outlet passage 734 of the lower container 730 to connect air inlet section 522 of dehumidification device 750 and air outlet passage 734 of the lower container 30. The controller can also control second switching mechanism 792 located in air outlet passage 734 of the upper container 730 to cut off the connection between air inlet section 522 of dehumidification device 750 and air outlet passage 734 of the upper container 730. When filter 720 needs to be cleaned after drying, the controller controls second switching mechanism 792 located in air outlet passage 734 of the upper container 730 to cut off the connection between air inlet section 522 of dehumidification device 750 and air outlet passage 734 of the upper container 730. The controller further controls second switching mechanism 794 located in air outlet passage 734 of the lower container 730 to connect air inlet section 522 of the dehumidification device 750 with air outlet passage 734 of the lower container 730. The liquid drain after cleaning can pass through air outlet passage 734 of the lower container 730, and can then be discharged through the drainage passage of the lower container 730. The connection between air outlet passage 734 of the lower container 730 and the drainage passage of the lower container 730 can be connected or cut off through a valve.

In some embodiments, during the drying process of the upper container 730, second switching mechanism 792 connects air outlet passage 734 of the upper container 730 with air inlet section 522 of dehumidification device 750, while second switching mechanism 792 also cuts off the connection between air outlet passage 734 of the lower container 730 and air inlet section 522 of dehumidification device 750. When filter 720 is sprayed and cleaned, second switching mechanism 794 is controlled to open for a short time to discharge the sprayed water to the lower container 730 or the drainage passage. During the drying process of the lower container 730, second switching mechanism 792 cuts off the connection between air outlet passage 734 of the upper container 730 and air inlet section 522 of dehumidification device 750, while second switching mechanism 794 keeps the connection between air outlet passage 734 of the lower container 730 and air inlet section 522 of dehumidification device 750, so that the air flow of the lower container 730 can pass through filter 720 and flow to dehumidification device 750, and the liquid used for spraying and cleaning filter 720 flows to the lower container 730 or the drainage passage in the opposite direction of that of the above air flow.

In some embodiments, when using the liquid spraying method, filter 720 and filter self-cleaning device 740 can also be arranged on air outlet passage 734 of container 730. For example, filter 720 and filter self-cleaning device 740 can be arranged on air outlet passage 734 of each container 730. The liquid after cleaning can pass through air outlet passage 734 of the corresponding container 730 and then be discharged through the drain passage of the container 730.

In some embodiments, the water flow of filter self-cleaning device 740 can flow to the water storage bucket or the drainage pipeline of one of the containers 30 through a separately provided fluid pipeline, such as the water storage bucket or the drainage pipeline of the lowermost container 730. In this case, a second switching mechanism can be provided at the junction of air outlet passage 734 of the upper container 730 and air outlet passage 734 of the lower container 730, so that the connection between air outlet passage 734 of the upper and lower containers 730 and air inlet section 522 of dehumidification device 750 can be either connected or switched off.

In some embodiments, the cleaning frequency can be set. For example, filter 720 is cleaned after each dehumidification treatment of the laundry. Filter 720 may also be cleaned after multiple dehumidification treatments. Parameters such as spray time and spray water speed for each cleaning process can also be set. The spray time and spray water speed for each cleaning process can be fixed or adjustable. For example, if filter 720 is cleaned after each dehumidification treatment, the spraying time can be relatively short and the speed of water spraying can be relatively slow. If filter 720 is cleaned after multiple dehumidification treatments, the spraying time can be relatively long and the speed of spraying water can also be relatively fast. A sensor can be set on filter 720, and when it is sensed that filter 720 is more blocked, e.g., when an air pressure on the pipeline drops to a certain threshold, indicating that filter 720 is clogged seriously, the controller of the laundry machine can increase the spraying time and/or the speed of the spraying water of the spraying mechanism, thereby increasing the cleaning strength.

In some embodiments, container 730 for containing clothes may be a clothes containing tub of a washing machine or a clothes containing tub of a dryer. In some embodiments, at least two containers 730 for containing clothes can be stacked vertically on top of each other or horizontally. In some embodiments, laundry machine 700 of FIG. 7 may be a washing machine, including an upper laundry tub and a lower laundry tub that are stacked on top of each other. In some embodiments, laundry machine 700 of FIG. 7 may also be an integrated washer dryer. The upper clothes containing tub may be the inner tub of the dryer and the lower clothes containing tub may be the inner tub of the washing machine, or the lower clothes containing tub may be the inner tub of the dryer and the upper clothes containing tub may be the inner tub of the washing machine. The laundry machine 700 can also be a clothes dryer, the upper clothes containing tub may be the inner tub of the upper dryer, and the lower clothes containing tub is the inner tub of the lower dryer.

Some embodiments of the present disclosure also provide a method for using the laundry machine. The method includes the following steps.

In the dehumidification step, dehumidification device 750 is fluidly connected to one of the containers 730 and dehumidifies the clothes contained therein. The air flow out of the connected container 730 enters dehumidification device 750 after passing through filter assembly 770.

In the cleaning step, filter self-cleaning device 740 cleans filter 720.

In some embodiments, the dehumidification step further includes: controlling the temperature of the airflow entering container 730 after being discharged from dehumidification device 750 to be lower than a predetermined temperature. In some embodiments, a temperature sensor can be provided near the air inlet of container 730. When the sensor senses that the temperature of the airflow entering the air inlet of container 730 is higher than the predetermined temperature, such as 75° C., the controller will control the heating temperature of heater 542, such as reducing the heating temperature, thereby reducing the temperature of the airflow entering the moisture exhaust area, so as to reduce the temperature of the moisture absorption and moisture exhaust member 560, and reduce the temperature of the airflow flowing out of the moisture absorption area and entering container 730.

In some embodiments, filter self-cleaning device 740 can clean filter 720 by spraying, blowing, vibrating, or scraping, etc.

In some embodiments, laundry machine 700 provided by the embodiments of the present disclosure has at least the following features and benefits.

Multiple containers share the same dehumidification device 750, which can simplify the structure of laundry machine 700, reduce the overall height or width of the laundry machine 700, thereby reducing the volume and cost of the entire device. The use of filters can prevent foreign matter, such as flying fluff, from entering the inside of dehumidification device 750, or covering the surface of dehumidification device 750, which can affect the dehumidification effect. In some embodiments, filter assembly 770 includes a filter self-cleaning device 740 used to automatically clean filter 720 to ensure that the filter function of filter 720 does not degrade with the extension of use time, thereby providing strong protection and extend the life of dehumidification device 750.

Figure 11:
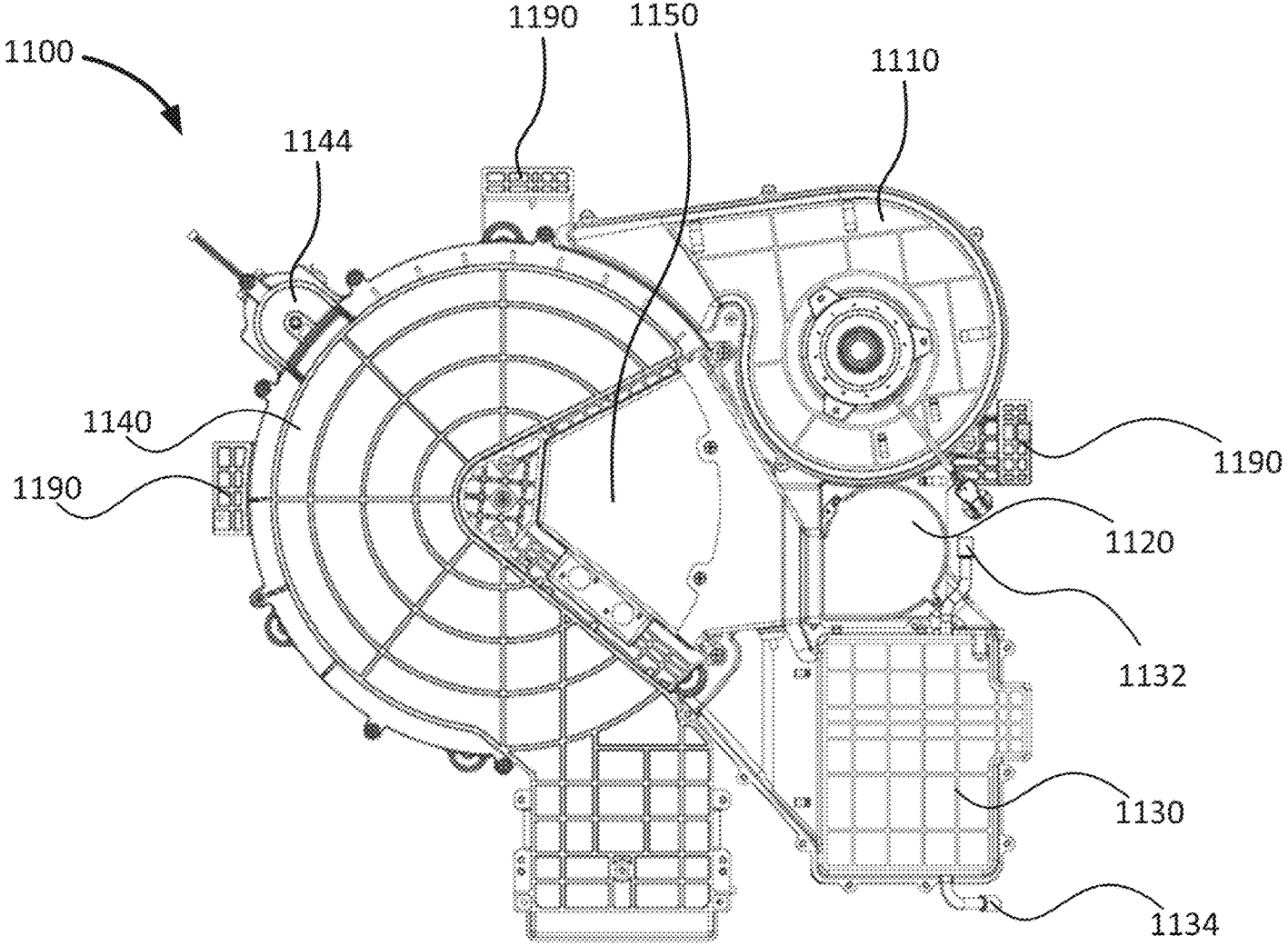
FIG. 11 shows a top view of a dehumidifier, in accordance with some embodiments.

FIG. 11 shows a top view of a dehumidifier 1100, in accordance with some embodiments. In some embodiments, dehumidifier 1100 can be working with any type of laundry machine (e.g., laundry machine 100, or laundry machine 1300 shown in FIG. 13), such as an integrated washer dryer, a dryer, a washer, etc. to dry the laundry items. In some embodiments, dehumidifier 1100 includes a circulation section 1110, a regeneration section 1120, a condensing section 1130, a roller section 1140, a driving motor 1144 configured to drive rotation of the roller in roller section 1140, and a heating section 1150. In some embodiments, condensing section 1130 includes a water inlet 1132 and a water outlet 1134 for circulating water. In some embodiments, dehumidifier 1100 can be coupled with one or more mounting members 1190, such as mounting brackets, for mounting and fixing dehumidifier 1100 on the laundry machine, e.g., as illustrated in an exemplary embodiment in FIG. 14. Dehumidifier 1100 can also be referred to as a drying module in the present disclosure.

Figure 12:
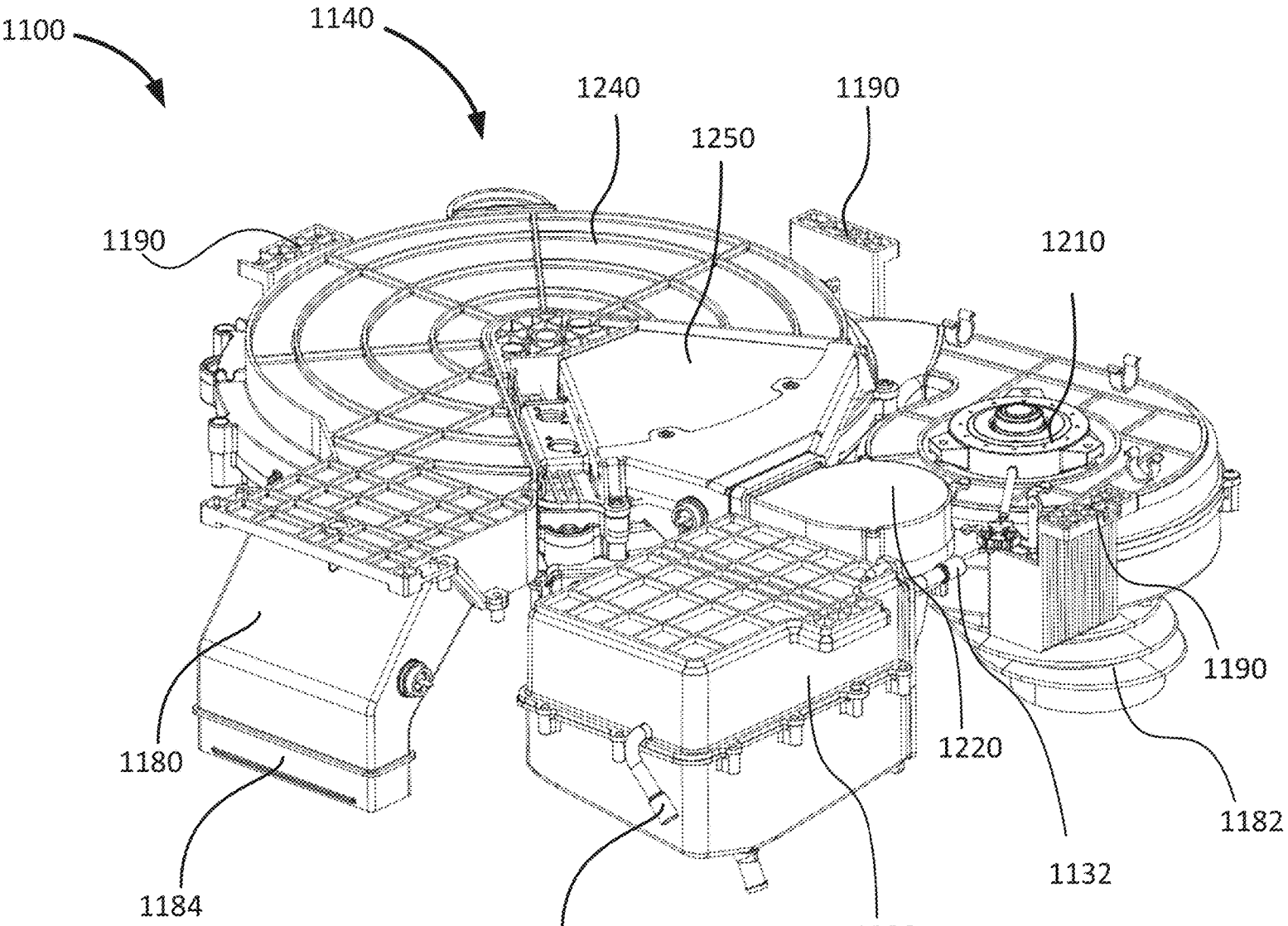
FIG. 12 shows a perspective view of a plurality of components of a dehumidifier, in accordance with some embodiments.

FIG. 12 shows a perspective view of a plurality of components of dehumidifier 1100 in FIG. 11, in accordance with some embodiments. In some embodiments, circulation section 1110 includes a circulation fan 1210 for circulating airflow between an inner drum of the laundry machine and roller section 1140 to remove the moisture from the humid air circulated from the inner drum. In some embodiments, circulation fan 1210 performs similar function as circulation fan 203 of integrated washer dryer 100. In some embodiments, regeneration section 1120 includes a regeneration fan 1220 for forming a moisture exhaust airflow. In some embodiments, regeneration fan 1220 performs substantially similar function as regeneration fan 205 of laundry machine 100. In some embodiments, condensing section 1130 contains a condenser 1230. In some embodiments, condenser 1230 performs substantially similar function as a condenser of condensation component 40 of laundry machine 100. In some embodiments, roller section 1140 can be divided into a moisture absorption area 1240 (e.g., a dehumidification area coupled to or disposed in a moisture absorption passage) and a moisture removal area 1250 (e.g., a regeneration area, corresponding to the heating section 1150 of FIG. 11, coupled to or disposed in a regeneration passage) corresponding to heating section 1150. In some embodiments, a portion of roller assembly 1900 (and the corresponding portion of roller 1914 (FIG. 19A)) coupled to or disposed in the moisture absorption passage, e.g., disposed in moisture absorption area 1240, is configured to absorb moisture from the moist air coming from wet laundry in drum 1302. Another portion of roller assembly 1900 (and the corresponding another portion of roller 1914) coupled to or disposed in the regeneration passage, e.g., disposed in moisture removal area 1250, is configured to remove the absorbed moisture from roller 1914 so as to "regenerate" this portion of roller assembly 1900 or roller 1914 for absorbing more moisture when it rotates to moisture absorption area 1240. As roller assembly 1900 rotates, the portion of roller 1914 previously in moisture absorption area 1240 and absorbed with moisture moves to moisture removal area 1250 where the absorbed moisture can be discharged to the regeneration passage via the moisture exhaust airflow; and the portion of roller 1914 previously in moisture removal area 1250 with absorbed moisture removed moves to moisture absorption area 1240 for absorbing more moisture coming from drum 1302. In some embodiments, a roller assembly 1900 (FIG. 18A) is substantially similar function as moisture absorption roller assembly 2062 (FIG. 4) of laundry machine 100.

In some embodiments, the moisture absorption passage is a passage that allows airflow generated by a fan (e.g., circulation fan 1210) to flow from drum 1302 to an area on moisture absorption and removal structure for absorbing the moisture contained in the airflow. In some embodiments shown in FIGS. 11-12, the moist air including moisture from drum 1302 is driven by circulation fan 1210 to flow from drum 1302, through circulation fan 1210, to enter roller assembly 1900, e.g., moisture absorption area 1240, for absorbing the moisture.

In some embodiments, the moisture removal passage is a passage that allows airflow driven by a fan (e.g., regeneration fan 1220) to flow through the roller assembly 1900, e.g., after moisture absorption area 1240 rotates to moisture removal area 1250 or after heated by heating section 1150, towards one or more components disposed in the moisture removal passage to remove the moisture from moisture removal area 1250 of roller assembly 1900. In some embodiments shown in FIGS. 11-12, airflow, e.g., from atmosphere or outlet of condenser 1230, is generated by regeneration fan 1220 to flow to heating section 1150, and the heated airflow is then flown to moisture removal area 1250 of roller assembly 1900, and then to condenser 1230 to condense the moisture in the heated airflow into water. The dry and cool air after passing condenser 1230 can either be exhausted to the atmosphere, or be recirculated back to inlet of regeneration fan 1220. In some embodiments, dehumidifier 1100 includes a connector 1182 coupled to circulation fan 1210 (e.g., illustrated in FIG. 18A), and connector 1182 is connected to an air outlet of an inner drum of the laundry machine, e.g., rotary drum 1302. In some embodiments, moist air with moisture from laundry flows out of rotary drum 1302 via circulating airflow driven by circulation fan 1210 flowing out from rotary drum 1302. In some embodiments, the airflow communication between rotary drum and dehumidifier 1100 is similar to the airflow communication disclosed with reference to FIGS. 1-5.

Figure 23A:
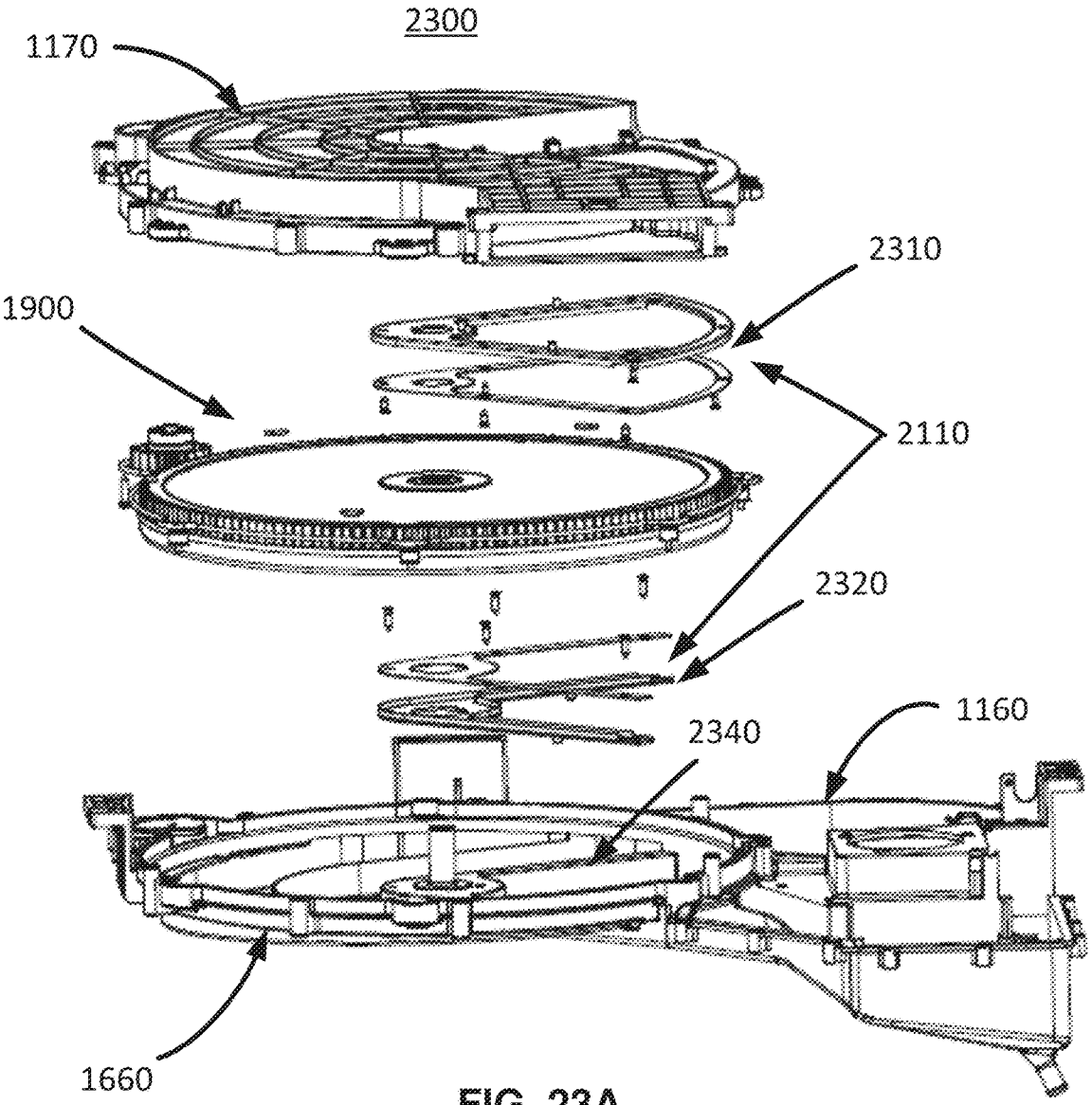
FIG. 23A shows an exploded view of a system including a roller assembly sandwiched between a roller upper casing and a dehumidifier lower casing, in accordance with some embodiments.

In some embodiments, dehumidifier 1100 includes a connector 1180 extending from a casing coupled to at least a portion of roller section 1140 (e.g., a roller upper casing 1170 of FIG. 23A). Connector 1180 can be used for connecting roller section 1140 on dehumidifier 1100 to the inner drum of the laundry machine for containing the laundry, e.g., rotary drum 1302 of laundry machine 1300 of FIG. 13. In some embodiments, roller section 1140, e.g., via its moisture absorption area 1240 and the corresponding moisture absorption passage, includes an air inlet and an air outlet respectively connected (e.g., directly or indirectly through other part(s)) to the inner drum of the laundry machine. In some embodiments, connector 1180 is connected to an air inlet of rotary drum 1302 to flow the dry air into rotary drum 1302 after the moisture removal process. In some embodiments, the lower part 1184 of connector 1180 uses a flexible corrugated pipe or a bellow hose to prevent the vibration of rotary drum 1302 during operation from being transmitted to the entire dehumidifier 1100.

In some embodiments, regeneration fan 1220 (similar to regeneration fan 205) is configured to form moisture exhaust airflow in a regeneration passage. In some embodiments, moisture absorption area 1240 is disposed in the moisture absorption passage, and the circulating airflow passes through moisture absorption area 1240. In some embodiments, moisture removal area 1250 is disposed in the regeneration passage, and the moisture exhaust airflow passes through moisture removal area 1250. In some embodiments, a portion of roller assembly 1900 disposed in moisture absorption area 1240 is configured to absorb moisture from the circulating airflow in the moisture absorption passage. When this portion with absorbed moisture rotates to moisture removal area 1250, the absorbed moisture is discharged through the moisture exhaust airflow. In some embodiments, after the moisture is removed and discharged, and when this "regenerated" portion of roller assembly 1900 rotates back to moisture absorption area 1240, it is capable of absorbing more moisture from the circulating airflow.

In some embodiments, roller section 1140 can be divided into more than two zones, such as three zones. For example, in addition to moisture absorption area 1240 (e.g., dehumidification area) and moisture removal area 1250 (e.g., regeneration area or heating area), a fan-shaped cooling zone (not shown) can also be placed downstream of the regeneration area. Accordingly, the heated air exiting the regeneration area (after being heated) can subsequently pass through the cooling zone, to reach the moisture absorption zone, so as to improve dehumidification effect.

In some embodiments, more than one roller, such as two rollers can be used for alternately performing the moisture absorption and regeneration processes. Accordingly, an air inlet and an air outlet will be provided on the drum for each of the two or more rollers. In some embodiments, one pair of air inlet and air outlet is provided on the drum, and the air inlet and air outlet are branched into two pipelines connected to the two rollers respectively. In some embodiments, while the first roller performs moisture absorption, the second roller performs the moisture removal (regeneration process). In some embodiments, when a predetermined switching mechanism is triggered, such as a predefined time period, or it is detected that the moisture absorption roller is saturated, the airflow path is switched through the switching mechanism to start the first roller for moisture removal, and the second roller for moisture absorption.

In some embodiments, instead of using a rotational roller, other types of moisture absorption and removal structure(s) can be used, such as crawler transmission for transmitting from moisture absorption channel to moisture removal channel, or a planar moisture absorption and moisture removal components that perform reciprocating motion. For example, moisture absorption channels and moisture removal channels can be alternately distributed on a plane. By applying a translation movement of the moisture absorption and removal structure relative to the two channels, the absorption part and removal part can perform moisture absorption and moisture removal processes, respectively, and these two parts can alternatively perform during the translation movement. After the translation occurs, the moisture absorption and moisture removal processes are alternatingly performed to different areas.

In some embodiments, in a circular moisture absorption and removal structure, the driving mechanism can drive the circular structure to rotate relative to the moisture absorption channel and the regeneration channel, or drive the moisture absorption channel and the regeneration channel to rotate relative to the rotating disk. In some embodiments, when the moisture absorption and removal structure includes a belt, the driving mechanism can drive the belt to perform a linear motion (or a translation movement) relative to the moisture absorption channel and the regeneration channel, or drive the moisture absorption channel and the regeneration channel to perform linear motion relative to the belt. In some embodiments, two or more moisture absorption members may be provided, and the driving mechanism is used to drive different moisture absorption members (or drive the moisture absorption channel and the regeneration channel), so that different moisture absorption members are alternately located on the moisture absorption channel and the regeneration channel.

Figure 13:
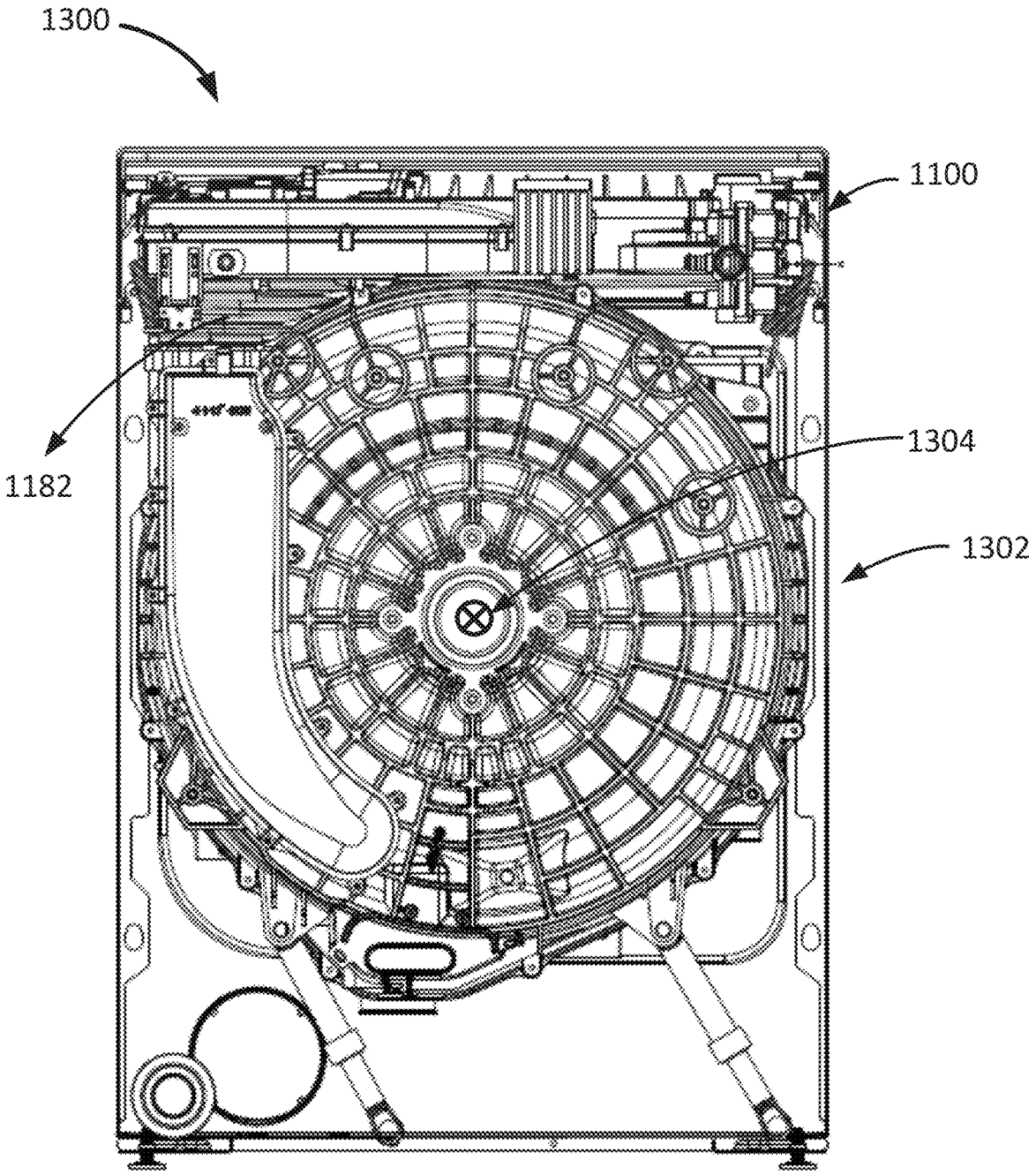
FIG. 13 shows a back view of a laundry machine coupled with a dehumidifier, in accordance with some embodiments.

FIG. 13 shows a back view of a laundry machine 1300 coupled with dehumidifier 1100 in FIG. 11, in accordance with some embodiments. In some embodiments, dehumidifier 1100 is mounted on the top portion of laundry machine 1300. In some embodiments, dehumidifier 1100 can also be installed on one side, in the back portion, or at the bottom of laundry machine 1300. Laundry machine 1300 includes a rotary drum 1302 for containing laundry items for washing and/or drying. When in operation, rotary drum 1302 rotates long a rotating axis 1304 (perpendicular to the plane of display). In some other embodiments, rotary drum can also rotate along a rotating axis parallel to the display and perpendicular to the ground, or along a rotating axis parallel to the display and parallel to the ground, or in any other suitable directions. In some embodiments, dehumidifier 1100 is connected to the chamber of rotary drum 1302 via connector 1182 coupled to circulation fan 1210. In some embodiments, connector 1182 of FIGS. 12-13 includes a flexible, extendable, and bendable hose, such as a bellow hose, for connecting circulation fan 1210 to the air outlet of rotary drum 1302. Connector 1182 can prevent the vibration of rotary drum 1302 during operation from being transmitted to dehumidifier 1100.

Figure 14:
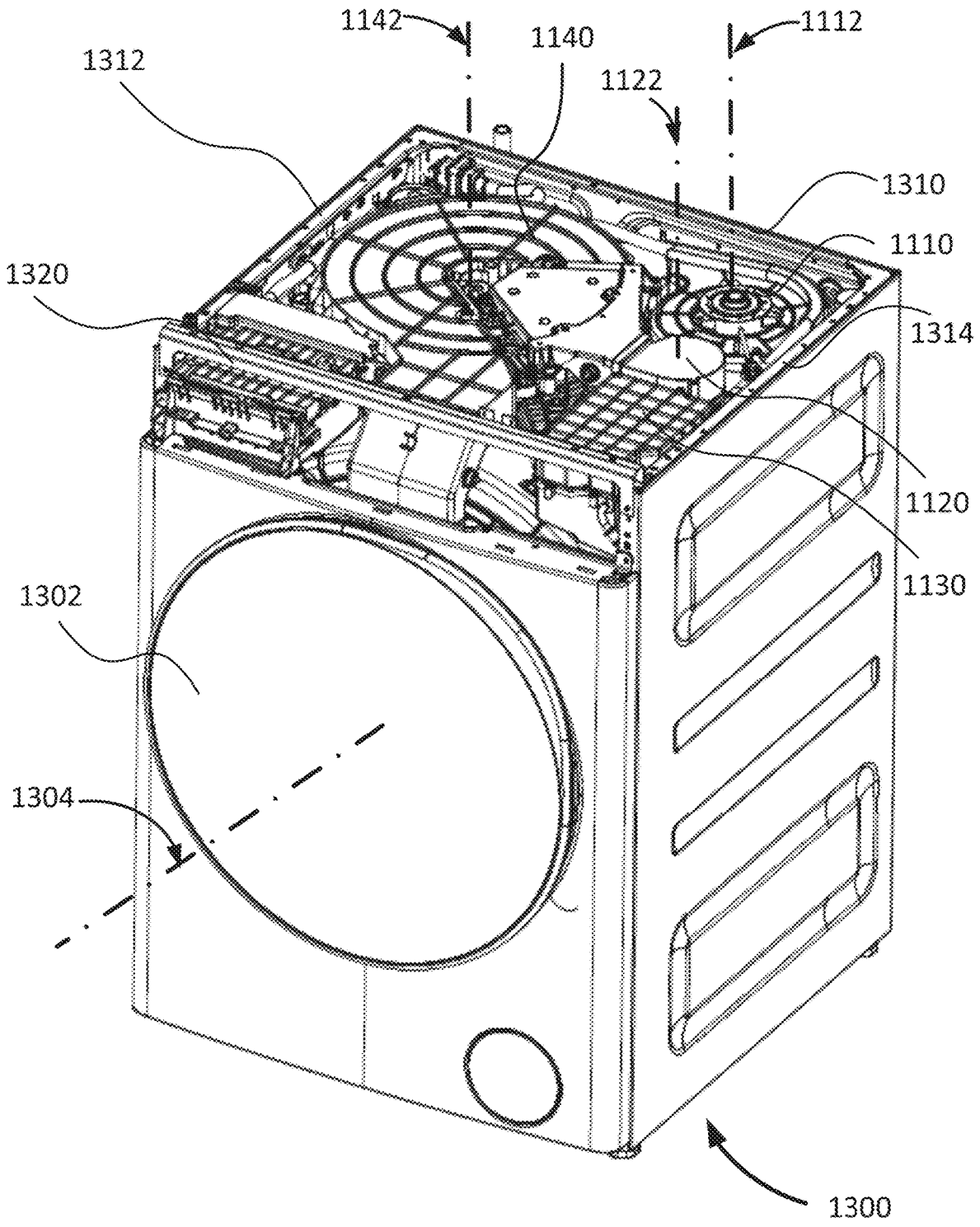
FIG. 14 shows a perspective view of a dehumidifier coupled to a laundry machine, in accordance with some embodiments.

FIG. 14 shows a perspective view of dehumidifier 1100 in FIG. 11 coupled to a top portion of laundry machine 1300, in accordance with some embodiments. In some embodiments, dehumidifier 1100 is mounted on top of laundry machine 1300. As shown in FIG. 11, dehumidifier 1100 can be coupled with a plurality of mounting brackets 1190, e.g., arranged in the back, left, and right as shown in FIGS. 11 and 12, for mounting the dehumidifier 1100 on a top frame of laundry machine 1300. For example, the top frame of laundry machine includes a back rack 1310, a left rack 1312, and a right rack 1314, respectively. In some embodiments, dehumidifier 1100 is also fitted with a rear frame 1320 at the top portion of laundry machine 1300 for providing space and connection for various electrical wires and pipelines. In some embodiments, dehumidifier 1100 is installed on the top frame of laundry machine 1300 as one single integrated module. Suitable coupling parts, such as mounting brackets 1190, are used to mount and stabilize dehumidifier 1100 to back rack 1310, left rack 1312, and right rack 1314 of the top frame of laundry machine 1300 as shown in FIGS. 11, 12 and 14. via suitable mechanisms, e.g., clipping, snapping, hanging, etc. In some embodiments, mounting brackets 1190 are extended from (e.g., connected to or removably coupled to) a continuous and integrated lower casing of dehumidifier 1100, and are mounted, locked, and fixed on the top frame, so as to install and stabilize dehumidifier 1100 on the laundry machine 1300. As dehumidifier 1100 is not directly in contact with the outer surface of the rotating drum, vibration of the rotating drum during operation will not be transmitted to the drying module affecting dehumidifier 1100, such as the roller section 1140.

In some embodiments, in order to minimize the height of laundry machine 1300, two or more parts of dehumidifier 1100 placed on top of the rotary drum 1302, including roller section 1140 including moisture absorption area 1240 and moisture removal area 1250 (or regeneration area), circulation section 1110 including circulation fan 1210, regeneration section 1120 including regeneration fan 1220, and/or condensing section 1130 including condenser 1230, are disposed within a plane, e.g., a horizontal plane substantially parallel to the ground, or a vertical plane substantially perpendicular to the ground. In some embodiments, roller section 1140 including roller assembly 1900 is disposed adjacent to at least one of circulation section 1110 including circulation fan 1210, regeneration section 1120 including regeneration fan 1220, and condensing section 1130 including the condenser 1230. For example, these four components may be all adject to each other. In another example, roller assembly 1900 (or a moisture absorption and removal structure in other shape) is adjacent to each of circulation section 1110 including circulation fan 1210, regeneration section 1120 including regeneration fan 1220, and condensing section 1130 including the condenser 1230, as shown in one embodiment in FIG. 12. In some embodiments, circulation section 1110 including circulation fan 1210 and condensing section 1130 including the condenser 1230 are disposed adjacent to and on opposite sides of regeneration section 1120 including regeneration fan 1220. In some embodiments, circulation section 1110 including circulation fan 1210, roller section 1140 including roller assembly 1900, regeneration section 1120 including regeneration fan 1220, and condensing section 1130 including the condenser 1230 are disposed in a substantial common plane. In some embodiments, for two components to be disposed in a substantial common plane, an upper surface of one component may be disposed within a substantial common plane with an upper surface of the other component, or a lower surface of one component may be disposed within a substantial common plane with a lower surface of the other component, or an upper surface of one component may be disposed within a substantial common plane with a lower surface of the other component. In some embodiments, for two components to be disposed in a substantial common plane, a center point (e.g., geometric center point) of one component is disposed within a substantial common plane with a center point of the other component, or a gravity center point of one component is disposed within a substantial common plane with a gravity center point of the other component, or a geometric center point of one component is disposed within a substantial common plane with a geometric center point of the other component. In some embodiments, dehumidifier 1100 with multiple parts disposed in a common plane can substantially save storage space thus providing a more compact structure of laundry machine 1300. For example, as shown in FIG. 11, dehumidifier 1100 includes one or more parts contained therein, e.g., all of roller section 1140, circulation section 1110, regeneration section 1120, and condensing section 1130, disposed within a horizontal common plane. In another example, roller section 1140 may be disposed in a common plane with one or two parts out of circulation section 1110, regeneration section 1120, and condensing section 1130. For example, at least one surface of one part is in a substantial common plane as at least one surface of another component. In another example, a geometric center point or gravity center point of one component is in a substantial common plane as a geometric center point or gravity center point of another component. In some embodiments, dehumidifier 1100 can be placed at the top of laundry machine 1300 as shown in FIG. 13, at the back of the laundry machine (e.g., FIG. 33), at the bottom of the laundry machine (e.g., FIG. 34), or other suitable spaces within a laundry machine.

In some embodiments, two or more rotation axes of two or more rotational parts of roller assembly 1900 (FIG. 18A), circulation fan 1210, regeneration fan 1220 are parallel to each other. For example, the rotation axes (e.g., corresponding to respective rotating shafts) of roller assembly 1900, circulation fan 1210, and regeneration fan 1220 are parallel to each other. In some embodiments, one or more of the rotation axes of roller assembly 1900, circulation fan 1210, and regeneration fan 1220 are perpendicular to an upper shell of laundry machine 1300. In some embodiments, one or more of a rotation axis 1142 of the roller assembly 1900 in roller section 1140, a rotation axis 1112 of circulation fan 1210 in circulation section 1110, and a rotation axis 1122 of regeneration fan 1220 in regeneration section 1120 are parallel to each other, and perpendicular to an rotation axis 1304 of rotary drum 1302 for loading laundry items in laundry machine 1300. In some embodiments, the airflow pipelines between different parts of dehumidifier 1100 are further connected within a compact space while providing high efficiency in dehumidifying performance.

In some embodiments, the overall height of the laundry machine is related to a combined dimension of the diameter of rotatory drum 1302 and the thickness of dehumidifier 1100 (including the shell containing dehumidifier 1100) placed above the rotatory drum. In some embodiments, the overall width or the overall depth of the laundry machine is related to a combined dimension of the diameter of rotatory drum 1302 and the diameter of roller section 1140. In some embodiments, circulation fan 1210, regeneration fan 1220, and/or condenser 1230 are disposed in one or more corners between the outer shell and the rotary drum 1302 of laundry machine 1300, to provide more compact design of the laundry machine. In some embodiments, circulation fan 1210, regeneration fan 1220, condenser 1230, the water pipelines connecting different parts, air pipelines connecting different parts, and/or electrical wires connecting different parts can be arranged in suitable horizontal or vertical space for more compact design without compromising the performance.

In some embodiments, as shown in FIGS. 11-14, the rotating shaft (e.g., along rotating axis 1142) of the rotating member of roller section 1140, the rotating shaft (e.g., along rotating axis 1112) of circulation fan 1210, and the rotating shaft (e.g., along rotating axis 1122) of regeneration fan 1220, are out of plane and perpendicular to the rotating shaft (e.g., along rotating axis 1304) of rotary drum 1302 of laundry machine 1300. In some embodiments, the rotating shaft of the rotating member of roller section 1140, the rotating shaft of circulation fan 1210, and the rotating shaft of regeneration fan 1220 are distributed on one or two sides of the rotating shaft of rotary drum 1302. In some embodiments, because the diameter of circulating fan 1210 and the diameter of the rotary member of roller section 1140 is larger than the diameter of regeneration fan 1220, the rotating shaft of roller section 1140 and the rotating shaft of circulating fan 1210 are both out-of-plane and perpendicular to the rotating shaft of rotary drum 1302, and are distributed on two sides of the rotating shaft of rotary drum 1302. For example, as shown in FIG. 14, the rotating shaft of roller section 1140 is disposed on one side of the rotating shaft of rotary drum 1302, and the rotating shaft of circulation fan 1210 is disposed on the other side of the rotating shaft of rotary drum 1302.

Figure 15A:
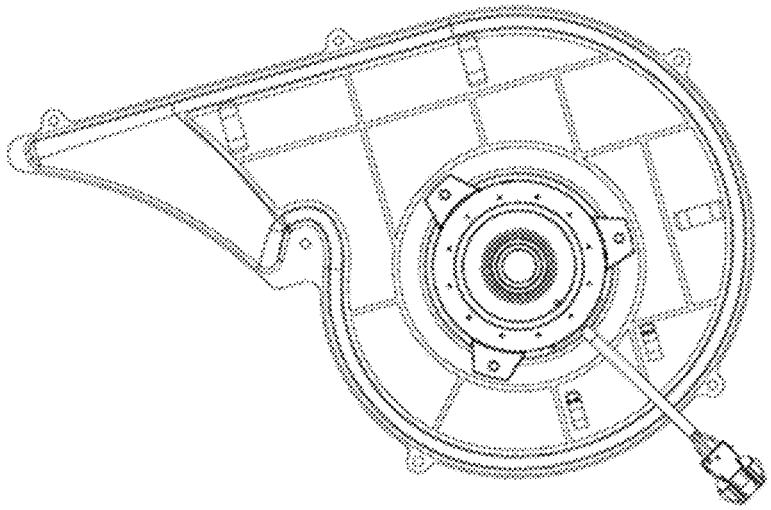
FIG. 15A shows a top view of a circulation fan of a dehumidifier, in accordance with some embodiments.
Figure 15B:
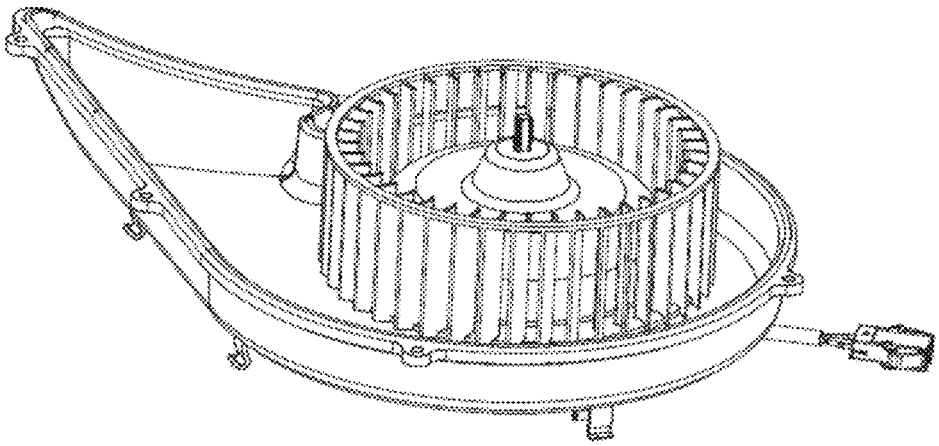
FIG. 15B shows a bottom view of a circulation fan of a dehumidifier, in accordance with some embodiments.
Figure 15C:
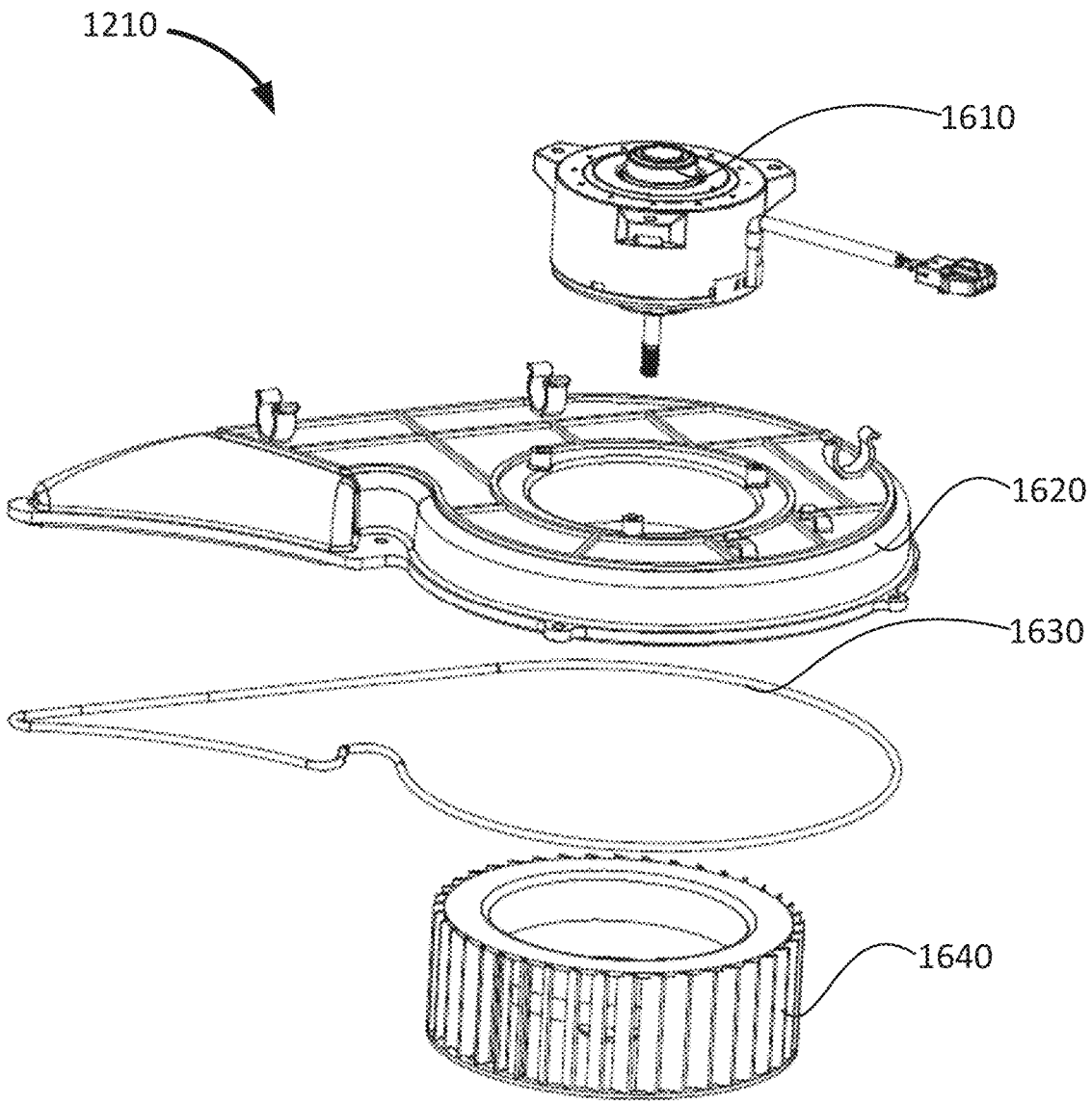
FIG. 15C shows an exploded view of different components of a circulation fan of a dehumidifier, in accordance with some embodiments.

FIGS. 15A-15B show a top view (e.g., from an upper casing side) and a bottom view (e.g., from the impeller side located on the opposite of the upper casing side), respectively, of circulation fan 1210 of dehumidifier 1100 in FIG. 11, in accordance with some embodiments. FIG. 15C shows an exploded view of different components of the circulation fan 1210 of dehumidifier 1100 in FIG. 11, in accordance with some embodiments. In some embodiments, circulation fan 1210 includes a motor 1610, an upper casing 1620 (e.g., in a volute shape), a gasket 1630, and an impeller 1640. In some embodiments, volute casing 1620 includes one or more slots, snaps, and/or clips for fitting and fixing wires and/or pipelines. In some embodiments, volute casing 1620 has a shape suitable for the fluid design requirements, so as to provide airflow channels that allow the optimized or maximized airflow volume and airflow speed for the operation of dehumidifier 1100.

Figure 16:
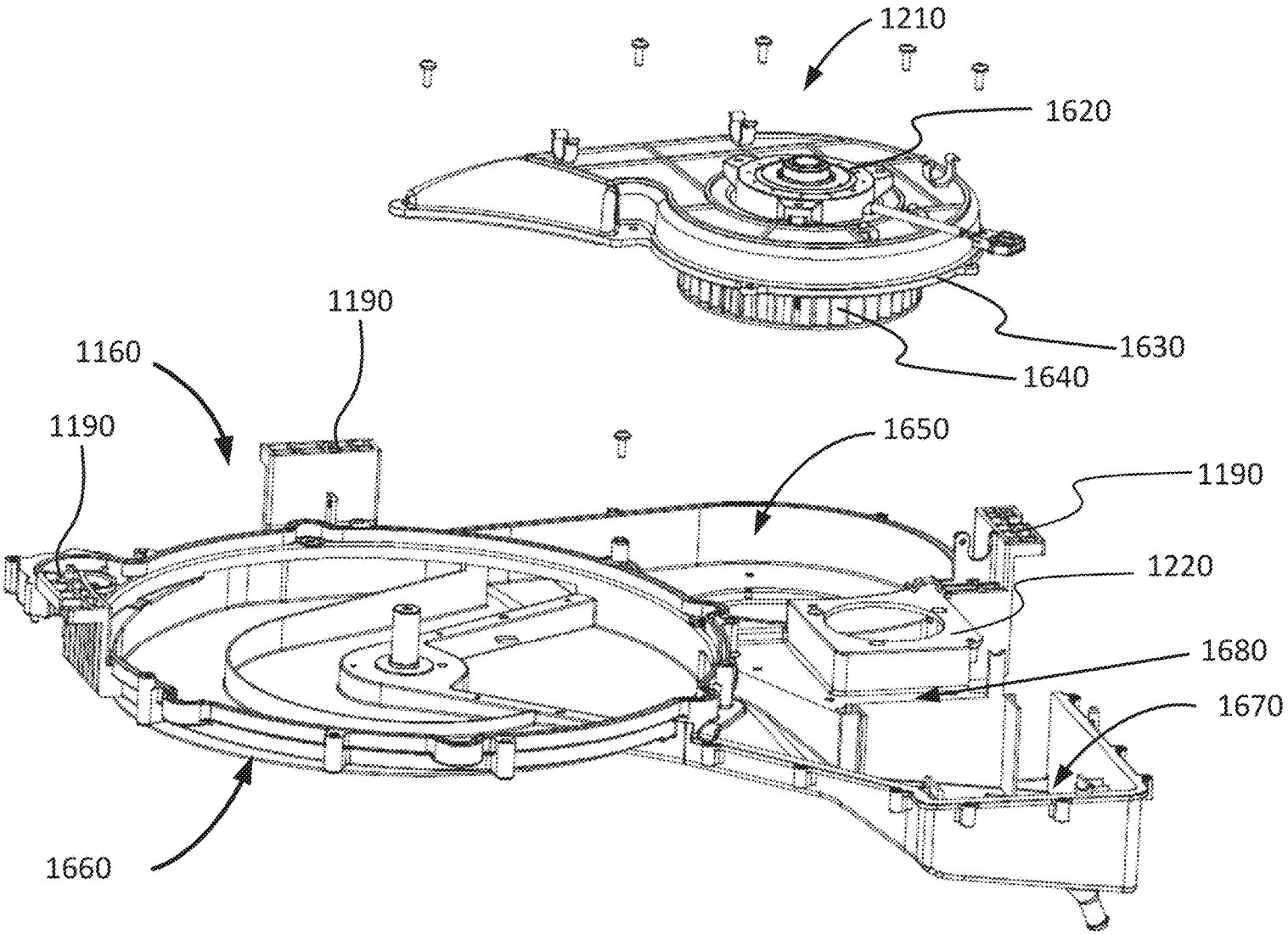
FIG. 16 shows a lower casing for containing a plurality of components of the dehumidifier including a circulation section, in accordance with some embodiments.

FIG. 16 shows a lower casing 1160 for containing a plurality of components of dehumidifier 1100 including circulation section 1110, in accordance with some embodiments. In some embodiments, lower casing 1160 can be divided into a plurality of areas for installing various components of dehumidifier 1100, including a circulation fan area 1650 for holding circulation fan 1210 therein. In some embodiments, volute casing 1620, motor 1610, and impeller 1640 can be screwed together in circulation fan area 1650 of lower casing 1160. In some embodiments, volute casing 1620 includes a slot for fitting gasket 1630 thereon. In some embodiments, as shown in FIGS. 15C and 16, lower casing 1160 includes a suitable slot for fitting gasket 1630 on volute casing 1620 for fixing and sealing circulation fan 1210 contained in lower casing 1160.

In some embodiments, lower casing 1160 of dehumidifier 1100 is a continuous and integrated shell. In some embodiments, lower casing 1160 includes a plurality of mounting brackets 1190 for mounting and fixing the entire module of dehumidifier 1100 to the frame of the laundry machine (e.g., as illustrated in FIGS. 11-12). In some embodiments, lower casing 1160 is divided into a plurality of areas for installing various components of dehumidifier 1100, including a roller area 1660, a circulation fan area 1650, a condenser area 1670, and an regeneration installation area 1680 for installing regeneration fan 1220. In some embodiments as discussed with reference to FIG. 15C, circulation fan 1210 includes fan impeller 1640 and an upper casing (e.g., volute casing 1620) for covering fan impeller 1640. Circulation fan 1210 can be held and fixed in circulation fan area 1650. In some embodiments, regeneration fan 1220 can be an integrated fan or an assembled fan installed on the corresponding regeneration installation area 1680 of lower casing 1160. In some embodiments, roller area 1660 is divided into multiple channels for separating moisture absorption area 1240 and moisture removal area 1250 (heating section 1150), and guiding airflow within roller area 1660 by air pressure difference.

Figure 17:
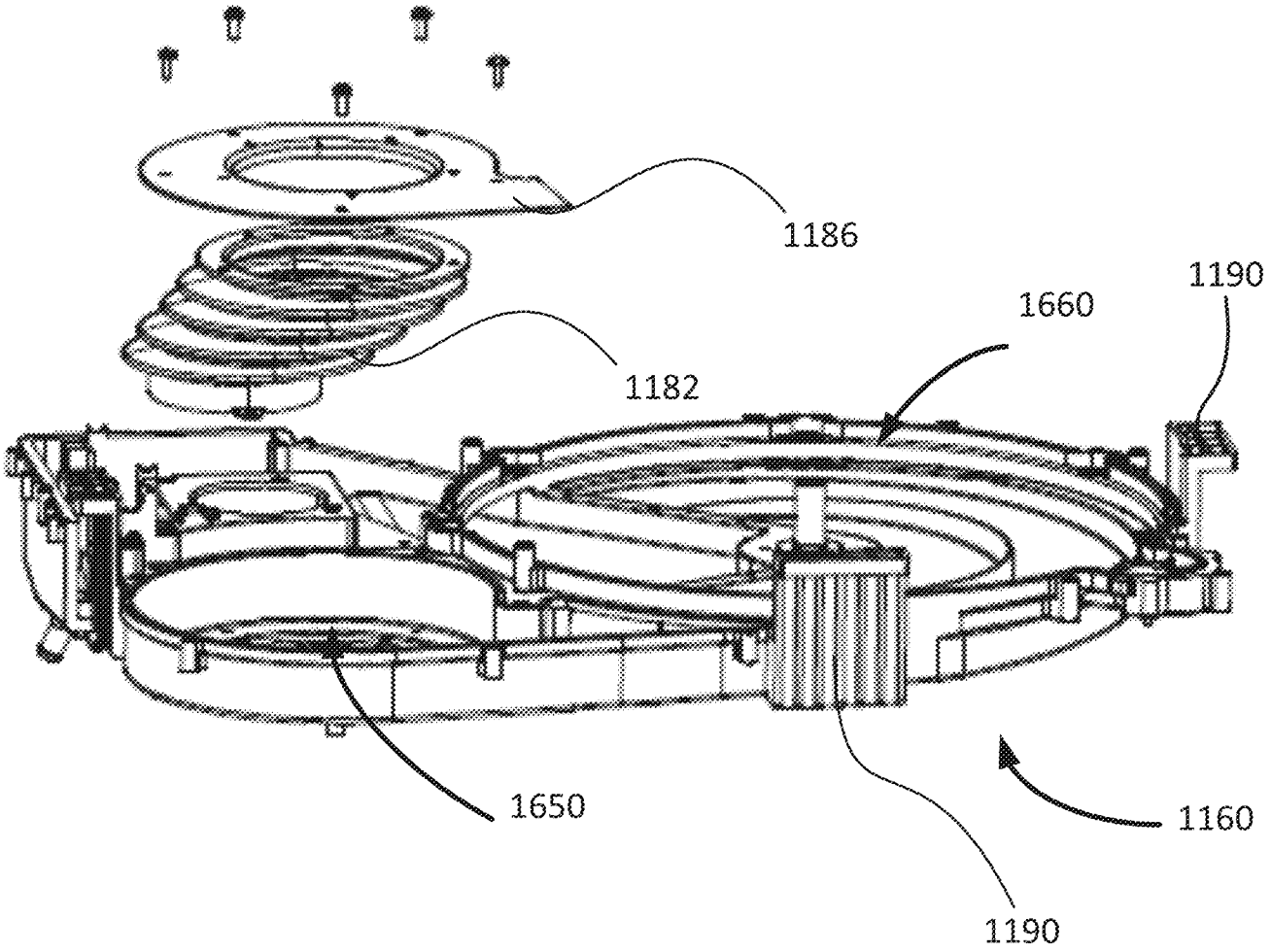
FIG. 17 shows a schematic view of a lower casing of a dehumidifier, in accordance with some embodiments.
Figure 18A:
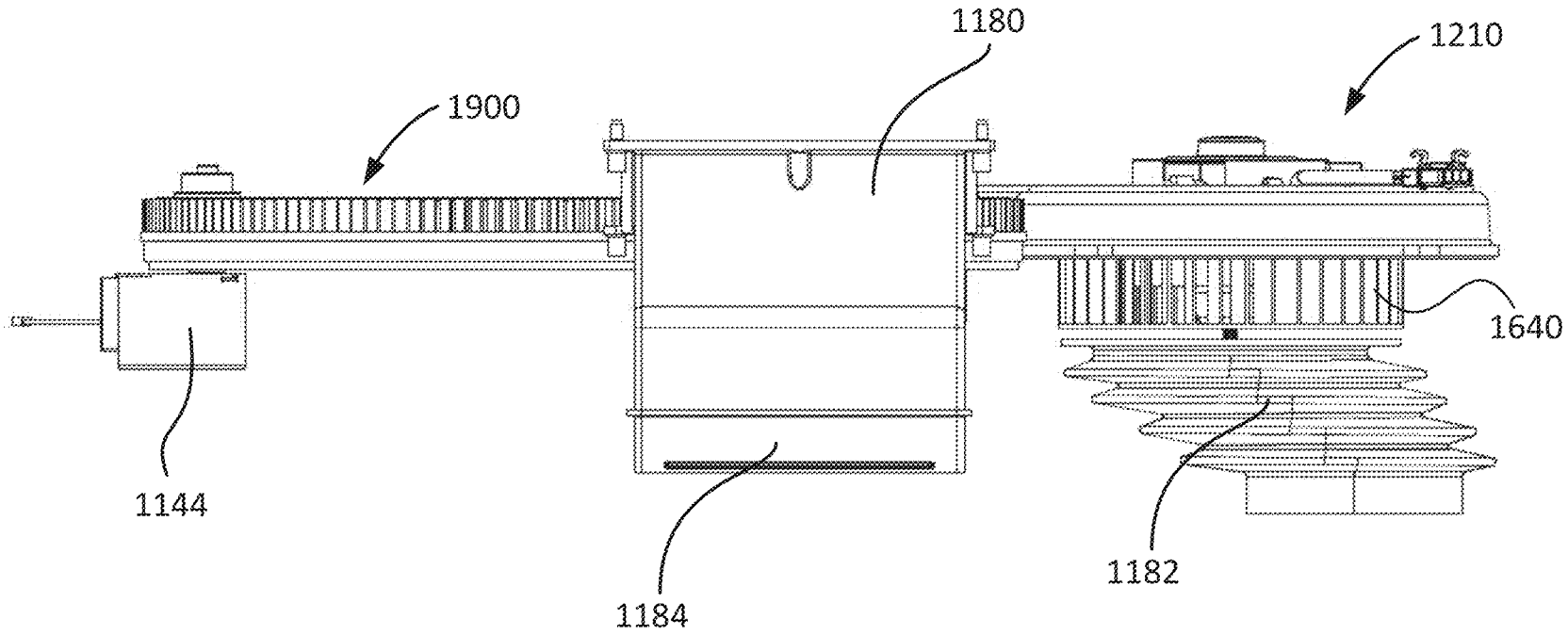
FIG. 18A shows a schematic view of a roller assembly, a circulation fan, and connectors used for air circulation for a dehumidifier, in accordance with some embodiments.

FIG. 17 shows a schematic view of lower casing 1160 of dehumidifier 1100, in accordance with some embodiments. In some embodiments, connector 1182 can be screwed to lower casing 1160 through a plate 1186 in circulation fan area 1650. FIG. 18A shows a schematic view of a roller assembly 1900 (e.g., including roller 1914 and other associated parts as shown in FIG. 19) of roller area 1140, connector 1180 for connecting roller area 1140 on dehumidifier 1100 to rotary drum 1302, circulation fan 1210, and connector 1182 for connecting circulation fan 1210 to rotary drum 1302 for circulating airflow between dehumidifier 1100 and rotary drum 1302 of laundry machine 1300, in accordance with some embodiments. In some embodiments, as shown in FIGS. 12, 15B, 15C, and 18A, volute casing 1620 and motor 1610 of circulation fan 1210 can be screwed to lower casing 1160 from one side, and impeller 1640 can be installed from the opposite side of lower casing 1160. Connector 1182 is also screwed to plate 1186, and further connected to the impeller side of circulation fan 1210 by screwing plate 1186 to lower casing 1160.

Figure 18B:
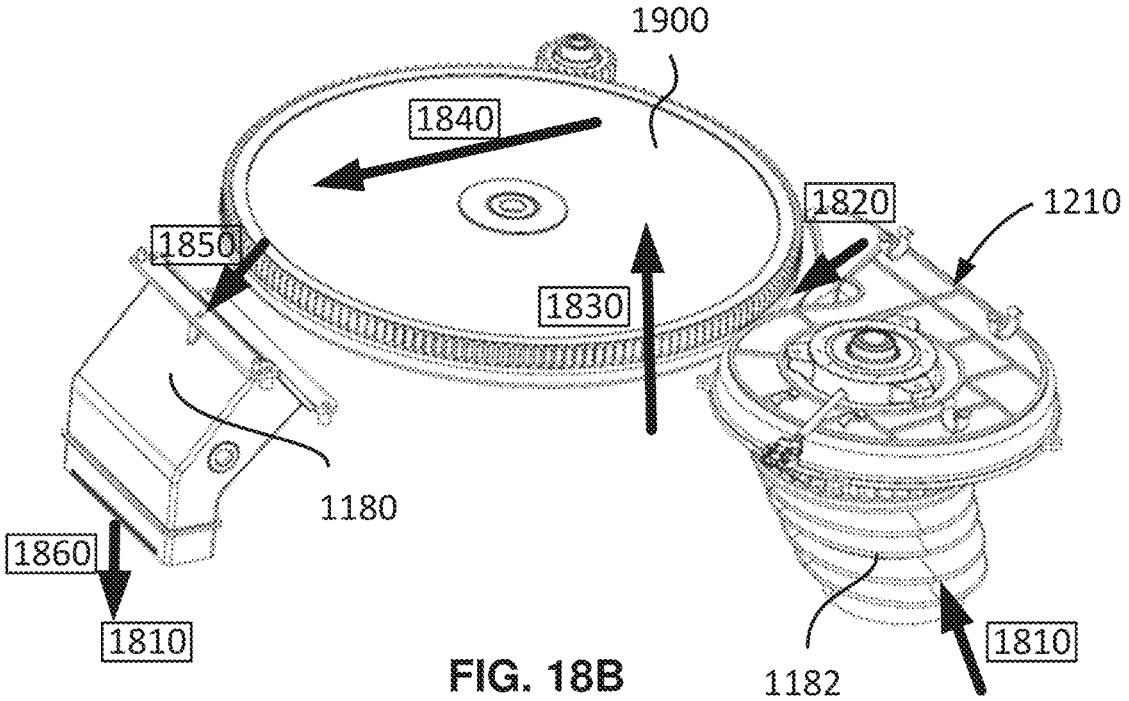
FIG. 18B shows a schematic view illustrating air circulation between a roller assembly, a circulation fan, and connectors, in accordance with some embodiments.

FIG. 18B shows a schematic view illustrating air circulation (indicated by arrows) between roller assembly 1900, connector 1180, circulation fan 1210, and connector 1182, in accordance with some embodiments. In some embodiments, the flexible connector 1182 (e.g., the bellow hose, the conjugated hose) forms the connection between circulation fan 1210 and rotary drum 1302 of laundry machine 1300. As shown by the arrows in FIG. 18B, the airflow (e.g., humid air from wet laundry) enters (1810) connector 1182 from rotary drum 1302 through the air outlet on rotary drum 1302 (e.g., through a filter screen placed at or near the air outlet), and passes through and enter from the air inlet of circulation fan 1210. In some embodiments, the airflow then passes (1820) from the air outlet of circulation fan 1210 to the lower side of roller assembly 1900. In some embodiments, the airflow flows from the lower side of roller assembly 1900, through (1830) roller assembly 1900, to the upper side of roller assembly 1900. In some embodiments, during circulation, moisture is absorbed from the humid air coming from rotary drum 1302. In some embodiments, as the roller rotates, the dried air flows (1840) in the upper space of roller assembly 1900 to reach the area corresponding to connector 1180. In some embodiments, the dried air enters (1850) connector 1180. In some embodiments, the dried air then circulates through connector 1180 and enters (1860) into rotary drum 1302.

Figure 18C:
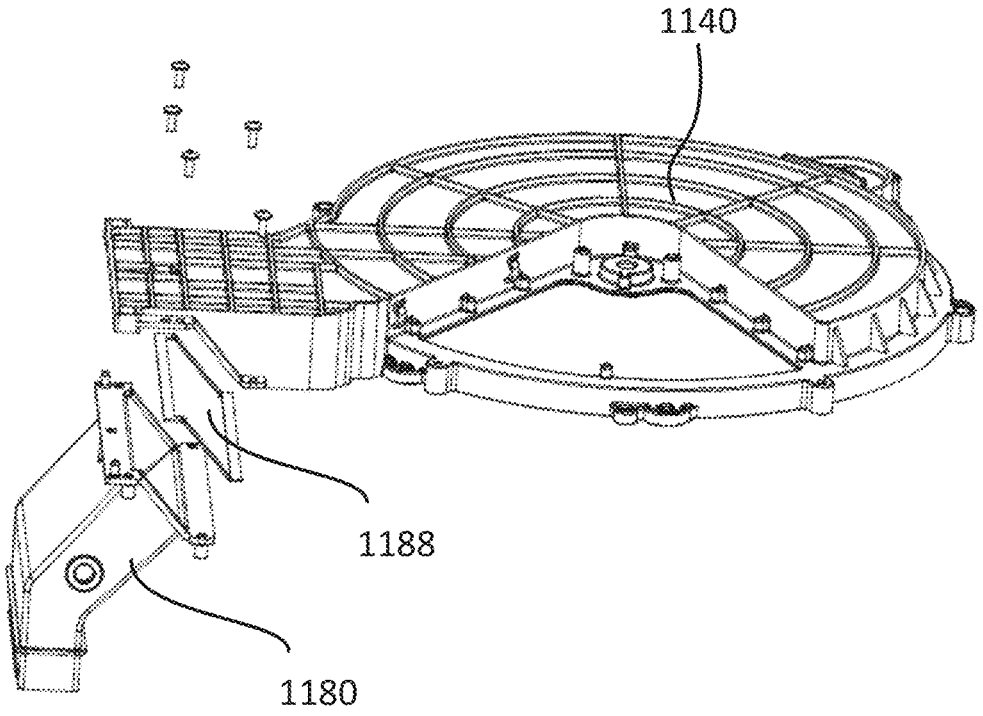
FIG. 18C shows a schematic view illustrating a sealed connection between a connector and a roller area with a gasket, in accordance with some embodiments.

FIG. 18C shows a schematic view illustrating a sealed connection between connector 1180 and roller area 1140 with a gasket 1188, in accordance with some embodiments. In some embodiments, connector 1180 can be attached to an extension on roller area 1140, and gasket 1188 is used for sealing the connection between connector 1180 and roller area 1140 to avoid air leakage during air circulation.

Figure 19A:
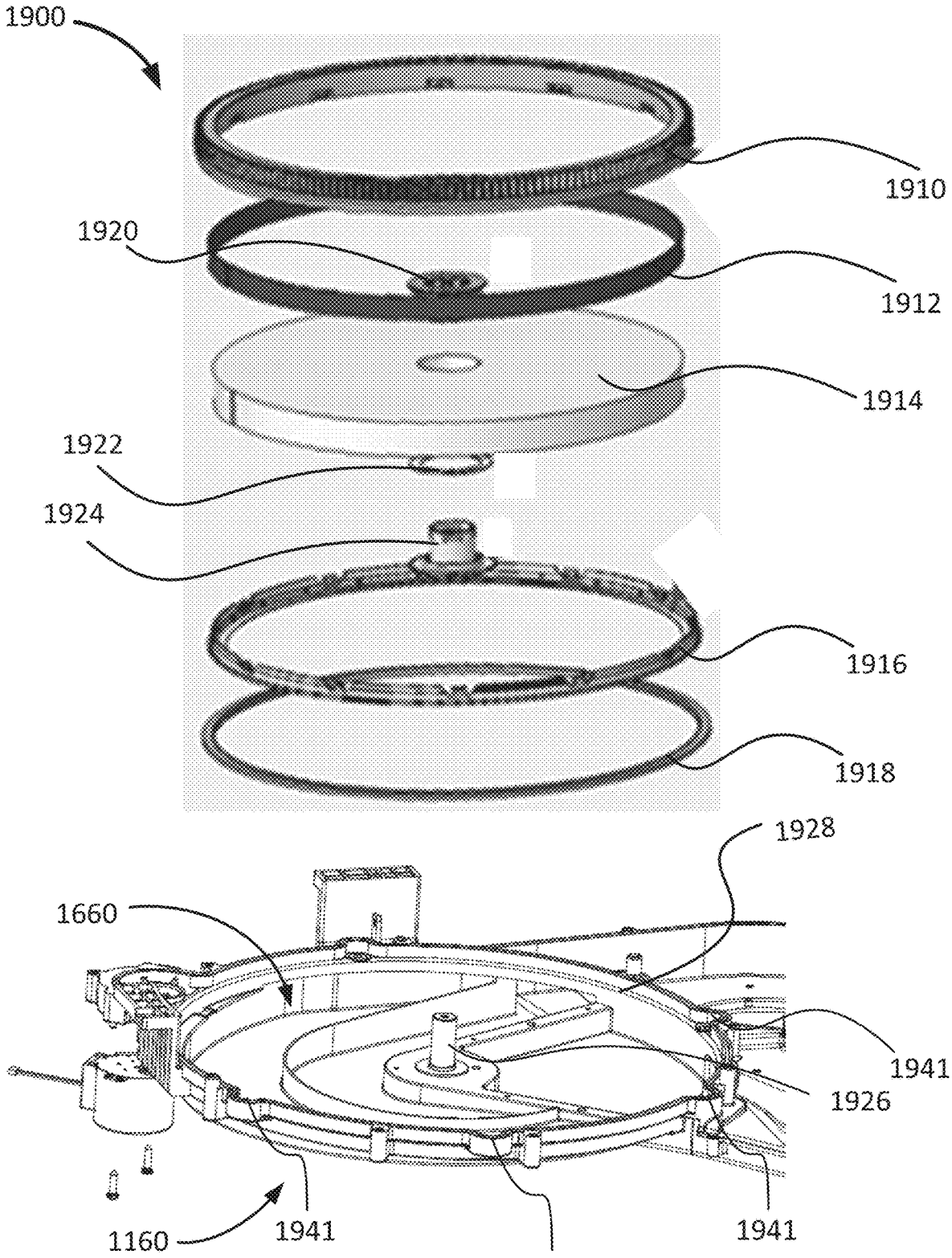
FIG. 19A shows an exploded view of a roller assembly, in accordance with some embodiments.
Figure 19B:
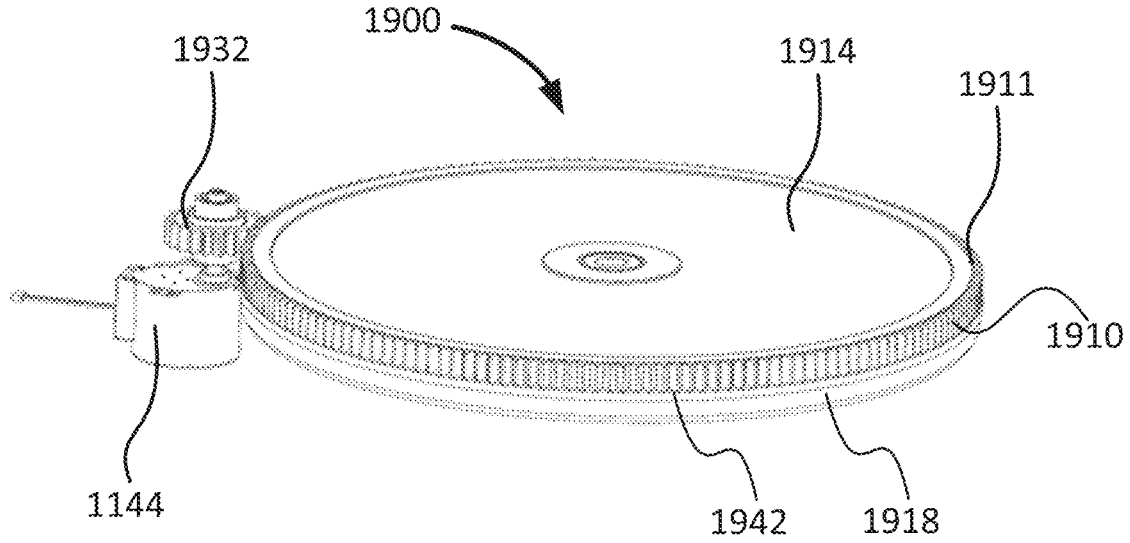
FIG. 19B shows a perspective view of a roller assembly engaged with a gear member powered by a driving motor, in accordance with some embodiments.
Figure 19C:
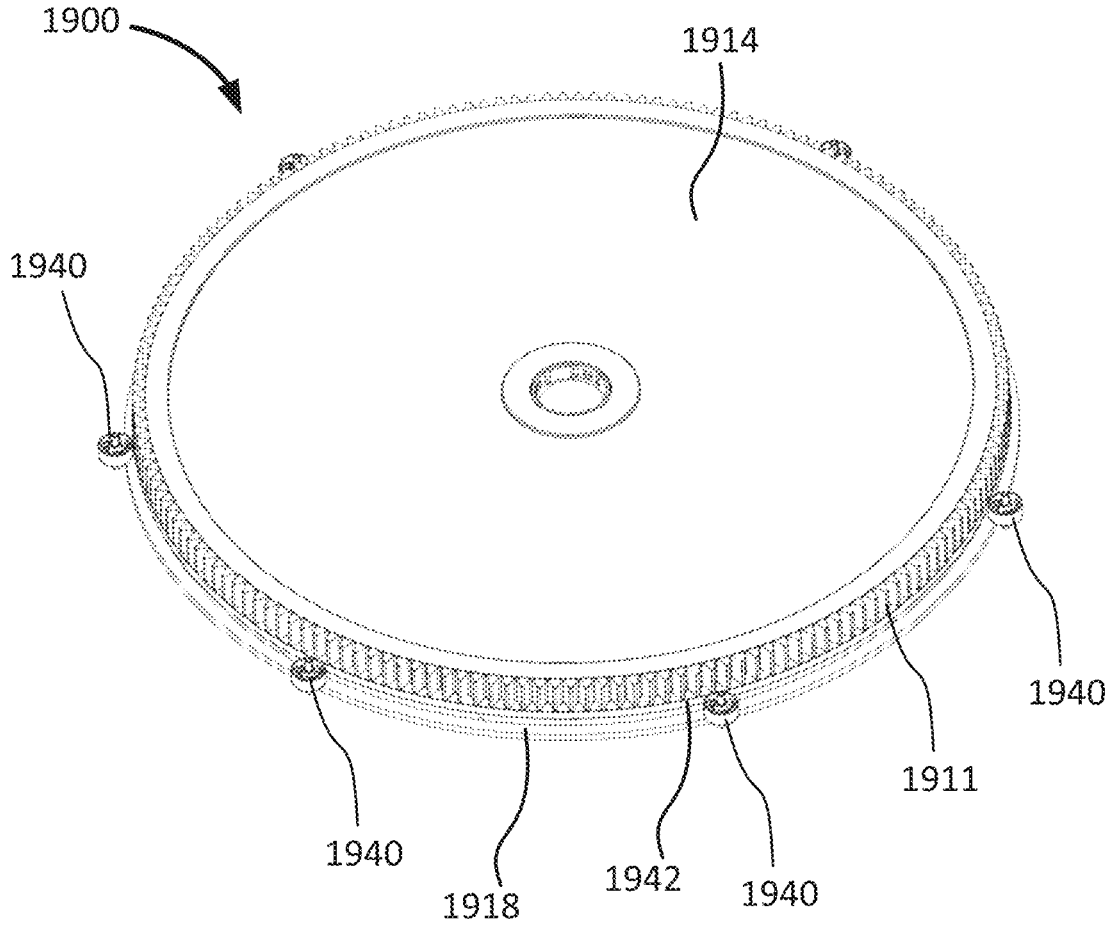
FIG. 19C shows a perspective view of a roller assembly coupled with a plurality of auxiliary rollers, in accordance with some embodiments.
Figure 19D:
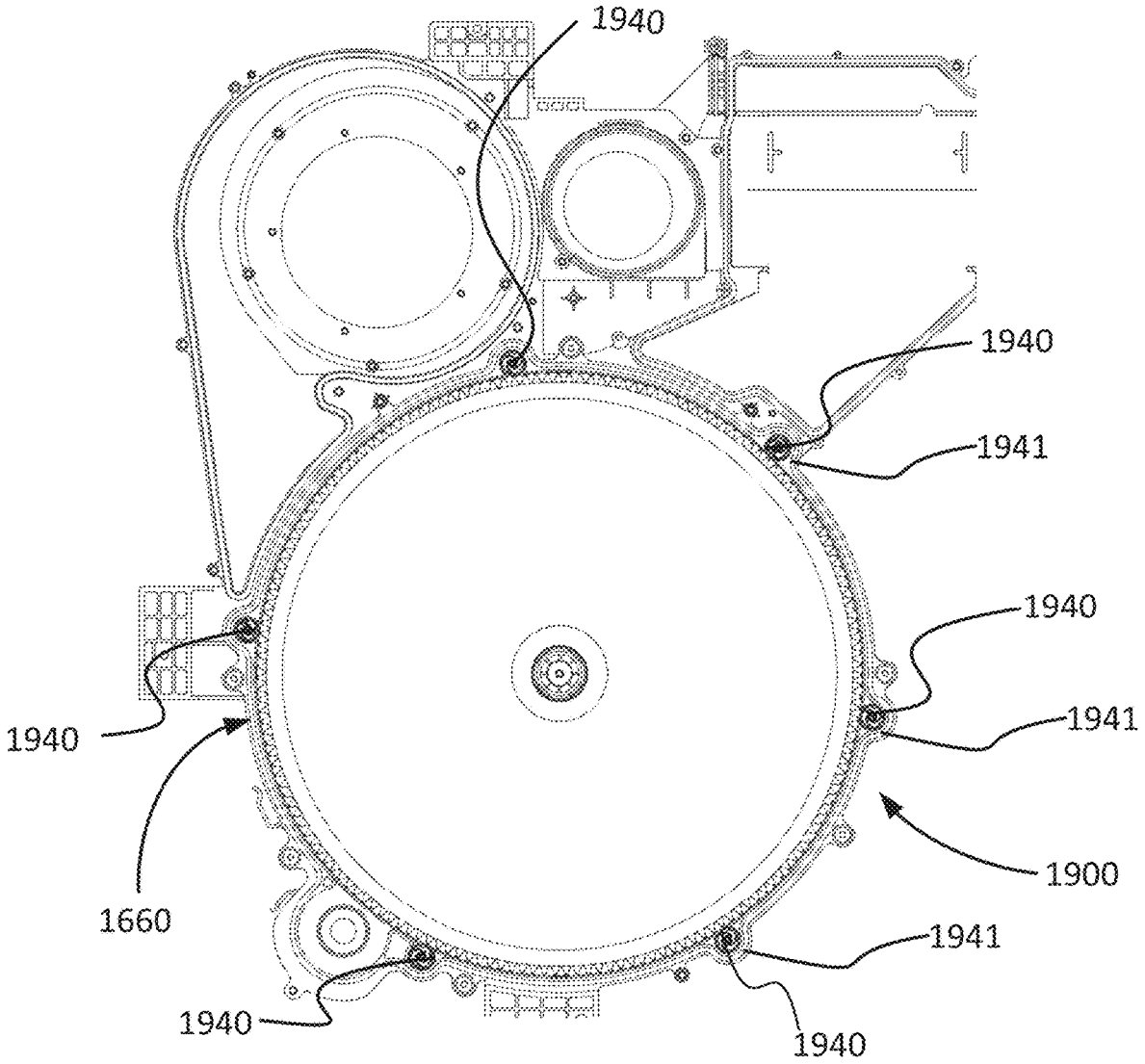
FIG. 19D shows a top view of a roller assembly coupled with a plurality of auxiliary rollers arranged on a lower casing, in accordance with some embodiments.
Figure 19E:
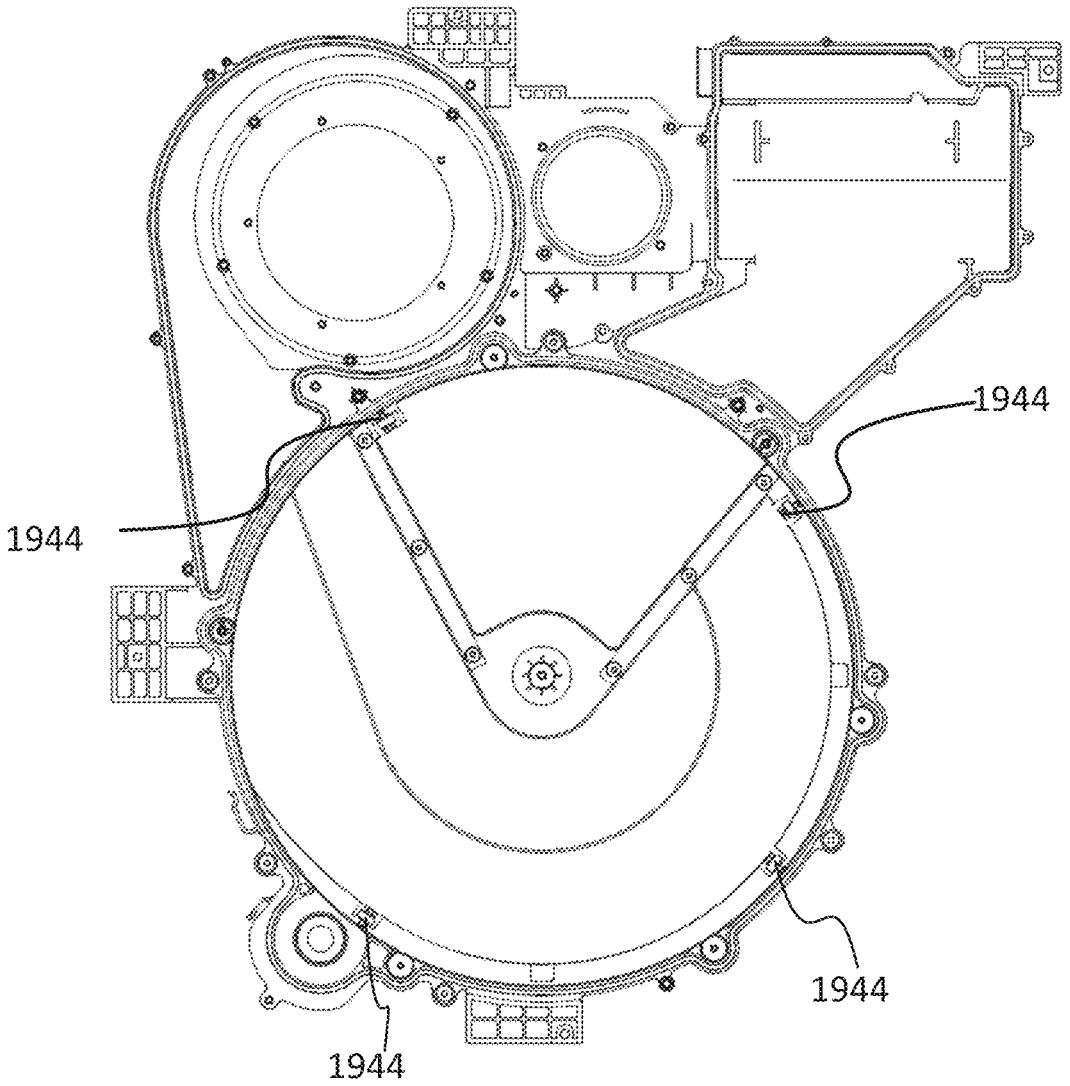
FIG. 19E shows a top view of a plurality of rollers arranged on a lower casing, in accordance with some embodiments.

FIG. 19A shows an exploded view of roller assembly 1900, in accordance with some embodiments. FIG. 19B shows a perspective view of roller assembly 1900 engaged with a gear member 1932 powered by driving motor 1144, in accordance with some embodiments. FIG. 19C shows a perspective view of roller assembly 1900 coupled with a plurality of auxiliary rollers 1940, in accordance with some embodiments. FIG. 19D shows a top view of roller assembly 1900 coupled with the plurality of auxiliary rollers 1940 arranged on lower casing 1160, in accordance with some embodiments. FIG. 19E shows a top view of a plurality of vertical rollers 1944 arranged on lower casing 1160, in accordance with some embodiments.

In some embodiments, roller assembly 1900 includes a peripheral upper casing 1910, a peripheral damper 1912, a roller 1914, a peripheral lower casing 1916, a sealing ring 1918, an upper center member 1920, a center damping member 1922, and a lower center member 1924. In some embodiments, roller 1914 is made of a molecular sieve, or at least a center area of roller 1914 includes a molecular sieve (e.g., a moisture absorption disk) for absorbing moisture in the humid air. In some embodiments, peripheral upper casing 1910 is coupled to peripheral lower casing 1916 using a suitable method, such as snapping, clamping, screwing, or gluing etc., and roller 1914 is contained and fixed there between to form roller assembly 1900.

In some embodiments, peripheral damper 1912 includes any suitable damping material, such as a foam ring, and is attached to the outer peripheral of roller 1914, to form a buffer between the outer ring of roller 1914 and the inner surfaces of peripheral upper casing 1910 and peripheral lower casing 1916 to avoid direct friction or collision between roller 1914 (e.g., the molecular sieve) and peripheral upper casing 1910 and peripheral lower casing 1916 during rotation to cause damage.

In some embodiments as shown in FIG. 19B, peripheral upper casing 1910 includes a plurality of driving teeth 1911 distributed on the outer circumference. When driving motor 1144 drives gear member 1932 to rotate, the teeth of gear 1932 engages the driving teeth 1911 to drive roller assembly 1900 including roller 1914 to rotate.

In some embodiments, as shown in FIGS. 19B-19C, sealing ring 1918 is attached to the outer circumference of the joint of peripheral upper casing 1910 and peripheral lower casing 1916 when they are coupled to form roller assembly 1900. In some embodiments, sealing ring 1918 is formed on lower casing 1160 (e.g., as part of lower casing 1160, attached to or coupled to lower casing 1160). In some embodiments as illustrated in FIG. 19C, driving teeth 1911, an auxiliary outer ring 1942, and sealing ring 1918 are arranged on the outer circumference of roller 1914 along a thickness direction from the center to the outer ring of roller 1914. In some embodiments, driving teeth 1911, outer ring 1942, and sealing ring 1918, are three circular shaped structures parallel to each other. In some embodiments, an outer surface of outer ring 1942 may be coupled to, in contact with, cooperate with, or adjacent to an inner surface of sealing ring 1918. In some embodiments, an inner surface of outer ring 1942 may be coupled to, in contact with, cooperate with, or adjacent to an outer surface of driving teeth 1911. In some embodiments, sealing ring 1918 is configured to be in contact and sealed with the inner wall of lower casing 1916. In some embodiments, driving teeth 1911, outer ring 1942, and sealing ring 1918 can be spaced apart or overlapped in the axial distribution. In addition, outer ring 1942 can be an independent part or an integral part with lower casing 1160 or sealing ring 1918, with a relatively flat shape and a suitable outer diameter, so as to be matched with roller 1914.

In some embodiments, sealing ring 1918 is formed of a suitable sealing material, such as foam, softer rubber, wool felt, etc. and with small resistance during rotation. In some embodiments, sealing ring 1918 seals the joint of peripheral upper casing 1910 and peripheral lower casing 1916. In some embodiments, when roller assembly 1900 rotates, sealing ring 1918 also forms a sealing and a buffer between roller assembly 1900 and a sealing ring 1928 on lower casing 1160 during rotation, so that most of the moisture air coming from rotary drum 1302 of laundry machine 1300 can pass through roller 1914 to be absorbed by the molecular sieve. The rolling seal can prevent air leak through the gap between the outer circumference of roller 1914 and the inner circumference of roller area 1660 on lower casing 1160. In some embodiments, sealing ring 1918 is used for sealing a gap between an inner surface of the lower casing 1160 and peripheral upper casing 1910 and/or peripheral lower casing 1916.

In some embodiments, upper center member 1920 and lower center member 1924 pass through the center hole of roller 1914, and can be coupled together by a suitable method such as snapping, bolting, gluing, etc., to form a rotational connection with a shaft 1926 extending from roller area 1660 on lower casing 1160. In some embodiments, central damping member 1922 can be provided between lower center member 1924 and roller 1914.

In some embodiments as shown in FIG. 19D, the plurality of auxiliary rollers 1940 are contained in respective housing protrusions 1941 on roller area 1660 of lower casing 1160, e.g., as shown in FIG. 19A. In some embodiments, housing protrusions 1941 are part of lower casing 1160 and protrude from the outer circumference at locations for holding auxiliary rollers 1940, respectively. In some embodiments, when roller assembly 1900 rotates, the auxiliary rollers 1940 can eliminate the sliding friction between roller 1914 and the inner ring of roller area 1660 of lower casing 1160 to avoid damage to roller 1914. In some embodiments, the auxiliary rollers 1940 can limit the rotational motion of roller 1914 to avoid damage brought by collision impact of roller 1914. For example, auxiliary rollers 1940 can function as buffer to reduce collision impact between roller 1914 with its outer ring and roller area 1660 of lower casing 1160 when there is irregular rotation of roller assembly 1900, e.g., caused by elastic deformation of outer casing of roller 1914 due to impact from irregular or inhomogeneous rotation. In some embodiments, the number of auxiliary rollers 1940 can be 4, 6, 8, or any other suitable number.

In some embodiments, as shown in FIGS. 19B-19D, auxiliary outer ring 1942 is in contact with at least one of the plurality of auxiliary rollers 1940 to facilitate the normal rotation of roller 1914 and reduce friction. For example, when the rotation of roller assembly 1900 has an offset relative to the rotation axis, auxiliary outer ring 1942 can press against one or more corresponding auxiliary rollers 1940 distributed on roller area 1660 of lower casing 1160 to tolerate the offset motion (e.g., an auxiliary roller 1940 can have elastic change to its diameter or the distribution of auxiliary rollers 1940 can tolerate and absorb the impact) to avoid damage or deformation to roller 1914. Further, auxiliary outer ring 1942 can also alleviate the pressure and friction between auxiliary outer ring 1942 and auxiliary rollers 1940 during rotation of roller assembly 1900.

In some embodiments as shown in FIG. 19E, roller area 1660 of lower casing 1160 further provides a plurality of vertical rollers 1944 (e.g., with fixed diameter) distributed on inner bottom surface of lower casing 1160, to form a support for peripheral lower casing 1916, so as to reduce or eliminate friction between roller assembly 1900 and lower casing 1160 during rotation. In some embodiments, as shown in FIG. 19E, vertical rollers 1944 are distributed perpendicular relative to auxiliary rollers 1940 on lower casing 1160, e.g., rotation axes of vertical rollers 1944 are perpendicular to rotation axes of auxiliary rollers 1940.

In some embodiments, the driving transmission is mainly through coordinated motion between gear teeth, pulleys, belts, etc. As shown in FIG. 19B, rotation of roller assembly 1900 can be driven by driving teeth 1911 distributed on the outer circumference of roller assembly 1900. In some embodiments, rotation of roller assembly 1900 can also be driven by upper center member 1920 and a lower center member 1924, e.g., which may be driven by rotation of shaft 1926 on lower casing 1160 (e.g., as shown in FIG. 19A).

Figure 20A:
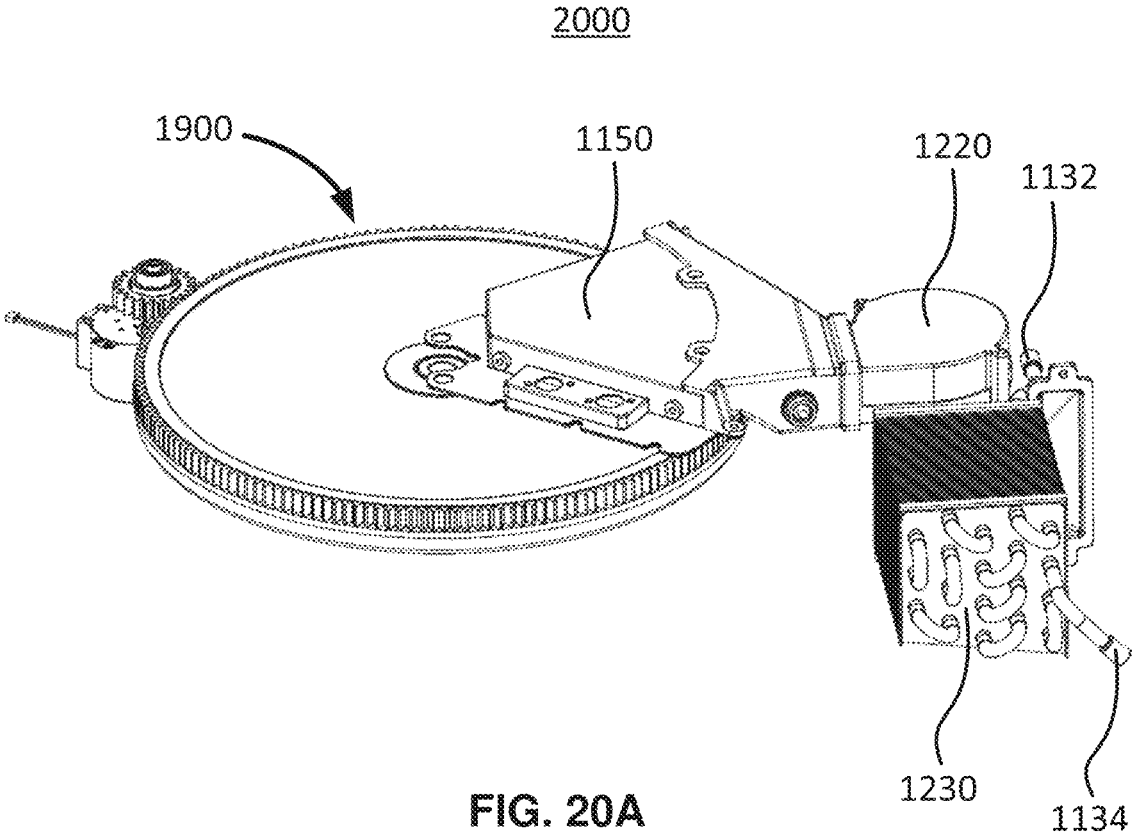
FIG. 20A shows a schematic view illustrating an air regeneration system, in accordance with some embodiments.
Figure 20B:
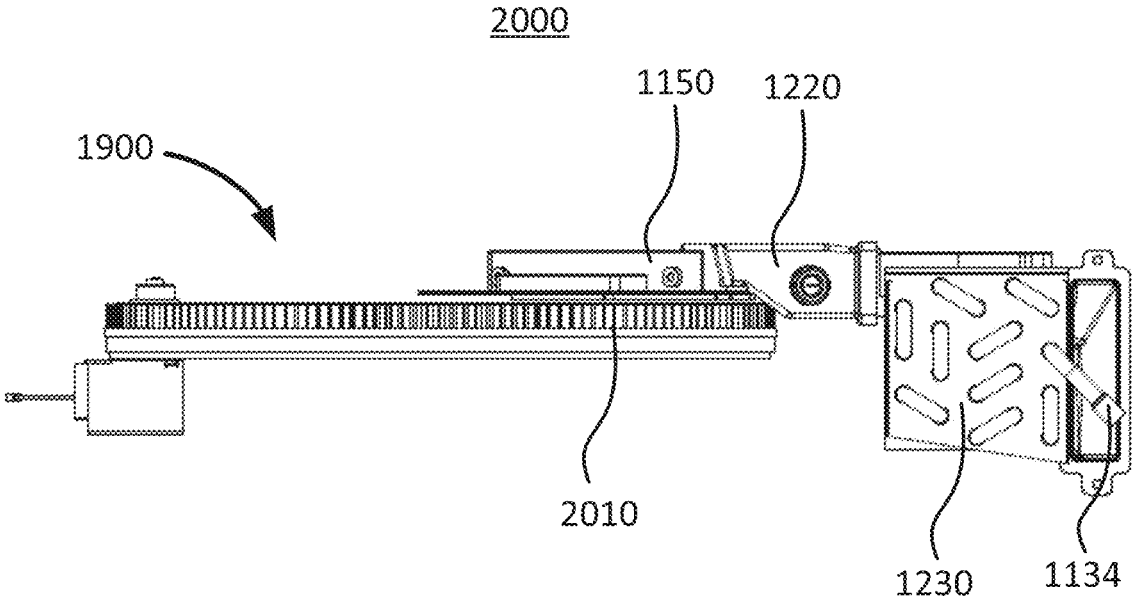
FIG. 20B shows a side view illustrating an air regeneration system, in accordance with some embodiments.

FIG. 20A shows a schematic view illustrating an air regeneration system 2000, in accordance with some embodiments. FIG. 20B shows a side view illustrating air regeneration system 2000, in accordance with some embodiments. In some embodiments, the air regeneration system includes a roller regeneration area 2010 (e.g., corresponding to moisture removal area 1250 of roller assembly 1900 or a portion of roller 1914 corresponding to heating section 1150), condenser 1230 (in condensing section 1130), regeneration fan 1220 (in regeneration section 1120), and heating elements in heating section 1150. In some embodiments, the circulation of regeneration airflow is in a closed loop. For example, the regeneration airflow flows sequentially through the outlet of regeneration fan 1220, the heating elements in heating section 1150, the upper side of the roller regeneration area 2010, passing through the roller regeneration area 2010 to the lower side of the roller regeneration area 2010, condenser 1230, and finally back to the inlet of regeneration fan 1220. In some embodiments, the circulation of regeneration airflow is in an open loop. For example, the inlet of regeneration fan 1220 is connected to the atmosphere, and the air outlet of condenser 1230 is also connected to the atmosphere. The open-looped airflow flows sequentially from the atmosphere, inlet of regeneration fan 1220, outlet of regeneration fan 1220, heating elements of heating section 1150, roller assembly 1900 (e.g., a portion of roller 1914 corresponding to moisture removal area 1250 or moisture removal area), condenser 1230, and to atmosphere. In some embodiments, condenser 1230 condenses the high-temperature and moisture-containing airflow obtained from the moisture removal process performed by the roller assembly 1900, to obtain a low-temperature and dry airflow. The condensed water can be discharged from condenser 1230 through water outlet 1134 of condenser 1230.

Figure 21A:
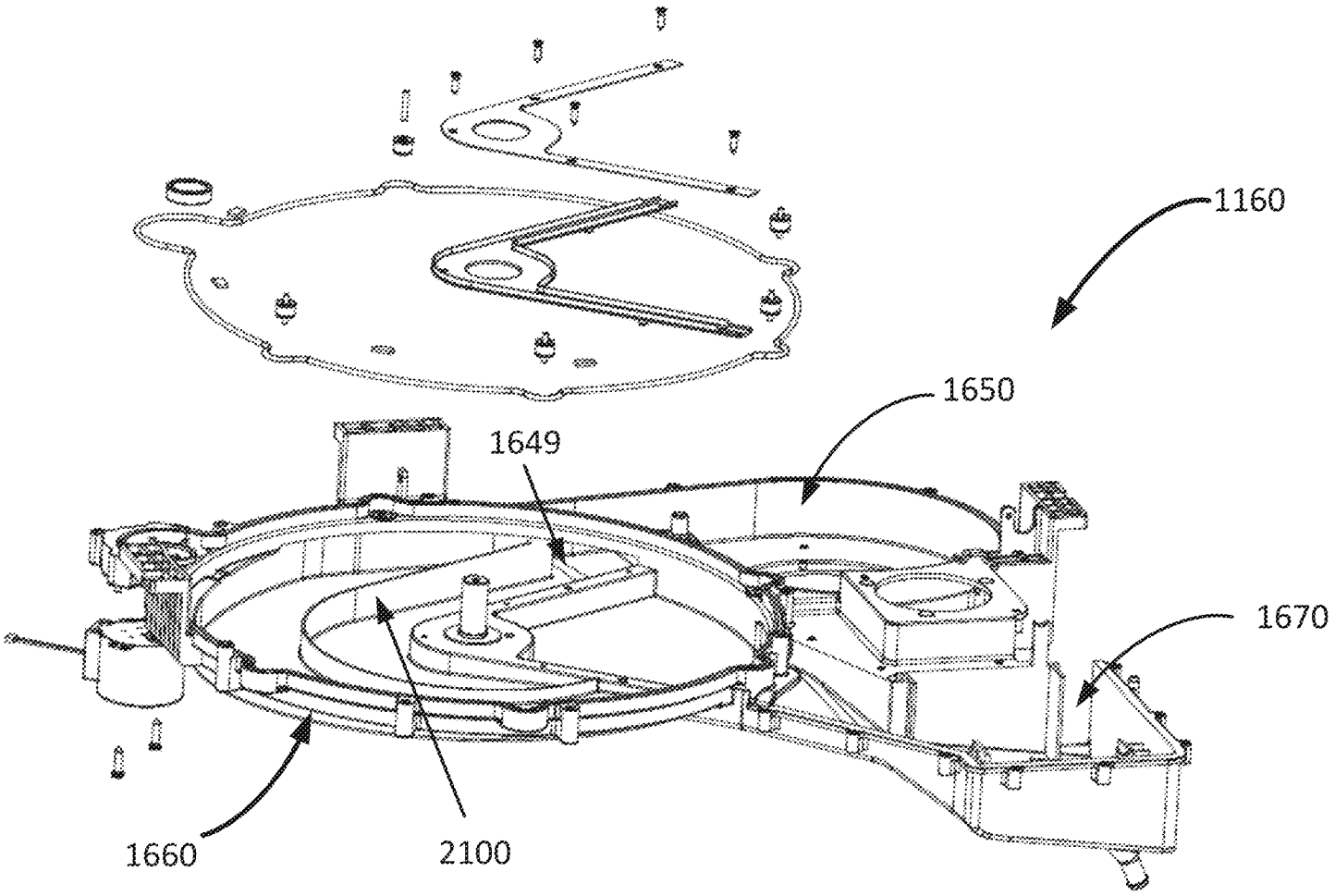
FIG. 21A shows an exploded view of a lower casing for a dehumidifier, in accordance with some embodiments.
Figure 21B:
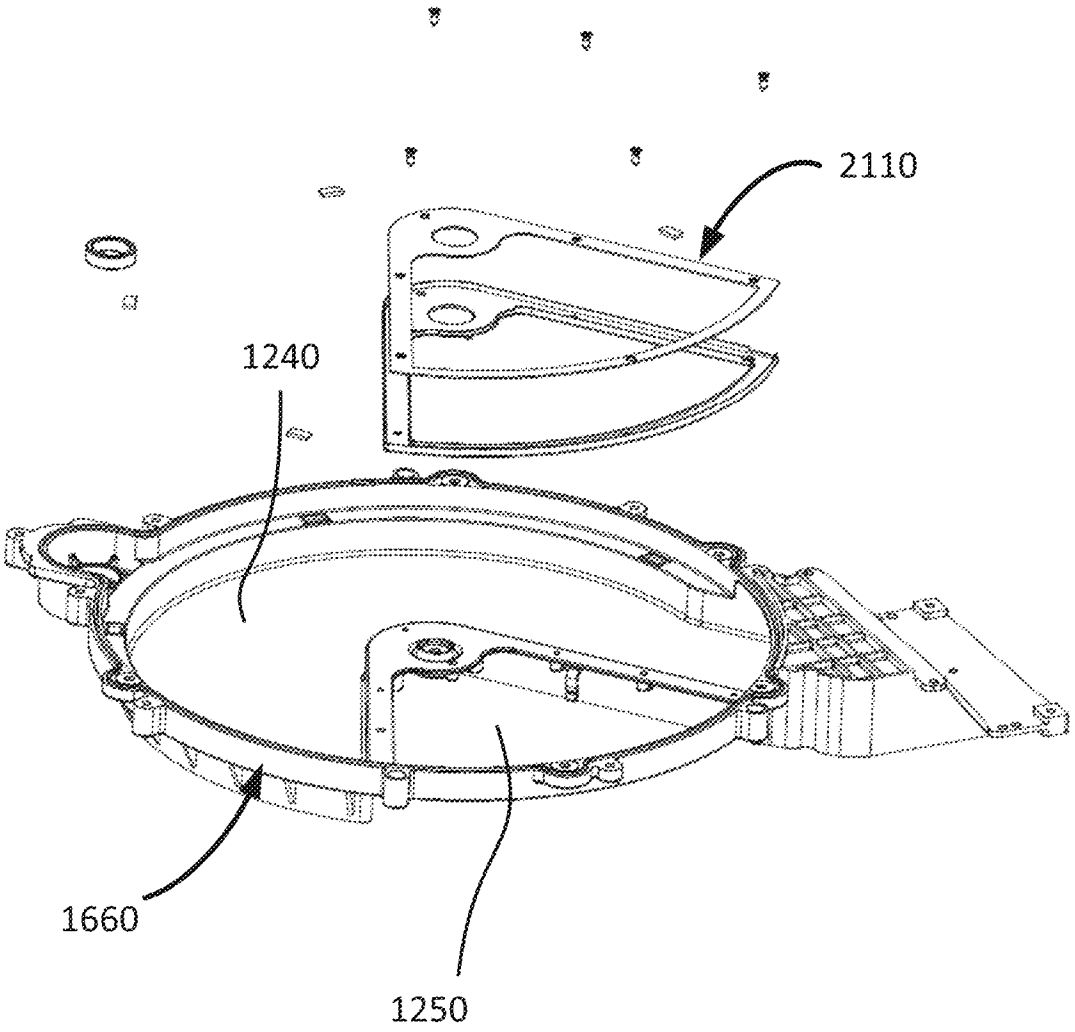
FIG. 21B shows an exploded view of a roller area on a lower casing, in accordance with some embodiments.

FIG. 21A shows an exploded view of lower casing 1160 for dehumidifier 1100, in accordance with some embodiments. FIG. 21B shows an exploded view of roller area 1660 on lower casing 1160, in accordance with some embodiments. In some embodiments, lower casing 1160 of dehumidifier 1100 includes roller area 1660 for containing roller assembly 1900, a circulation area 1650 for holding circulation fan 1210, a condensing area 1670 for holding condenser 1230. In some embodiments, lower casing 1160 is a one-piece and integrated component that is mounted on the laundry machine. As discussed herein, the connections between the air outlet and air inlet of the rotary drum and roller section 1140 may use flexible, extendable, and bendable hose, such as a bellow hose, or conjugated hose, to avoid the vibration impact being transmitted to the roller section 1140. In some embodiments, lower casing 1160 can also include separate sections for containing respective components of dehumidifier 1100. In some embodiments, roller area 1660 can be fixedly attached to the frame of the laundry machine, while other parts are fixedly and rigidly connected to the outer drum of the drum. Since other small parts may be less affected by vibration impact than roller assembly does, such arrangement can avoid damage to the roller while reduce the cost of using the integrated one-piece lower casing. In some embodiments, the connection between the air inlet of the moisture absorption passage on the roller (e.g., the connection with the air inlet of the circulating fan) and the air outlet (such as the position connected to the drum) can be made into a flexible connection (such as a corrugated hose). In some embodiments, there is also a flexible connection between the air outlet of the regeneration fan and the air inlet of the roller regeneration passage. Another flexible connection may be provided between the air outlet of the roller regeneration passage and the air inlet of the condenser. In some embodiments, the pipelines between the roller housing and all components that are involved vibrations are transitionally connected with flexible pipes to isolate vibrations.

In some embodiments, roller area 1660 includes partitioning or dividing members 2110, such as brackets, for dividing roller area 1660 of lower casing 1160 into moisture absorption area 1240 (e.g., the dehumidification area) and moisture removal area 1250 (e.g., the regeneration area). In some embodiments, upper casings, such as a separate circulating fan upper casing (e.g., volute casing 1620), or condenser upper casing are also provided.

In some embodiments, roller area 1660 of lower casing 1160 includes a divider 2100 for separating the airflow circulated within roller assembly 1900. In some embodiments, an air outlet of circulation fan 1210 is coupled to an air inlet 1649 of roller section 1140 located on roller area 1660 of lower casing 1160 for forming airflow communication between circulation section 1110 and roller section 1140. Roller section 1140 may include an air outlet 1647 at a casing (e.g., roller upper casing 1170 of FIG. 23B) of roller assembly 1900 as shown in FIG. 18C. In some embodiments, the circulation air driven by circulation fan 1210 enters, via the inlet of roller section 1140, the space between roller assembly 1900 and roller area 1660 from circulation fan 1210, and is divided into two parts by divider 2100 for more evenly distribution within roller assembly 1900 to increase efficiency. As such, the airflow can avoid accumulating on an outer ring region of roller assembly 1900 driven by the centrifugal force from rotation of the roller, so as to improve the moisture absorption and removal efficiency by even airflow distribution.

Figure 22:
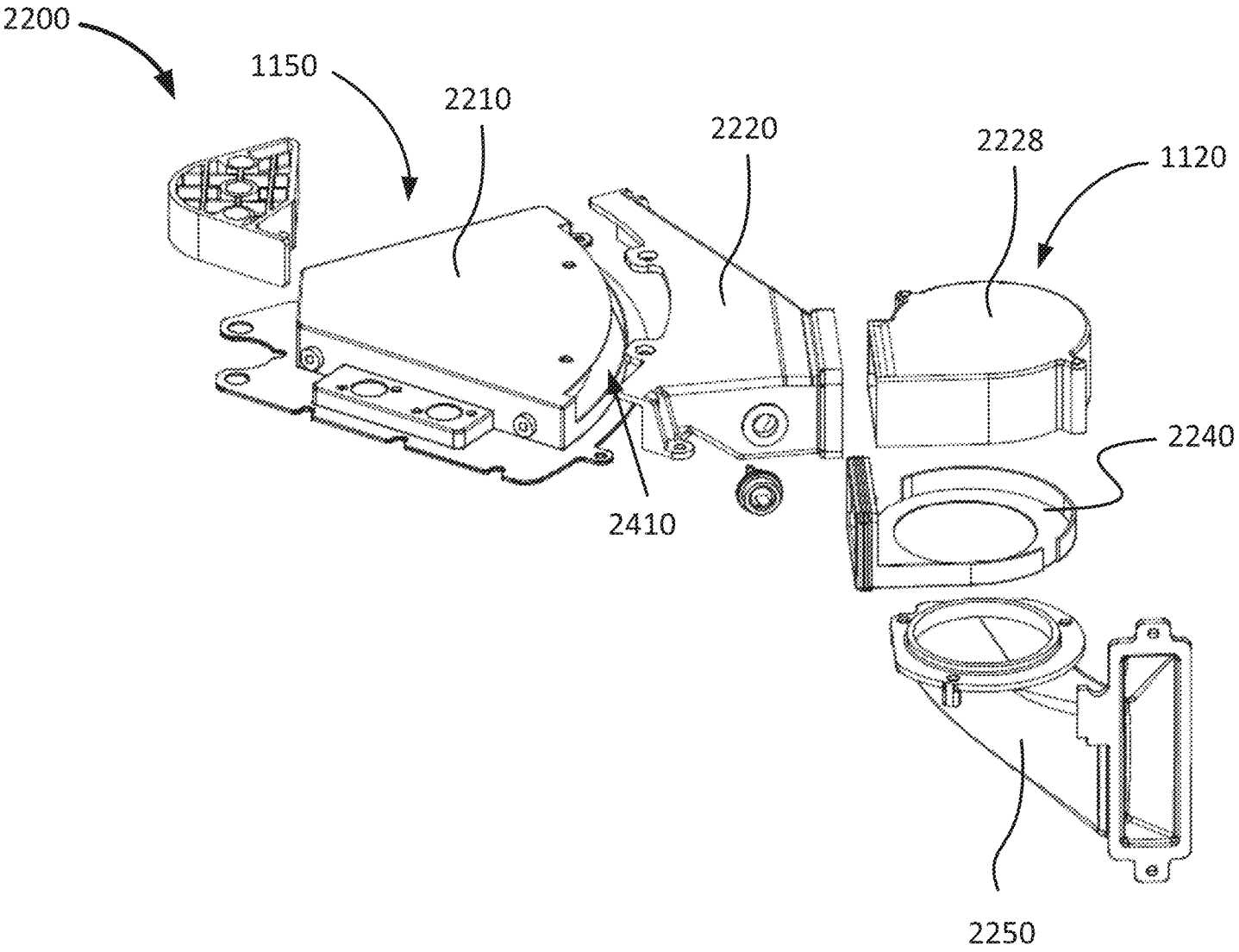
FIG. 22 shows an exploded view of a system including a heating section and a regeneration section of a dehumidifier, in accordance with some embodiments.

FIG. 22 shows an exploded view of a system 2200 including heating section 1150 and regeneration section 1120 of dehumidifier 1100, in accordance with some embodiments. In some embodiments, heating section 1150 is connected to regeneration section 1120 via a heating section upper casing 2210, a connector 2220, a regeneration fan upper casing 2228, a regeneration fan lower casing 2240, and another connector 2250 when coupled with each other.

FIG. 23A shows an exploded view of a system 2300 including roller assembly 1900 sandwiched between a roller upper casing 1170 and dehumidifier lower casing 1160, in accordance with some embodiments. In some embodiments, roller assembly 1900 can be fixed between roller upper casing 1170 and roller lower casing 1660 using a suitable method, such as screwing, snapping, gluing, etc., to form roller section 1140. In some embodiments, upper sealing members 2310 are attached to roller upper casing 1170, e.g., via screws, snaps, or glues, etc. In some embodiments, lower sealing members 2320 are attached to partitioning members 2340 on roller lower casing 1660 for forming the airflow regeneration area (e.g., moisture removal area 1250), e.g., via screws, snaps, or glues, etc. In some embodiments, system 2300 can separate moisture absorption area 1240 from moisture removal area 1250. For example, moisture absorption area 1240 and moisture removal area 1250 can be partitioned by partitioning members 2340 in combination with protrusions from upper casing 1170. In some embodiments, sealing members 2110, including upper sealing members 2310 and lower sealing members 2320, can provide effective sealing to respective areas, so as to prevent the airflow in moisture absorption area 1240 from passing through dividing members 2110 to flow into moisture removal area 1250, as well as preventing the airflow from flowing from moisture removal area 1250 to moisture absorption area 1240 through dividing member 2110. For example, soft sealant can be applied between roller assembly 1900 and roller upper casing 1170 and roller lower casing 1660. In some embodiments, sealing members 2110 can use soft sealant, rubber, silicon, or other suitable materials. In some embodiments, the connection between sealing members 2110 and roller upper casing 1170 and roller lower casing 1660 can be fixed by metal pressing pieces and screws.

Figure 23B:
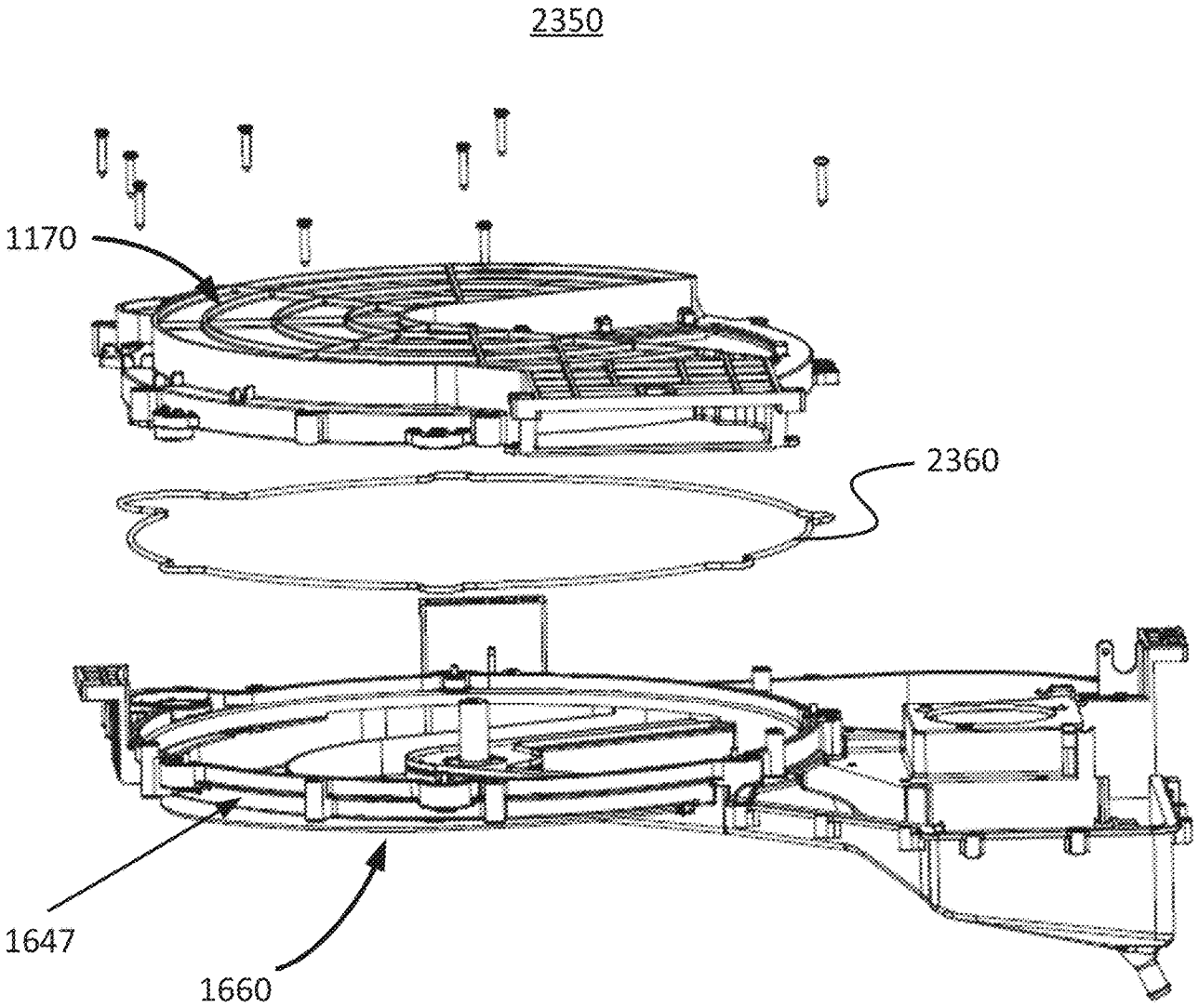
FIG. 23B shows an exploded view of a system including a roller upper casing and a roller lower casing, in accordance with some embodiments.

FIG. 23B shows an exploded view of a system 2350 including roller upper casing 1170 and roller lower casing 1660, in accordance with some embodiments. In some embodiments, roller upper casing 1170 and roller lower casing 1660 can be fastened together, e.g., via screws or bolts, and further sealed via a sealing ring 2360, to ensure sealing of roller section 1140. In some embodiments, sealing ring 2360 can be a rubber gasket, a silicone gasket, or any other suitable gasket etc. In some embodiments, roller upper casing 1170 and roller lower casing 1660 can respectively include mounting grooves for fitting sealing ring 2360 in, when roller upper casing 1170 and roller lower casing 1660 are fastened by bolts after snapping the two together.

Figure 24A:
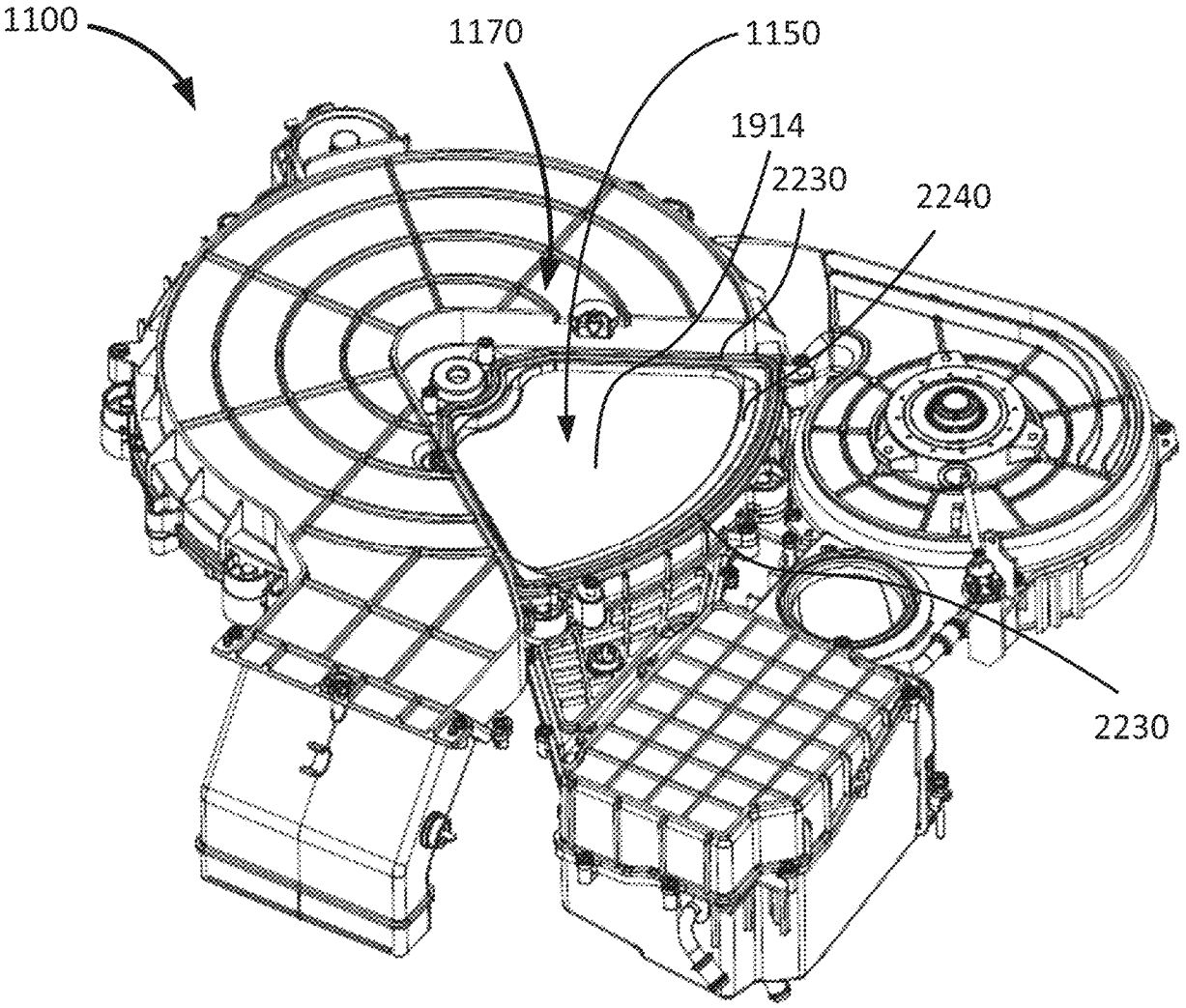
FIG. 24A shows a perspective view of a dehumidifier including a heating section, in accordance with some embodiments.

FIG. 24A shows a perspective view of dehumidifier 1100 including heating section 1150, in accordance with some embodiments. In some embodiments, heating elements of heating section 1150 are arranged to be covered by heating area upper casing 2210 (of FIG. 22). In some embodiments, a sealant 2230 and a heat insulator 2240 are arranged to surround heating section 1150. In some embodiments, sealant 2230 includes a foam, a silica gel, or a soft glue. In some embodiments, heat insulator 2240 is made of heat insulating material, or a suitable alloy, arranged between heating elements of heating section 1150 and heating area upper casing 2210.

In some embodiments, heat insulator 2240 is disposed on sealant 2230 (e.g., made of foam, silica gel, or soft glue). For example, sealant 2230 is in direct contact with heating area upper casing 2210 and the heating section 1150. Heat insulator 2240 in combination with sealant 2230 can separate moisture absorption area 1240 and moisture removal area 1250 (e.g., regeneration area), and allow the regeneration air flow to smoothly pass through roller 1914. In some embodiments, sealant 2230 is installed to have a distance between 0.2 mm and 2 mm from roller 1914, such as 0.8 mm, so that while having a certain sealing effect, during the rotation of roller 1914, roller 1914 does not directly contact sealant 2230 to increase the rotational resistance. In some embodiments, heat insulator 2240 can form a heat transmission buffer so that heating section 1150 is not in direct contact with the plastic roller upper casing 1170, which can be deformed or burned by the heat for a long time.

Figure 24B:
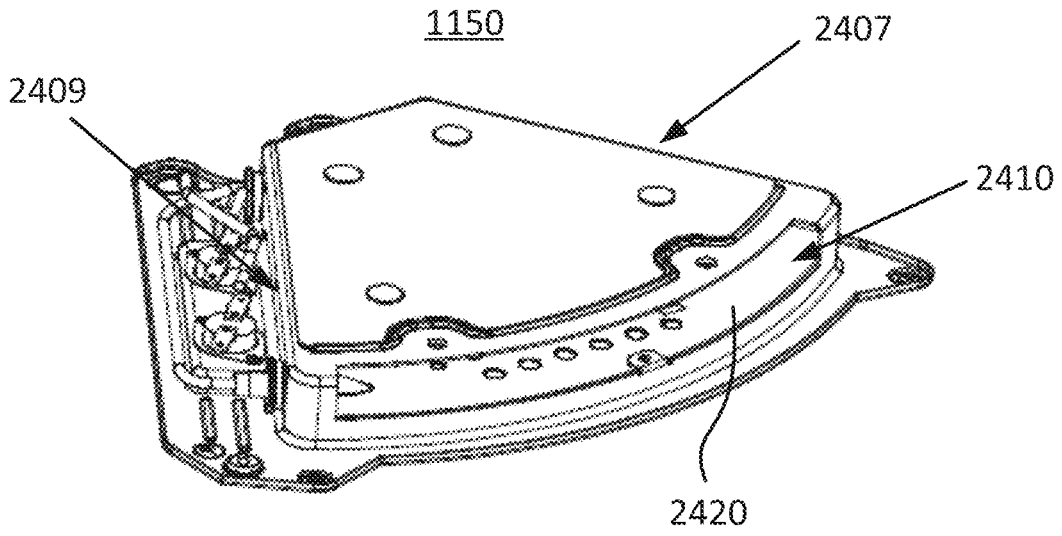
FIG. 24B shows a perspective view of a heating section, in accordance with some embodiments.
Figure 24C:
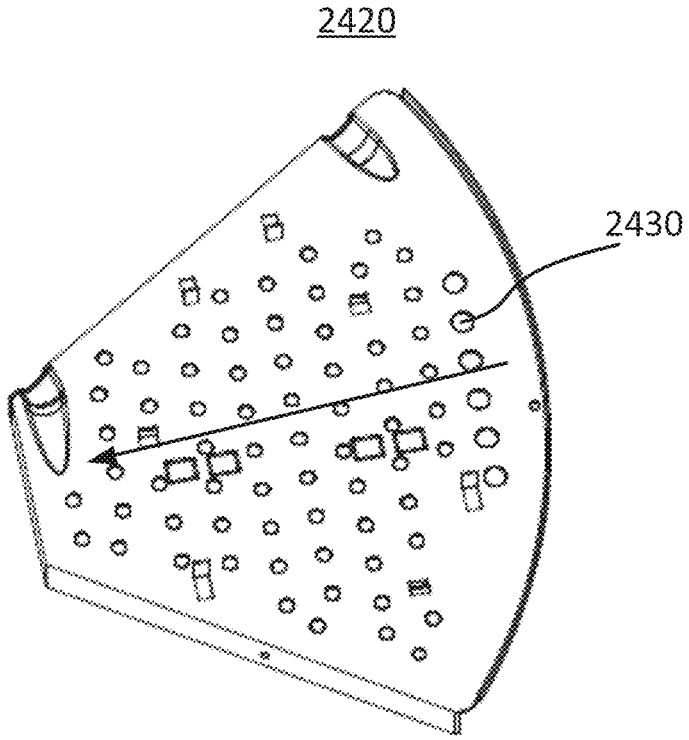
FIG. 24C shows a perspective view of a mesh plate used in a heating section, in accordance with some embodiments.
Figure 24D:
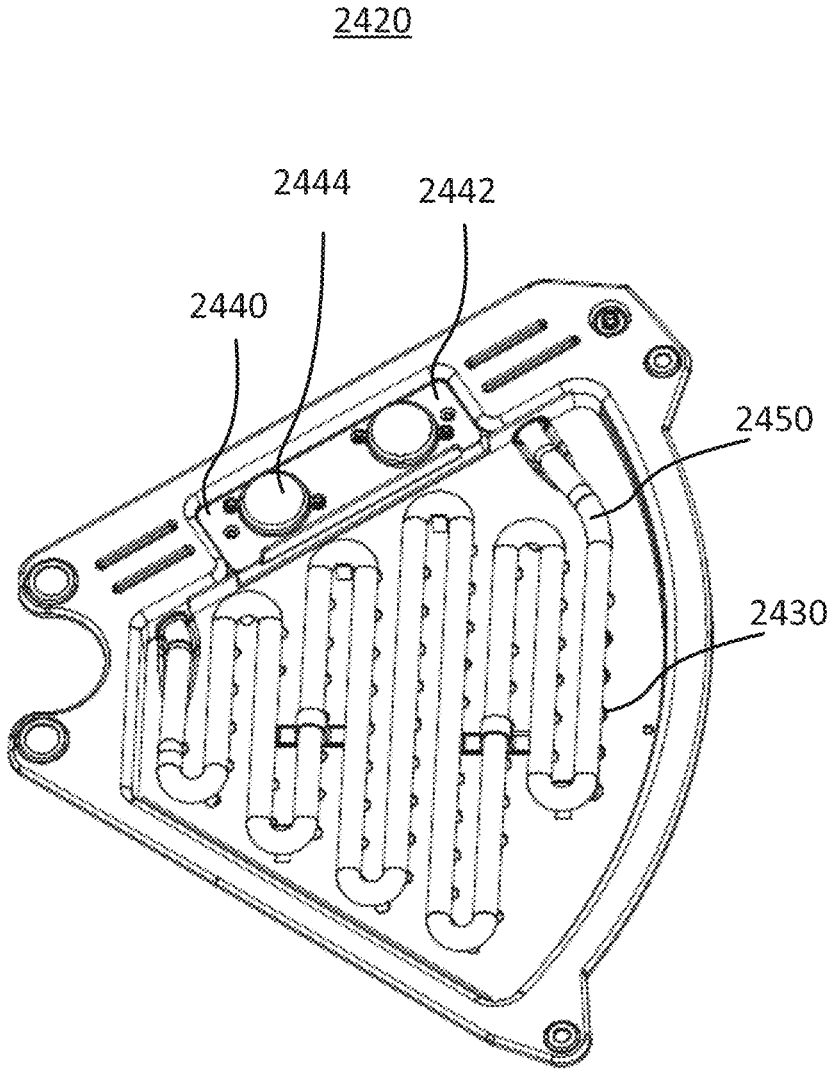
FIG. 24D shows a top view of a mesh plate coupled with a plurality of heating elements in a heating section, in accordance with some embodiments.

FIG. 24B shows a perspective view of heating section 1150, in accordance with some embodiments. FIG. 24C shows a perspective view of a mesh plate 2420 used in heating section 1150, in accordance with some embodiments. FIG. 24D shows a top view of mesh plate 2420 coupled with heating elements 2450 in heating section 1150, in accordance with some embodiments. In some embodiments, heating section 1150 has a fan-shaped structure, including a space (e.g., regeneration airflow passage coupled between regeneration section 1120 and heating section 1150 via an air inlet on a side 2410 as shown in FIG. 22) formed by upper and lower casings and two side walls along a radial direction as shown in FIG. 24B. In some embodiments, mesh plate 2420, and heating elements 2450 located under mesh plate 2420 are disposed in the space (e.g., the regeneration airflow passage).

In some embodiments, the airflow enters from side 2410 from the regeneration airflow passage, passes radially across mesh plate 2420, and flows down toward heating elements 2450 through a plurality of air holes 2430 on mesh plate 2420. The heated airflow then flows to the regeneration area of the roller, thus having the effect of heating and dehumidification at the regeneration area (e.g., moisture removal). In some embodiments, air holes 2430 are distributed to have reduced diameters inward along the radius. In some embodiments, the airflow can enter heating section 1150 from a different side, such as a side 2409 as shown in FIG. 24B, and flow across mesh plate 2420 to get in contact with heating elements 2450 through air holes 2430, and exit heating section 1150 from another side, such as a side 2407 or side 2410, for more evenly distributed heated airflow and more homogenous regeneration flow.

In some embodiments, heating elements 2450 are distributed next to mesh plate 2420, e.g., in close proximity, so as not to form a large resistance for the airflow passing through air holes 2430. In some embodiments, heating elements 2450 are placed next to the air holes 2430 and with an offset inward along the radius, so that when the airflow blows inward along the radius and passes through air holes 2430, a speed can be generated along the radius pointed by the arrow, and the offset can make the airflow passing through air holes 2430 facing the heating elements 2450.

In some embodiments, as shown in FIG. 24D, thermostat mounting portion 2440 can monitor the temperature of the area and control on or off of heating elements 2450. In some embodiments, a heat-conducting sheet 2442 is arranged on thermostat mounting portion 2440, and then a temperature controller 2444 is arranged on heat-conducting sheet 2442. For example, heat-conducting sheet 2442 covers temperature controller 2444, so that the temperature of heating section 1150 can be conducted to the heat-conducting sheet 2442, and temperature controller 2444 can detect the temperature of heat-conducting sheet 2442. This can avoid the problem when the airflow carries heat forms turbulent flow in heating area, the unstable temperature distribution can hinder effective temperature sensing and control of heating elements 2450.

In some embodiments, instead of using heating regeneration methods, other types of regeneration methods can be used, such as ultrasonic regeneration, microwave regeneration, etc. When using another type of regeneration method, a corresponding change to the roller material can adopted. In some embodiments, lithium chloride, zeolite, modified silica gel, etc. are moisture absorption roller materials, and are suitable for heating generation process. In some embodiments, silica gel can be used for ultrasonic regeneration. In some embodiments, roller materials can also include activated alumina, Molecular Sieve 13X (e.g., sodium type) molecular sieve, etc. In some embodiments, moisture absorption can include a container containing liquid solvent, gel, or solid agents for absorbing water.

Figure 25:
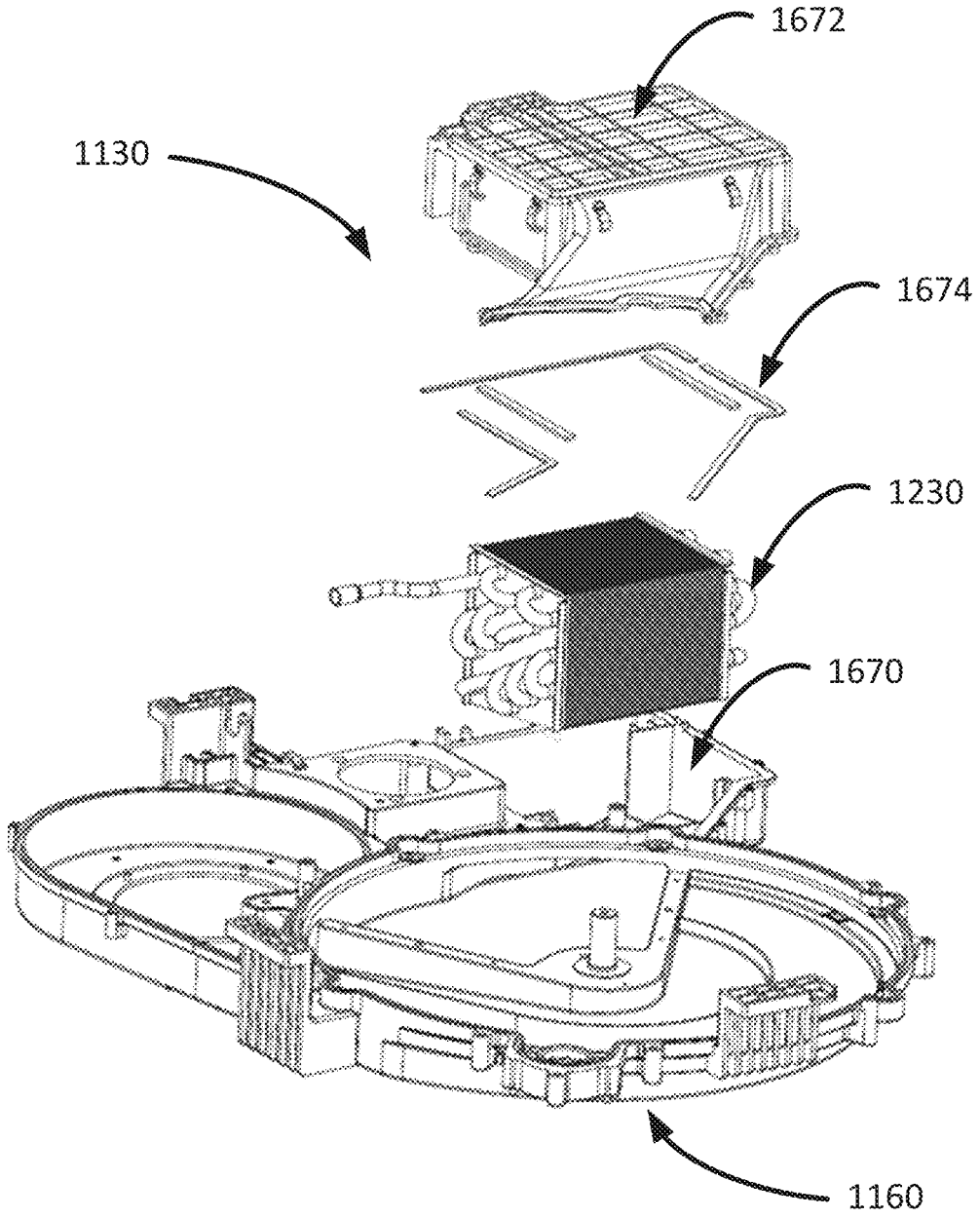
FIG. 25 shows an exploded view illustrating a condensing section including a condenser for installation on a lower casing, in accordance with some embodiments.

FIG. 25 shows an exploded view illustrating condensing section 1130 including condenser 1230 to be installed on lower casing 1160, in accordance with some embodiments. Condenser 1230 can be fitted into to condenser area 1670 on lower casing 1160 through the partition members and space limit. The casing 1672 of condenser 1230 presses down sealing strip 1674 surrounding condenser 1230 to achieve the sealing effect.

Figure 26:
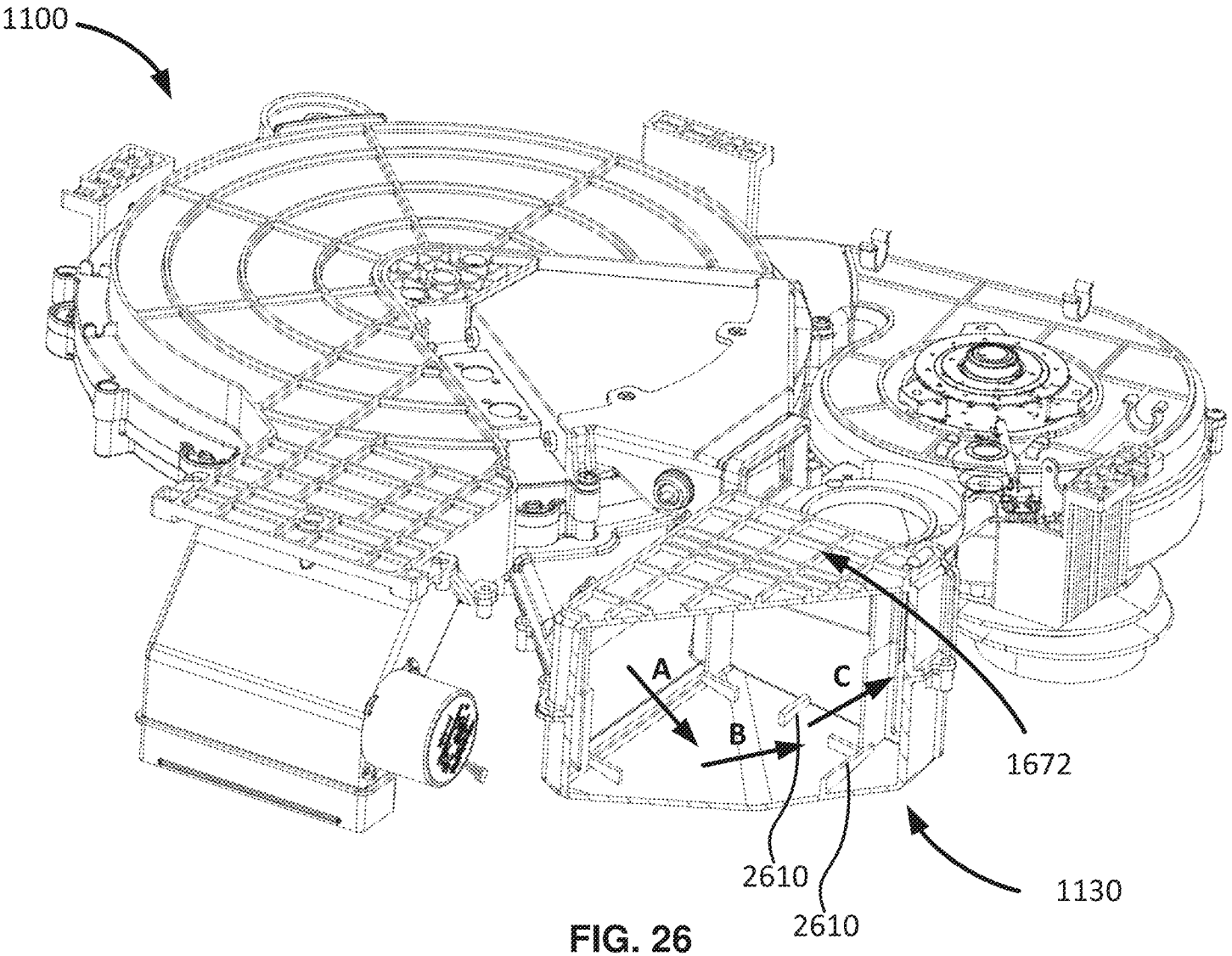
FIG. 26 shows a perspective view of a dehumidifier including a condensing section, in accordance with some embodiments.

FIG. 26 shows a perspective view of dehumidifier 1100 including condensing section 1130, in accordance with some embodiments. In some embodiments, the air circulation in condensing section 1130 includes: the high-temperature and high-humidity air enters the condensation area B from the air inlet A, and the dry air after passing through the condenser exits the condenser area B from the air outlet C. In some embodiments, casing 1672 includes one or more baffle plates 2610 extending from the lower surface and are placed below the condenser contained in casing 1672 to prevent the high-humidity gas from being directly reaching air outlet C from the bottom of condenser and blown out of condensing section 1130, without passing through the condenser. In some embodiments, casing 1672 does not include baffle plates.

Figure 27A:
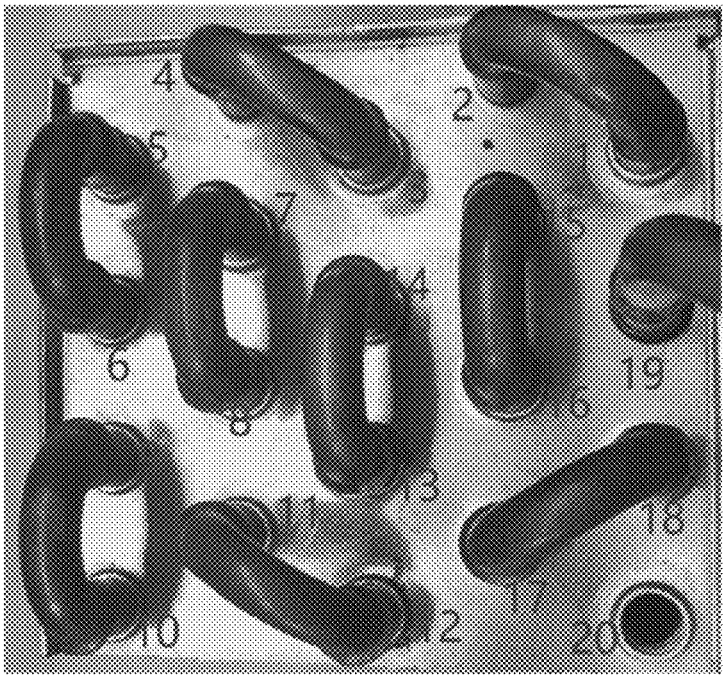
FIG. 27A shows a condensing pipeline arrangement for a condenser, in accordance with some embodiments.
Figure 27B:
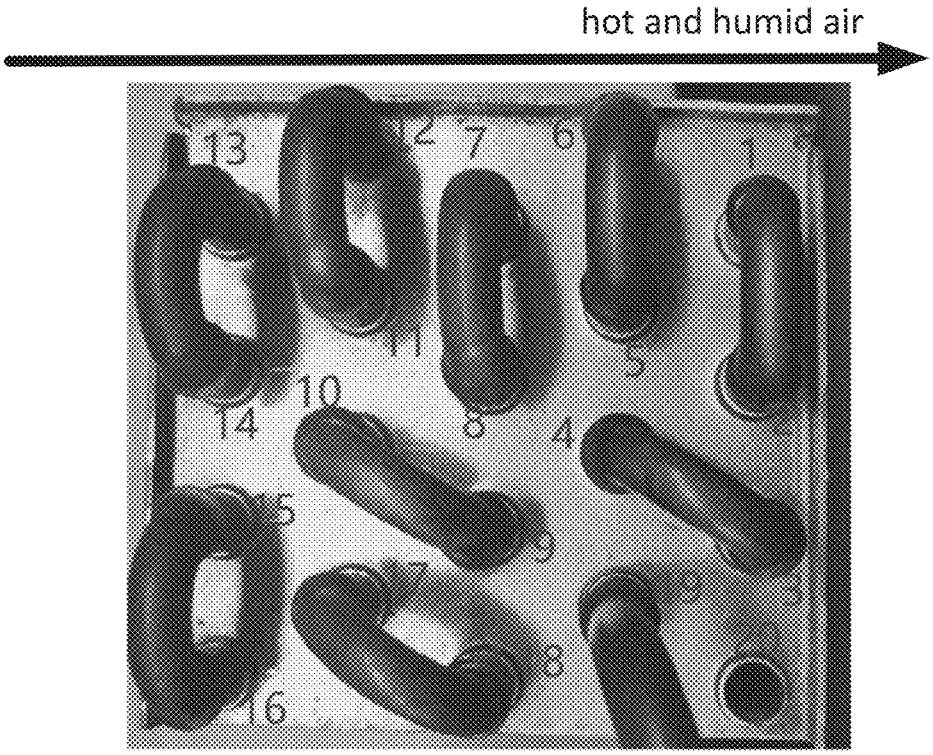
FIG. 27B shows a condensing pipeline arrangement for a condenser, in accordance with some embodiments.

FIGS. 27A-27B show schematic views of respective condensing pipeline arrangements for condenser 1230, in accordance with some embodiments. In some embodiments, condensing process uses a water-cooling scheme. For example, the hot and humid air absorbed from the wet laundry enters condenser 1230 and gets condensed into water, so as to achieve the purpose of drying of the moist and hot air. A good pipeline design can improve the condensation efficiency and shorten the condensation time. FIG. 27A shows an overall pipeline routing from top to bottom. FIG. 27B shows an overall pipeline routing from right to left and top to bottom. The order of condensate water entering and exiting is as follows numbers 1-20.

In some embodiments, the main principle of condensation is that when the hot and humid air encounters a low-temperature object, such as cooling water running in the pipelines of condenser 1230, the moisture in the hot and humid air gets condensed into water. In some embodiments shown in FIG. 27A, the water temperature is relatively high from the top to the bottom. In some embodiments shown in FIG. 27B, the temperature of the condensed water gradually increases from right to left, while the temperature of the hot and humid air gradually decreases from left to right. As such, humid and hot air and the condensed water can maintain a certain temperature difference during the whole condensation process, which is beneficial for condensation.

In some embodiments, in addition to one condenser placed in the regeneration passage, a second condenser or a condensing member can also be arranged between the air outlet of the rotary drum of the laundry machine and the roller, so as to first condense the hot and humid airflow with a relatively high temperature exhaust from the drum to reduce the water content, and then use roller for the moisture absorption process.

Figure 28:
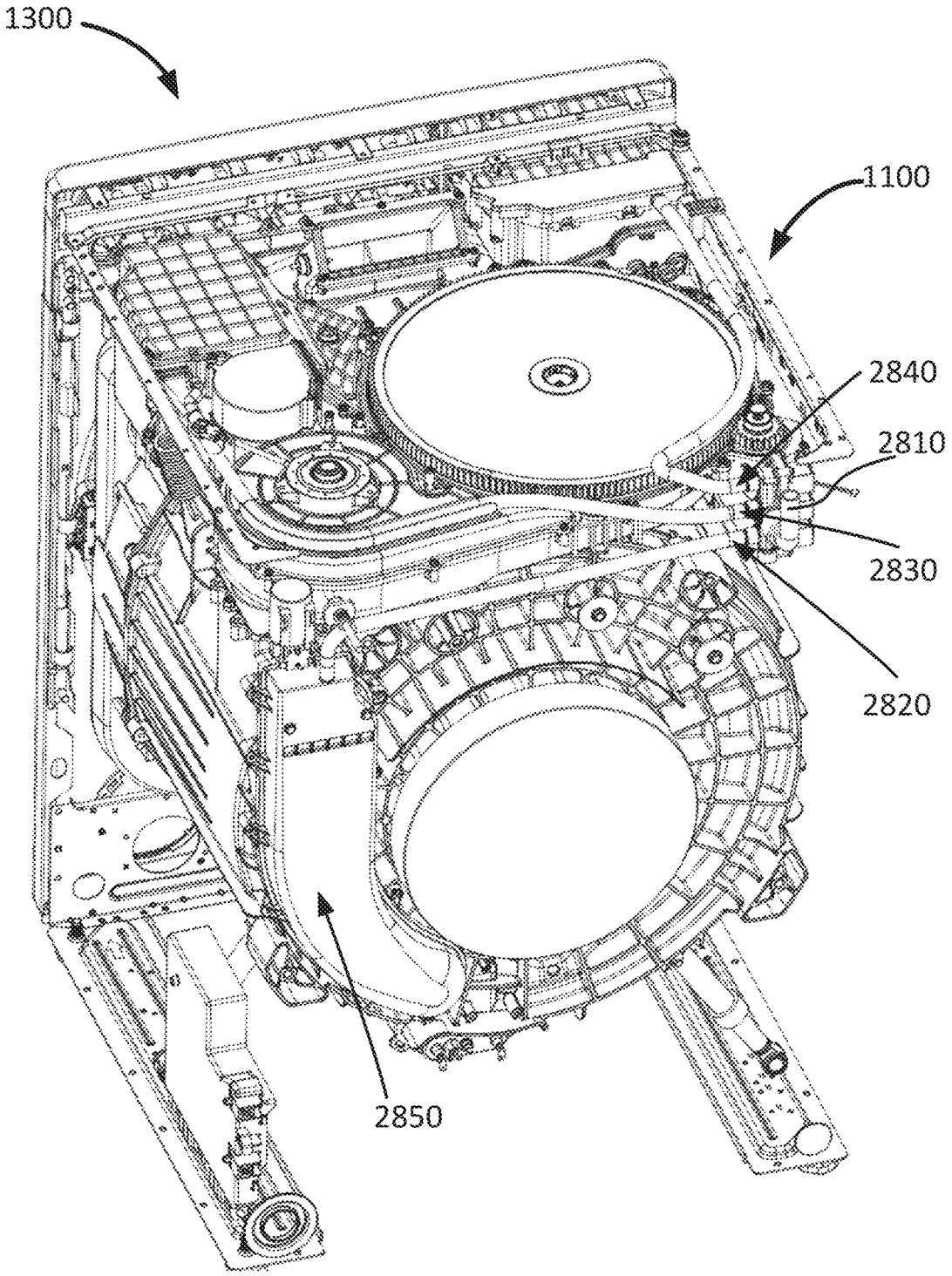
FIG. 28 shows a schematic view of a plurality of components contained inside a laundry machine, in accordance with some embodiments.

FIG. 28 shows a schematic view of a plurality of components inside laundry machine 1300, in accordance with some embodiments. The laundry machine may include a water inlet 2810 connected to the water pipe, and three water outlets, including a condenser water outlet 2840 used to provide low-temperature water to the condenser, a filter self-cleaning water outlet 2820 used for supplying water for the filter screen self-cleaning nozzle, and a drum and detergent box cleaning water outlet 2830 for supplying water to the laundry machine drum and/or detergent box. In some embodiments, water outlet 2830 has a solenoid valve switch, to control when to supply the water to the drum, or when to supply the water to the detergent box. In some embodiments, the water pipe connected to water outlet 2830 is connected to the detergent box, so that during the cleaning process, the water first flushes the detergent from the detergent box into the inside of the drum, and then continues to fill the drum with water for laundry washing.

In some embodiments, an air exhaust passage 2850 is connected to air outlet of the drum. Driven by the circulating fan, the humid air in the drum is introduced into the dehumidification area of the roller for dehumidification. In some embodiments, a filter screen is arranged in the exhaust passage 2850 for intercepting and filtering the fluff that may be generated in the drum when washing or drying clothes, so as to prevent the fluff from entering and blocking the roller area to affect the dehumidification effect. In some embodiments, if the fluff gets adhered to the dehumidification area on the roller, the fluff may further be brought into the regeneration area due to the rotation of the roller. Because the regeneration area has a heating mechanism, the fluff may be ignited.

Figure 29B:
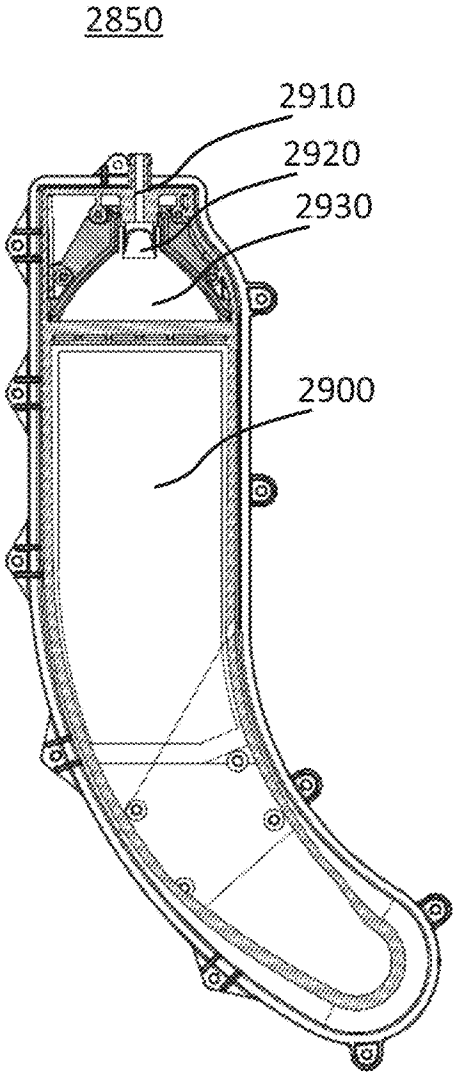
FIG. 29B shows a perspective view of an air exhaust pipeline including a filter screen connected to a drum of a laundry machine, in accordance with some embodiments.
Figure 29A:
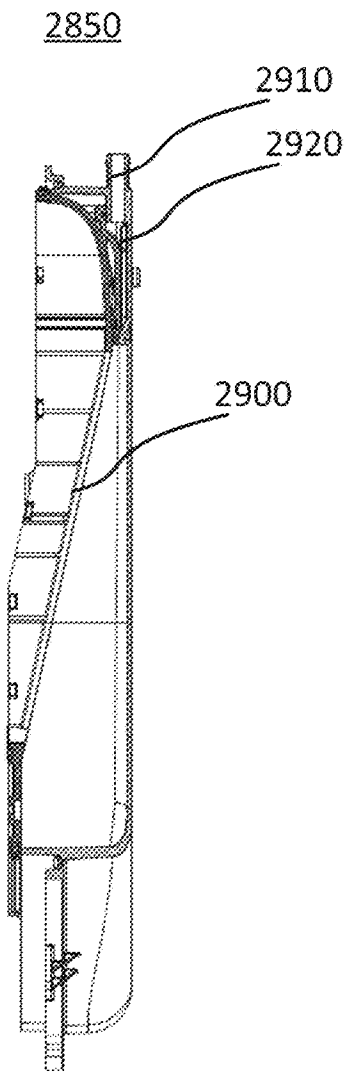
FIG. 29A shows a perspective view of an air exhaust pipeline including a filter screen connected to a drum of a laundry machine, in accordance with some embodiments.
Figure 29C:
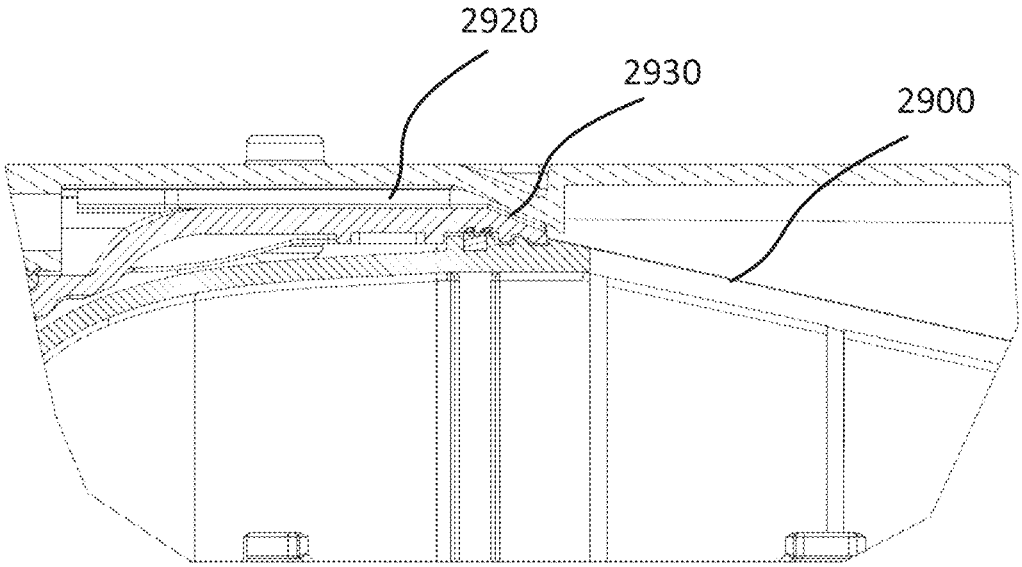
FIG. 29C shows a perspective view of an air exhaust pipeline including a filter screen connected to a drum of a laundry machine, in accordance with some embodiments.

FIGS. 29A-29C show perspective views of air exhaust passage 2850 including a filter screen 2900, in accordance with some embodiments. As shown in FIG. 29A, a water inlet 2910 (e.g., connected to filter self-cleaning water outlet 2820) of a nozzle 2920, wherein nozzle 2920 connects inlet 2910 with filter screen 2900 and gradually becomes flat, so that the water flow can cover the entire width of filter screen 2900. In some embodiments, filter screen 2900 is tilted and extends through the whole air outlet pipeline, e.g., air exhaust passage 2850, so as to increase the area of filter screen 2900 in air exhaust passage 2850 in contact with the airflow to prevent blockage on filter screen 2900 resulting in reduced airflow passing efficiency. The increased area of filter screen 2900 extended in air exhaust passage 2850 will not affect the airflow passing efficiency through filter screen 2900 even if there is uncleaned place during the self-cleaning process. In some embodiments, the inclination angle of filter screen 2900 is small, to effectively prevent fluff from stuck into filter screen 2900, so as not to make self-cleaning more difficult.

In some embodiments, self-cleaning water flows from water inlet 2910, through nozzle 2920, gets sprayed toward filter screen 2900. Meanwhile, moisture from the drum flows in an opposite direction. For example, the moisture flow first passes through one surface of the filter screen 2900 (which can be defined as the filter surface, used to intercept fluff, etc.), and then goes through the filter screen 2900, and continue to go up to the roller moisture absorption area. In some embodiments, the self-cleaning water flows out of water inlet 2910, reaches nozzle 2920, and flows through nozzle extension 2930, to rinse filter screen 2900 to wash away the fluff adhered to it. As shown in FIG. 29B, nozzle extension 2930 may be extended to have the same width as filter screen 2900.

In some embodiments, after rinsing filter screen 2900, the self-cleaning water flows to the drain port of the laundry machine to be discharged out of the laundry machine. In some embodiments, this drain port can be used for discharging self-cleaning water only. In some embodiments, this drain port can be a water outlet combined with the drain port of the drum of the laundry machine.

Figure 30B:
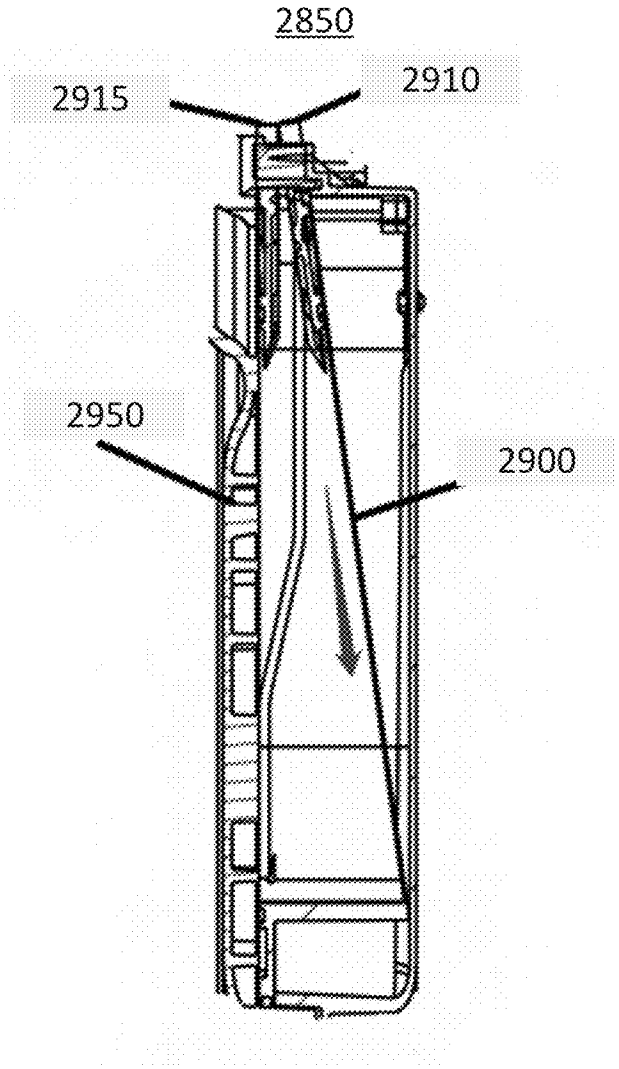
FIG. 30B shows a perspective view of an air exhaust pipeline including a filter screen connected to a drum of a laundry machine, in accordance with some embodiments.
Figure 30A:
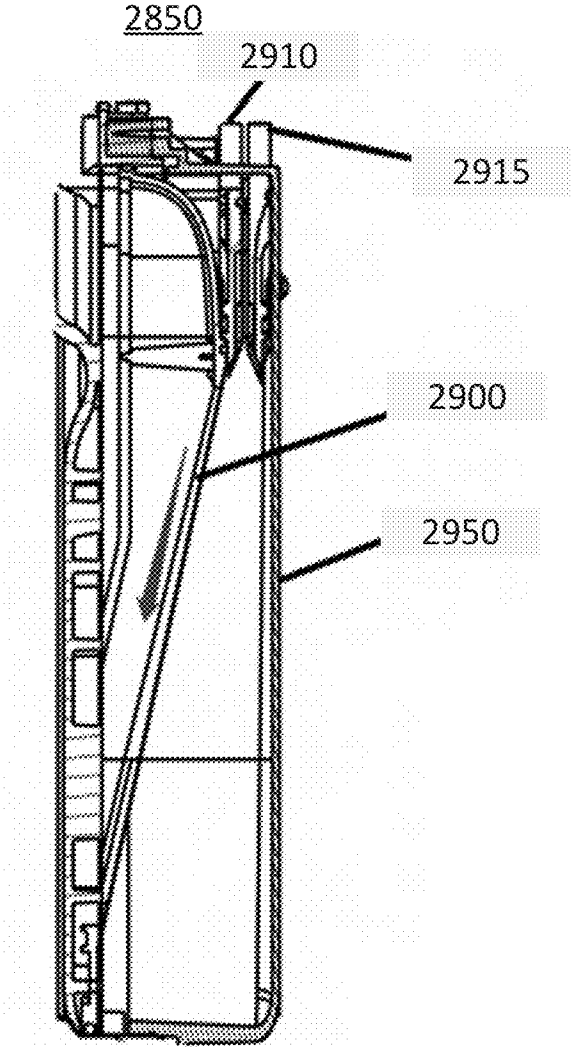
FIG. 30A shows a perspective view of an air exhaust pipeline including a filter screen connected to a drum of a laundry machine, in accordance with some embodiments.

FIGS. 30A-30B show perspective views one or more parts of air exhaust passage 2850 including filter screen 2900, in accordance with some embodiments. In some embodiments, water inlet 2910 is used to spray water on filter screen 2900 for cleaning. In some embodiments, the condensation function of the air exhaust passage 2850 of the drum is to spray water slowly to an outer wall 2950 of exhaust passage 2850 through a second water inlet 2915, so as to keep the temperature low on pipeline wall 2950, and to condense the hot and humid air flowing through exhaust passage 2850. In some embodiments, a water flow passage is formed to guide the condensed water to be sprayed on outer wall of the pipe without being spilled. and flow into the drum outer tub or the water outlet pipe of the laundry machine.

Figure 31A:
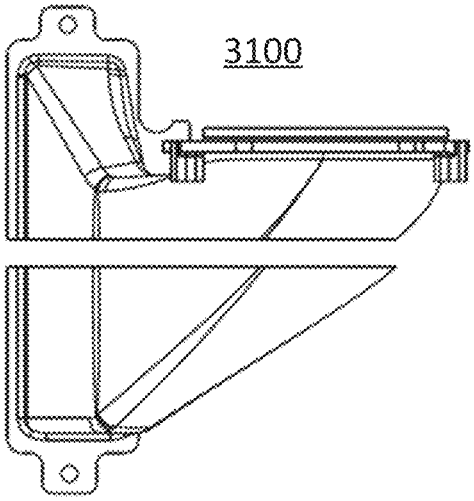
FIG. 31A shows a perspective view of a part of a connector, in accordance with some embodiments.
Figure 31B:
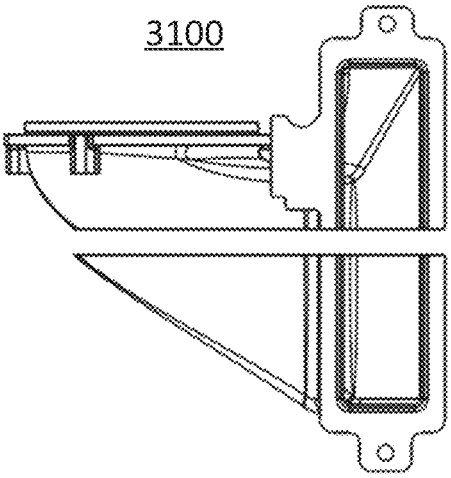
FIG. 31B shows a perspective view of a part of a connector, in accordance with some embodiments.
Figure 31C:
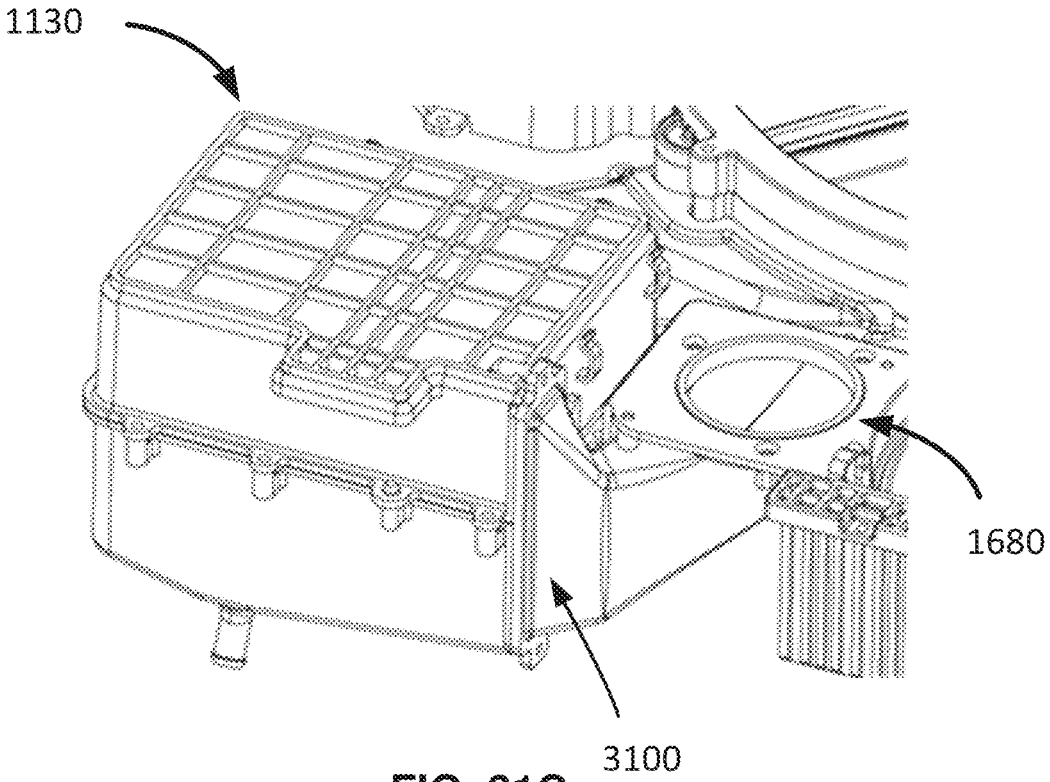
FIG. 31C shows a connector connecting a condenser section and a regeneration area for holding a regeneration section, in accordance with some embodiments.
Figure 32A:
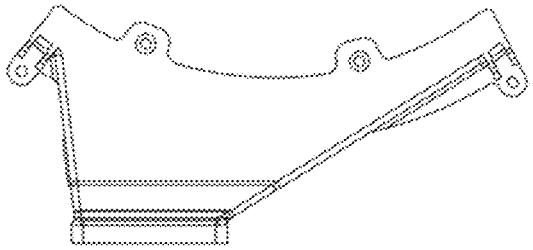
FIG. 32A shows a perspective view a part of a connector, in accordance with some embodiments.
Figure 32B:
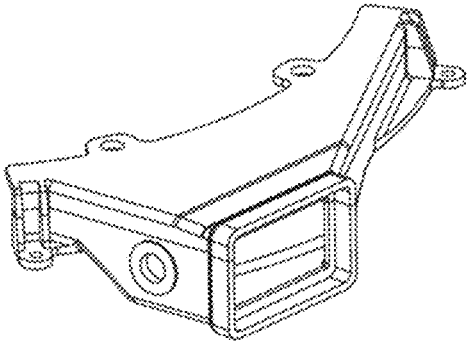
FIG. 32B shows a perspective view of a connector, in accordance with some embodiments.
Figure 32C:
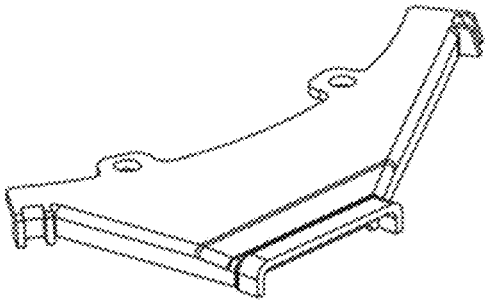
FIG. 32C shows a perspective view a part of a connector, in accordance with some embodiments.
Figure 32D:
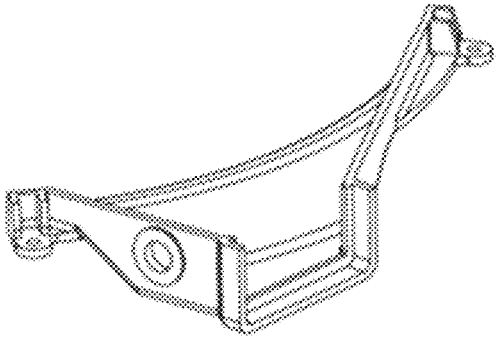
FIG. 32D shows a perspective view a part of a connector, in accordance with some embodiments.
Figure 32E:
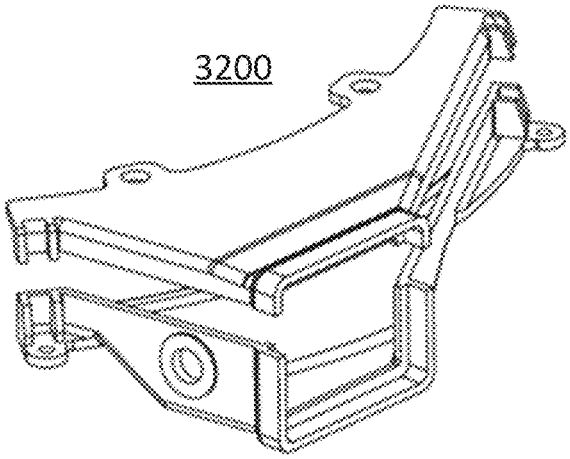
FIG. 32E shows a perspective view of a connector, in accordance with some embodiments.

FIGS. 31A-31C show perspective views of a connector 3100, such as an air duct connector, in accordance with some embodiments. In some embodiments, one end of connector 3100 is connected to condenser section 1130, e.g., the lower casing and the condenser upper casing, and the other end of connector 3100 is connected to regeneration area 1680 for holding regeneration fan 1220. In some embodiments, connector 3100 helps to facilitate circulation of air from condenser to regeneration fan so as to cool the temperature down. In some embodiments, air duct connector 3100 can be disassembled into an upper part and a lower part in production, which are formed by welding after processing respectively. In some embodiments, the shape of air duct connector 3100 can adjust air duct direction, improve sealing, while ensuring manufacturability. In some embodiments, connector 2250 as shown in FIG. 22 is connector 3100.

FIGS. 32A-32E show perspective views of one or more parts of a connector 3200, such as an air duct connector, in accordance with some embodiments. In some embodiments, connector 3200 is used to connect heating section 1150 with regeneration fan 1220. In some embodiments, connector 3200 helps to facilitate circulation of dry and cold air generated from regeneration fan 1220 to flow into heating section 1150. In some embodiments, connector 3200 can be disassembled into an upper part and a lower part in production, which are formed by welding after processing respectively. In some embodiments, the shape of connector 3200 can adjust air duct direction, improve sealing, while ensuring manufacturability. In some embodiments, connector 2220 as shown in FIG. 22 is connector 3200.

Figure 33:
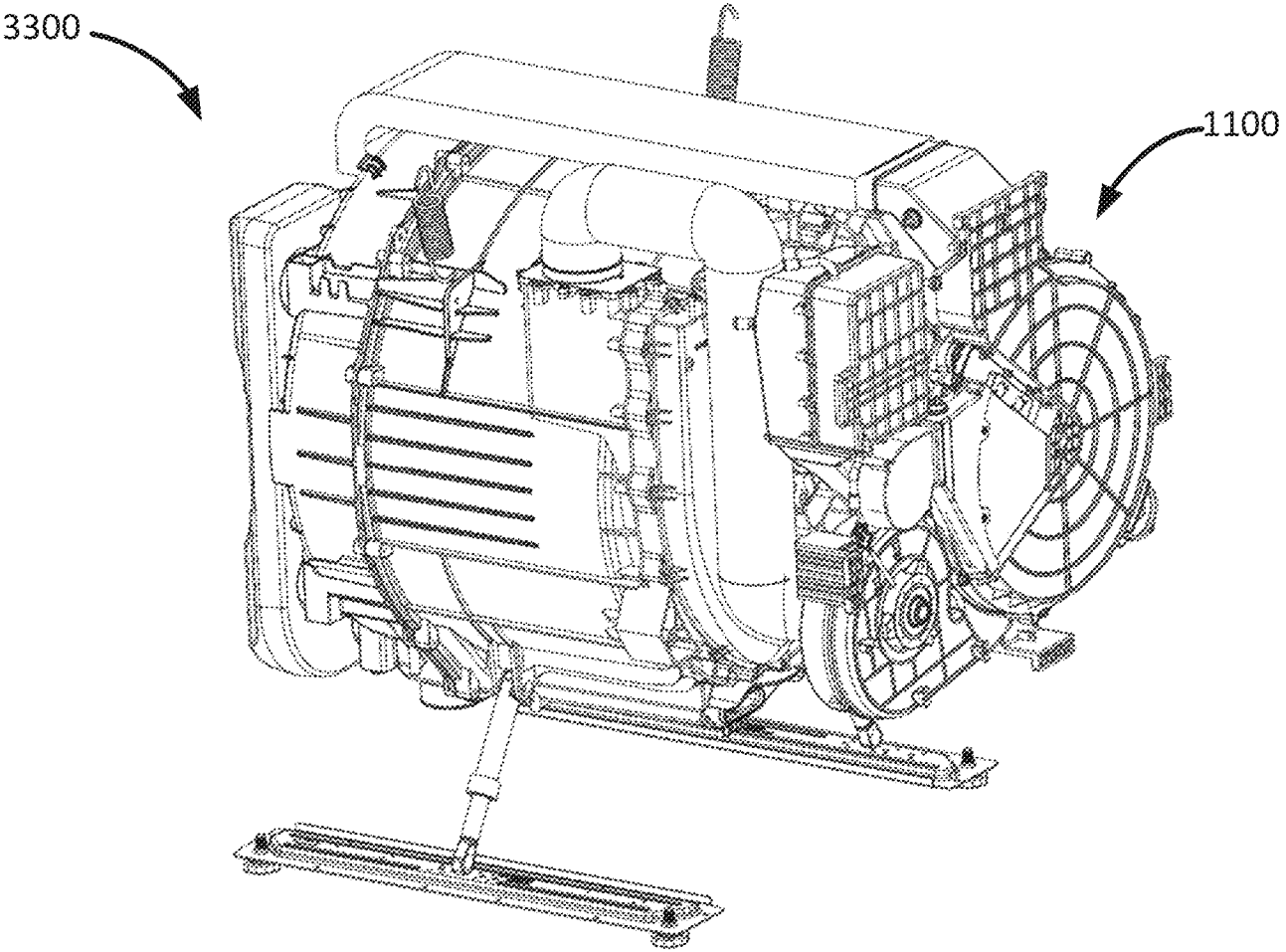
FIG. 33 shows a schematic view of a plurality of components contained inside a laundry machine, in accordance with some embodiments.
Figure 34:
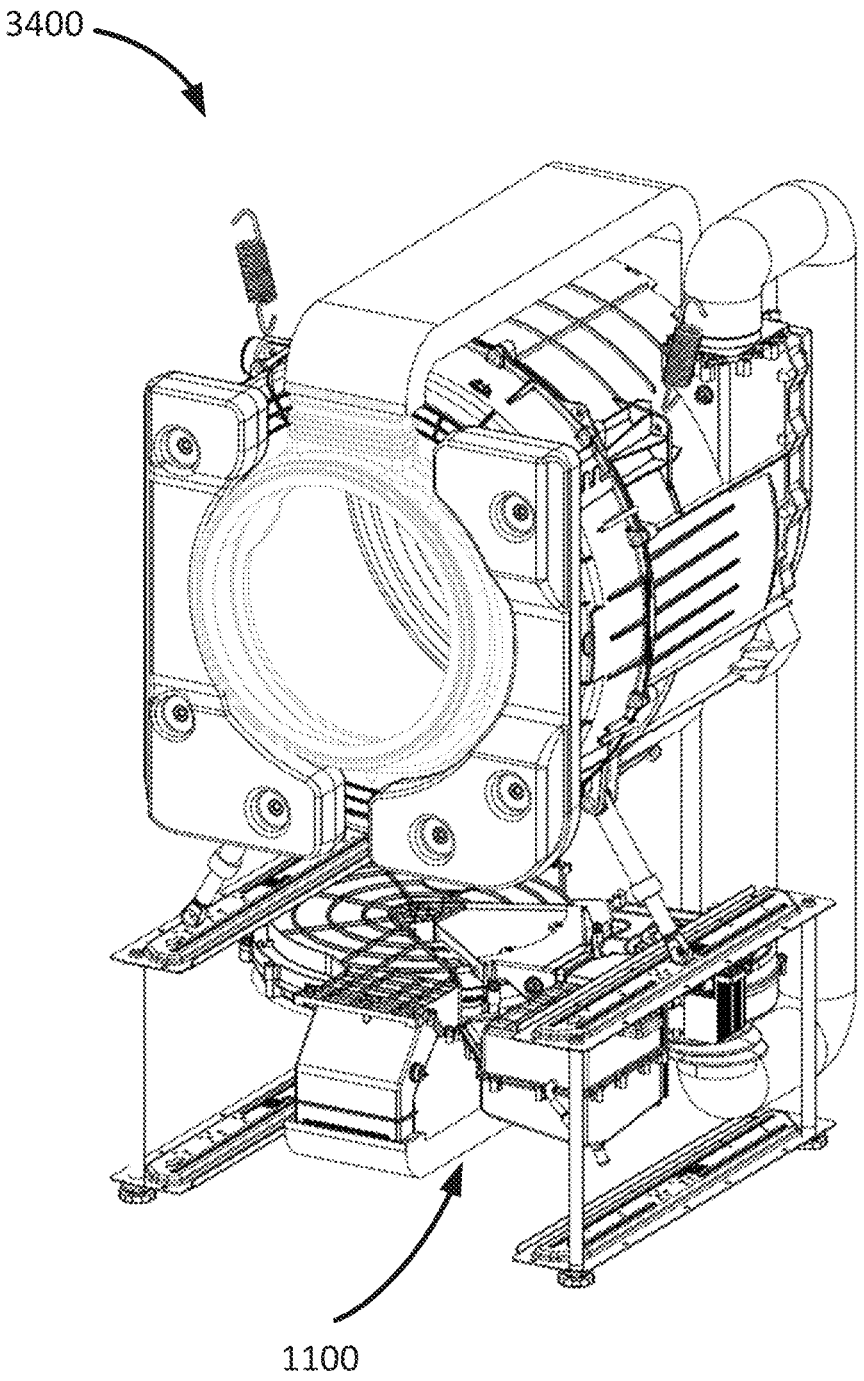
FIG. 34 shows a schematic view of a plurality of components contained inside a laundry machine, in accordance with some embodiments.

FIG. 33 shows a schematic view of a plurality of components contained inside laundry machine 3300, in accordance with some embodiments. In some embodiments, instead of placing dehumidifier 1100 on top of the rotary drum as shown in laundry machine 1300 of FIG. 28, laundry machine 3300 in FIG. 33 has dehumidifier 1100 place at the back of the rotary drum. FIG. 34 shows a schematic view of a plurality of components contained inside laundry machine 3400, in accordance with some embodiments. In some embodiments, laundry machine 3400 has dehumidifier 1100 place at the bottom of the rotary drum. As shown in FIGS. 28, 33, and 34, the laundry machine using dehumidifier 1100 with multiple parts disposed in a common plane can provide a more compact structure for the laundry machine to save storage space while maintaining high dehumidification efficiency. In some embodiments, dehumidifier 1100 has one or more parts of roller section 1140, circulation section 1110, regeneration section 1120, and condenser 1130 arranged within a common plane. For example, all of roller section 1140, circulation section 1110, regeneration section 1120, and condenser 1130 can be arranged within a plane as shown in dehumidifier 1100. In another example, roller section 1140 has a large dimension compared to other parts, and one or more of circulation section 1110, regeneration section 1120, and condenser 1130 can be placed within the same plane as roller section 1140, while other parts may be placed in other space(s) within the laundry machine suitable for the design and pipeline connection.

Figure 35:
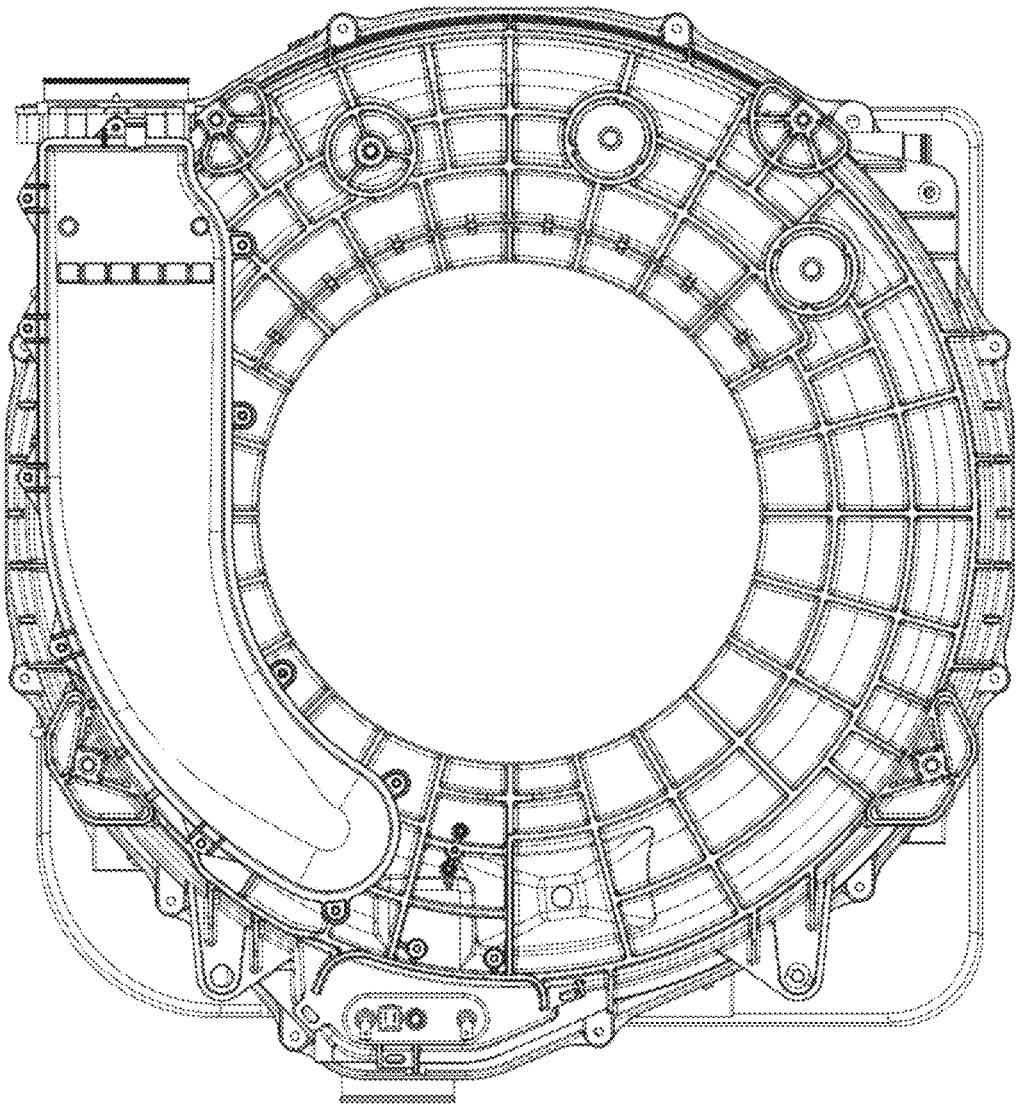
FIG. 35 shows a back view of a laundry machine, in accordance with some embodiments.

FIG. 35 shows a back view of laundry machine 3500, in accordance with some embodiments. In some embodiments, instead of placing air exhaust passage 2850 on rear left of the rotary drum, (e.g., FIGS. 13 and 28), laundry machine 3300 has air exhaust passage 2850 placed at the rear right of the rotary drum.

In some embodiments, the air exhaust passage 2850 can also extend from the rear left to the front left of the drum, and other structures can be modified accordingly. For example, the filter screen may be manual removed. Because the filter screen is taken out manually, the filter screen box with the filter screen can be placed on a certain part of the front panel of the laundry machine, and at least a part of the air intake pipeline is close to the front panel of the laundry machine.

A laundry machine is provided and includes:

a container for containing laundry; and a dehumidifier including a circulation fan configured to circulate moist air flowing out of the container toward a moisture absorption and removal structure configured to absorb moisture in the moist air, a regeneration fan configured to generate airflow to exhaust the moisture absorbed by the moisture absorption and removal structure and drive the airflow to flow toward a condenser configured to condense water from the generated airflow, wherein the moisture absorption and removal structure is disposed adjacent to the circulation fan, the regeneration fan, and the condenser.

In some embodiments, the circulation fan and the condenser are disposed adjacent to and on opposite sides of the regeneration fan.

In some embodiments, the moisture absorption and removal structure is disposed in a common plane with at least one of the circulation fan, the regeneration fan, and the condenser.

In some embodiments, the circulation fan, the moisture absorption and removal structure, the regeneration fan, and the condenser are disposed in a common plane.

In some embodiments, the moisture absorption and removal structure includes a roller assembly.

In some embodiments, two or more of respective rotation axes of the circulation fan, the roller assembly, and the regeneration fan in the dehumidifier are parallel to each other.

In some embodiments, the roller assembly further includes:

a plurality of auxiliary rollers contained in respective housings on a lower casing for containing one or more parts of the dehumidifier, wherein rotation axes of the plurality of auxiliary rollers are placed parallel to a rotation axis of a roller of the roller assembly.

In some embodiments, wherein the roller assembly further includes:

a plurality of vertical rollers distributed on a lower casing for containing one or more parts of the dehumidifier and rotation axes of the plurality of vertical rollers are placed vertically relative to a rotation axis of a roller of the roller assembly.

In some embodiments, one or more of respective rotation axes of the circulation fan, the roller assembly, and the regeneration fan in the dehumidifier are perpendicular to a rotation axis of the container.

In some embodiments, one or more of respective rotation axes of the circulation fan, the roller assembly, and the regeneration fan in the dehumidifier are parallel to a rotation axis of the container.

In some embodiments, the laundry machine further includes a lower casing including a plurality of areas configured to contain two or more of the circulation fan, the moisture absorption and removal structure, the regeneration fan, and the condenser, respectively.

In some embodiments, the lower casing is a single integrated part.

In some embodiments, the moisture absorption and removal structure includes a moisture absorption area and a moisture removal area;

the moisture absorption area includes at least a first portion of the moisture absorption and removal structure for absorbing the moisture from the moist air circulated from the circulation fan; and the moisture removal area includes a heating section disposed over a second portion of the moisture absorption and removal structure adjacent the regeneration fan.

In some embodiments, the dehumidifier further includes a moisture absorption passage, wherein the moisture absorption area is disposed on the moisture absorption passage, and wherein the moisture absorption passage is configured to flow airflow generated by the circulation fan from the container to the moisture absorption area.

In some embodiments, the dehumidifier further includes a moisture removal passage, wherein the moisture removal area is disposed on the moisture removal passage, and wherein the moisture removal passage is configured to flow airflow generated by the regeneration fan to flow toward the condenser for removing moisture in the airflow.

In some embodiments, the heating section includes a plurality of heating elements placed adjacent a plurality of air holes in a mesh plate.

In some embodiments, the heating section has a fan-shaped structure, and the plurality of air holes have respective diameters reducing along a radius direction toward a center of the fan-shaped structure.

In some embodiments, the plurality of heating elements are disposed adjacent the plurality of air holes and with an offset along the radius direction toward the center of the fan-shaped structure.

In some embodiments, the laundry machine further includes an air exhaust passage coupled to an air outlet of the container; and a filter assembly disposed on the air exhaust passage, the filter assembly including a filter screen; and a filter self-cleaning device for cleaning the filter screen.

In some embodiments, the dehumidifier further includes:

a volute casing configured to cover and attach the circulation fan to a lower casing for containing one or more parts of the dehumidifier.

an integrated washer dryer is provided and includes an inner drum, a drying module, a circulation fan, and a regeneration fan;

wherein the drying module includes a moisture absorption passage, a regeneration passage, and a moisture absorption component, the moisture absorption passage including a first air inlet and a first air outlet, and the inner drum being coupled with the first air inlet and the first air outlet respectively;

wherein the circulation fan is disposed on the moisture absorption passage to form circulating airflow in the inner drum and the moisture absorption passage, and the regeneration fan is disposed on the regeneration passage to form a dehumidification airflow in the regeneration passage; and wherein the moisture absorption component is disposed on the moisture absorption passage and the regeneration passage to enable the circulating airflow and the dehumidification airflow to flow through the moisture absorption component, wherein the moisture absorption component is configured to absorb moisture of the circulating airflow in the moisture absorption passage during rotation of the moisture absorption component, and discharge the moisture through the moisture exhaust airflow of the regeneration passage.

In some embodiments, the integrated washer dryer further includes:

a water inlet and a water outlet respectively coupled with the inner drum.

In some embodiments, the integrated washer dryer further includes:

a driving part coupled with the inner drum and configured to drive the inner drum to rotate.

In some embodiments, the integrated washer dryer further includes: a filtering part disposed on the moisture absorption passage, the filtering part being disposed at upstream of the moisture absorption component.

In some embodiments, the integrated washer dryer further includes: a filtering part disposed on the regeneration passage.

In some embodiments, the integrated washer dryer further includes: the moisture absorption passage further includes a heating member.

In some embodiments, the moisture absorption component includes a moisture absorption rotary disc and a heating assembly, wherein the heating assembly covers a regeneration area on the moisture absorption rotary disc, and a moisture absorption area on the moisture absorption rotary disc is disposed in the moisture absorption passage; and wherein the dehumidification airflow flows through the regeneration area on the moisture absorption rotary disc, and the circulating airflow flows through the moisture absorption area on the moisture absorption rotary disc.

In some embodiments, the heating assembly includes a cover, wherein the cover covers the regeneration area of the moisture absorption rotary disc, a part of the cover corresponding to the regeneration area includes an opening coupled with the regeneration passage, and the cover includes a regeneration heating portion.

In some embodiments, the moisture absorption rotary disc includes a moisture absorption roller and a rotary part coupled to the moisture absorption roller, and wherein a shell covers an outside the moisture absorption rotary disc, and the moisture absorption rotary disc is configured to rotate relative to the shell when driven by the rotary part; the shell is respectively connected to the moisture absorption passage and the regeneration passage.

In some embodiments, a condensing member is disposed on the regeneration passage, and the condensing member is configured to cool the dehumidification airflow in the regeneration passage to dry the dehumidification air flow.

In some embodiments, the integrated washer dryer further includes a controller, wherein a temperature sensor is disposed in the moisture absorption passage, and the controller is electrically connected to the temperature sensor and a heating member; and wherein the controller is configured to control the heating member to be switched on or switched off according to a detected temperature of the temperature sensor.

In some embodiments, a humidity sensor for detecting the humidity of the inner drum is disposed in the inner drum.

In some embodiments, the integrated washer dryer further includes two or more of the humidity sensors, wherein the temperature sensor is located at a different position than the humidity sensors of the inner drum.

In some embodiments, the integrated washer dryer further includes a housing;

wherein the inner drum and the driving part are disposed in the housing, the regeneration passage is at least partially disposed between the inner drum and the housing, and wherein a second air outlet and a second air inlet are disposed on a side surface of the housing, the second air outlet is connected to an air outlet end of the regeneration passage, and the second air inlet is connected to an air inlet end of the regeneration passage.

In some embodiments, the integrated washer dryer further includes a housing, wherein the moisture absorption component is located in the housing, the moisture absorption component is fixed, and the housing rotates relative to the moisture absorption component.

A laundry machine is provided and includes a housing including a plurality of containers for holding laundry, each of the plurality of containers including an air inlet passage and an air outlet passage; and a dehumidification device configured to selectively dehumidify laundry from a selected container of the plurality of containers, the dehumidification device including an air inlet for connecting with the air outlet passage of the selected container and an air outlet for connecting with the air inlet passage of the selected container.

In some embodiments, the laundry machine further includes:

a filter assembly, including:

a filter, arranged on the air outlet passage of the selected container or the air inlet of the dehumidification device; and a filter self-cleaning device for cleaning the filter.

In some embodiments, the dehumidification device selectively communicates with one of the plurality of containers in fluid communication through a switching mechanism.

In some embodiments, the dehumidification device includes a moisture absorption channel, a moisture removal channel, and a moisture absorption and moisture removal member, the moisture absorption and moisture removal member includes a moisture absorption area that communicates with the moisture absorption channel and a moisture removal area that communicates with the moisture removal channel;

the moisture absorption channel includes the air inlet of the dehumidification device located at an air inlet side on the moisture absorption area of the moisture absorption and moisture removal member and the air outlet of the dehumidification device located at an air outlet side of the moisture absorption area of the moisture absorption and moisture removal member;

the moisture removal channel includes an air intake section located on the air inlet side of a moisture removal area of the moisture absorption and moisture removal member, and an air removal section located at the air outlet side of the moisture removal area of the moisture absorption and moisture removal member;

the air inlet section of the moisture absorption channel is selectively in communication with the air outlet passage of the selected container, and the air outlet section of the moisture absorption channel is in communication with the air inlet passage of the selected container; or the moisture absorption and moisture removal member is rotatably arranged on the moisture absorption channel and the moisture removal channel.

In some embodiments, the laundry machine further includes a switching structure including a first switching mechanism and a second switching mechanism, the air inlet passage of the selected container being connected with the air outlet section of the moisture absorption channel through the first switching mechanism, and the air outlet passage of the selected container is connected with the air inlet section of the moisture absorption channel through the second switching mechanism.

In some embodiments, the filter and the filter self-cleaning device are arranged in the air inlet section of the dehumidification device and between the second switching mechanism and the moisture absorption and moisture removal member.

In some embodiments, the second switching mechanism is placed at a joint between the air inlet section of the dehumidification device and the air outlet passage of the container; or the laundry machine includes more than one second of the switching mechanisms arranged in the air outlet passage of the container.

in some embodiments, the laundry machine further includes:

more than one set of the filter and the filter self-cleaning device respectively arranged on the air outlet passage of the container and located upstream or downstream of the second switching mechanism.

In some embodiments, the filter self-cleaning device includes a spray mechanism for spraying the filter; or the filter self-cleaning device includes a vibration mechanism for vibrating the filter; or the filter self-cleaning device includes a blowing mechanism for blowing the filter; or the filter self-cleaning device includes a scraping mechanism for scraping the filter.

In some embodiments, a direction in which the fluid of the spray mechanism flows through the filter is opposite to a direction of the airflow through the filter; or the filter and the filter self-cleaning device are arranged in the air inlet section of the dehumidification device, and are located between a switching mechanism and the moisture absorption and moisture removal member, the filter self-cleaning device including a spraying mechanism for spraying the filter, wherein the fluid spraying direction of the spraying mechanism is a direction away from the moisture absorption and moisture removal member.

In some embodiments, a nozzle of the spray mechanism is arranged above a centerline of the filter; or the nozzle of the spray mechanism is arranged on the side of an air outlet of the filter.

in some embodiments, the laundry machine further includes:

a fan and a heater are arranged in the moisture removal channel, the heater being located in a vicinity of the moisture removal area of the moisture absorption and moisture removal member.

in some embodiments, the laundry machine further includes:

a heat exchanger arranged in the moisture removal channel, the heat exchanger being located on the air outlet side of the moisture removal area, and the heat exchanger includes a ventilation passage in communication with the moisture removal area and a water outlet for draining condensed water;

wherein:

the heat exchanger includes a cooling passage for a coolant to pass through, and an exhaust port of the ventilation passage of the heat exchanger communicates with an air inlet of the fan; or the heat exchanger includes a cooling passage for the coolant to pass through, and the exhaust port of the ventilation passage of the heat exchanger communicates with the outside of the laundry machine; or the fan includes an air inlet passage that passes through the interior of the heat exchanger.

in some embodiments, the laundry machine further includes:

a heat exchanger on the air outlet passage of the selected container or in the air inlet section of the dehumidification device to dehumidify and lower the temperature of the air flow discharged from the selected container, the moisture exhaust channel being located upstream of a moisture removal area through inside of the heat exchanger, so that hot and humid air in the air outlet passage of the container or in the air inlet section of the dehumidification device can perform heat exchange with dry and cold air in a moisture discharge passage located on an upstream of the moisture removal area.

In some embodiments, the plurality of containers include an upper tub and a lower tub stacked on top of each other, and the dehumidification device is located between the upper tub and the lower tub, above the upper tub, or below the lower tub.

In some embodiments, the upper tub and the lower tub are both inner tubs of the laundry machine; or the upper tub is the inner tub of a dryer and the lower tub is the inner tub of a washing machine; or the upper tub is the inner tub of the washing machine and the lower tub is the inner tub of the dryer.

A method of operating a laundry machine is provided and the laundry machine includes a housing including a plurality of containers for holding laundry, a dehumidification device, and a filter assembly between the dehumidification device and the plurality of containers, the filter assembly including a filter and a filter self-cleaning device, the method includes:

performing a dehumidification step including performing moisture removal of one of the containers selected and connected by the dehumidification device, wherein an air flow exhaust from the selected container flows into the dehumidification device via the filter assembly; and performing a cleaning step including cleaning, by the filter self-cleaning device, the filter.

In some embodiment, the filter self-cleaning device cleans the filter by a spraying method, a blowing method, a vibration method, or a scraping method.

It is to be understood that the disclosed embodiments are not necessarily limited in their application to the details of construction and the arrangement of the components set forth in the above description and/or illustrated in the drawings and/or the examples. The disclosed embodiments are capable of variations, or of being practiced or carried out in various ways. It will be apparent to those skilled in the art that various modifications and variations can be made to the disclosed devices and systems. Other embodiments will be apparent to those skilled in the art from consideration of the specification and practice of the disclosed devices and systems. It is intended that the specification and examples be considered as exemplary only, with a true scope being indicated by the following claims and their equivalents.

What is claimed is:

1. A laundry machine, comprising:

a container for containing laundry; and a dehumidifier including a circulation fan, a regeneration fan, a moisture absorption and removal structure and a condenser;

wherein the moisture absorption and removal structure comprises a moisture absorption area and a moisture removal area;

wherein the circulation fan is configured to circulate moist air flowing out of the container toward the moisture absorption area configured to absorb moisture in the moist air, the regeneration fan is configured to generate airflow to exhaust moisture of the moisture removal area and drive the airflow to flow toward the condenser, and the condenser is configured to condense water from the airflow generated by the regeneration fan, wherein the moisture absorption and removal structure is disposed adjacent to the circulation fan, the regeneration fan, and the condenser;

wherein the moisture absorption and removal structure comprises a roller assembly, a functional roller is provided on at least one of a bottom portion of the roller assembly or a side of the roller assembly;

wherein the functional roller comprises a plurality of auxiliary rollers provided on the side of the roller assembly; and a plurality of vertical rollers provided on the bottom portion of the roller assembly.

2. The laundry machine of claim 1, wherein the circulation fan and the condenser are disposed adjacent to and on opposite sides of the regeneration fan.

3. The laundry machine of claim 1, wherein the moisture absorption and removal structure is disposed in a common plane with at least one of the circulation fan, the regeneration fan, or the condenser.

4. The laundry machine of claim 1, wherein the circulation fan, the moisture absorption and removal structure, the regeneration fan, and the condenser are disposed in a common plane.

5. The laundry machine of claim 1, wherein two or more of respective rotation axes of the circulation fan, the roller assembly, and the regeneration fan in the dehumidifier are parallel to each other.

6. The laundry machine of claim 1, wherein the plurality of auxiliary rollers are contained in respective housings on a lower casing for containing one or more parts of the dehumidifier, wherein rotation axes of the plurality of auxiliary rollers are placed parallel to a rotation axis of a roller of the roller assembly.

7. The laundry machine of claim 1, wherein the plurality of vertical rollers are distributed on a lower casing for containing one or more parts of the dehumidifier, and rotation axes of the plurality of vertical rollers are placed vertically relative to a rotation axis of a roller of the roller assembly.

8. The laundry machine of claim 1, wherein one or more of respective rotation axes of the circulation fan, the roller assembly, and the regeneration fan in the dehumidifier are perpendicular to a rotation axis of the container.

9. The laundry machine of claim 1, wherein one or more of respective rotation axes of the circulation fan, the roller assembly, and the regeneration fan in the dehumidifier are parallel to a rotation axis of the container.

10. The laundry machine of claim 1, further comprising:

a lower casing including a plurality of areas configured to contain two or more of the circulation fan, the moisture absorption and removal structure, the regeneration fan, and the condenser, respectively.

11. The laundry machine of claim 10, wherein the lower casing is a single integrated part.

12. The laundry machine of claim 1, wherein the moisture absorption area comprises at least a first portion of the moisture absorption and removal structure for absorbing the moisture from the moist air circulated from the circulation fan; and the moisture removal area comprises a heating section disposed over a second portion of the moisture absorption and removal structure adjacent the regeneration fan.

13. The laundry machine of claim 12, wherein the dehumidifier further comprises a moisture absorption passage, wherein the moisture absorption area is disposed on the moisture absorption passage, and wherein the moisture absorption passage is configured to flow airflow generated by the circulation fan from the container to the moisture absorption area.

14. The laundry machine of claim 12, wherein the dehumidifier further comprises a moisture removal passage, wherein the moisture removal area is disposed on the moisture removal passage, and wherein the moisture removal passage is configured to flow airflow generated by the regeneration fan to flow toward the condenser for removing moisture in the airflow.

15. The laundry machine of claim 12, wherein the heating section comprises a plurality of heating elements placed adjacent a plurality of air holes in a mesh plate.

16. The laundry machine of claim 15, wherein the heating section has a fan-shaped structure, and the plurality of air holes have respective diameters reducing along a radius direction toward a center of the fan-shaped structure.

17. The laundry machine of claim 16, wherein the plurality of heating elements are disposed adjacent the plurality of air holes and with an offset along the radius direction toward the center of the fan-shaped structure.

18. The laundry machine of claim 1, further comprising:

an air exhaust passage coupled to an air outlet of the container; and a filter assembly disposed on the air exhaust passage, the filter assembly including a filter screen; and a filter self-cleaning device for cleaning the filter screen.

19. The laundry machine of claim 1, wherein the dehumidifier further comprises:

a volute casing configured to cover and attach the circulation fan to a lower casing for containing one or more parts of the dehumidifier.

20. The laundry machine of claim 1, wherein the roller assembly further comprises:

a peripheral upper casing;

a peripheral lower casing; and a roller contained and fixed between the peripheral upper casing and peripheral lower casing.

* * * * *